US010041687B1

(12) United States Patent
Caneba

(10) Patent No.: US 10,041,687 B1
(45) Date of Patent: Aug. 7, 2018

(54) VENT EXTENDER METHOD HAVING INTAKE AIR OPTION FOR CONVEYING VENTILATION TO CLOSE PROXIMITY OF A FUME AND ODOR SOURCE

(76) Inventor: Mary Ann Caneba, Houghton, MI (US)

( * ) Notice: Subject to any disclaimer, the term of this patent is extended or adjusted under 35 U.S.C. 154(b) by 3012 days.

(21) Appl. No.: 11/131,956

(22) Filed: May 17, 2005

(51) Int. Cl.
*F24C 15/20* (2006.01)
*F23J 11/00* (2006.01)

(52) U.S. Cl.
CPC ..... *F24C 15/20* (2013.01); *F23J 11/00* (2013.01)

(58) Field of Classification Search
CPC ..... F24C 15/20; F23J 11/00
USPC ..... 126/299 R, 299 D, 49, 65
See application file for complete search history.

(56) References Cited

U.S. PATENT DOCUMENTS

| | | | | |
|---|---|---|---|---|
| 3,131,687 | A | 5/1964 | Kalla | |
| 3,260,189 | A | 7/1966 | Jensen | |
| 3,303,839 | A | 2/1967 | Tavan | |
| 3,358,579 | A | 12/1967 | Hauville | |
| 3,425,335 | A | 2/1969 | Black | |
| 3,978,777 | A | 9/1976 | Nett | |
| 4,034,663 | A | 7/1977 | Jenn et al. | |
| 4,040,042 | A * | 8/1977 | Mayer | 454/340 |
| 4,200,087 | A | 4/1980 | Welsh | |
| 4,346,692 | A | 8/1982 | McCauley | |
| 4,411,675 | A * | 10/1983 | de Castella | 96/140 |
| 4,446,861 | A * | 5/1984 | Tada | 128/863 |
| 4,475,534 | A | 10/1984 | Moriarty | |
| 4,788,964 | A | 12/1988 | Dorsey et al. | |
| 5,279,279 | A | 1/1994 | White | |
| 5,884,619 | A | 3/1999 | Terry | |
| 6,216,686 | B1 * | 4/2001 | Chiu | 126/299 R |
| 6,647,978 | B1 | 11/2003 | Khosropour et al. | |
| 2004/0011349 | A1 | 1/2004 | Livchak | |
| 2004/0206348 | A1 | 10/2004 | Bourassa | |

FOREIGN PATENT DOCUMENTS

| | | | | |
|---|---|---|---|---|
| DE | 10325809 | A1 * | 1/2005 | F24C 15/20 |
| DE | 10325809 | A1 * | 1/2005 | F24C 15/20 |
| EP | 1418386 | A2 * | 10/2003 | F24C 15/20 |
| EP | 1418386 | A2 * | 10/2003 | F24C 15/20 |
| JP | 20032002145 | * | 7/2003 | F24F 7/06 |

* cited by examiner

*Primary Examiner* — Gregory Huson
*Assistant Examiner* — Nikhil Mashruwala

(57) ABSTRACT

One vent extender method comprises providing the underside of an over-the-range type vent hood with an exhaust enclosure having an outlet opening and at least one inlet opening. The outlet opening is disposed upstream to the existing exhaust fan. An exhaust ducting system comprises a tube having a downstream end attachable to an inlet opening and an upstream end attachable to a first canopy. The exhaust ducting system delivers the suction power of the exhaust fan closer to the fume and odor source and guides the vapors toward the outlet opening of the enclosure. An improved method comprises the use of an intake ducting system enveloping the exhaust ducting system for delivering intake air right to the periphery of the cooking vessel. Another improvement comprises the use of a double-walled canopy with two separate top openings for connecting to an exhaust power source and an intake air source.

2 Claims, 49 Drawing Sheets

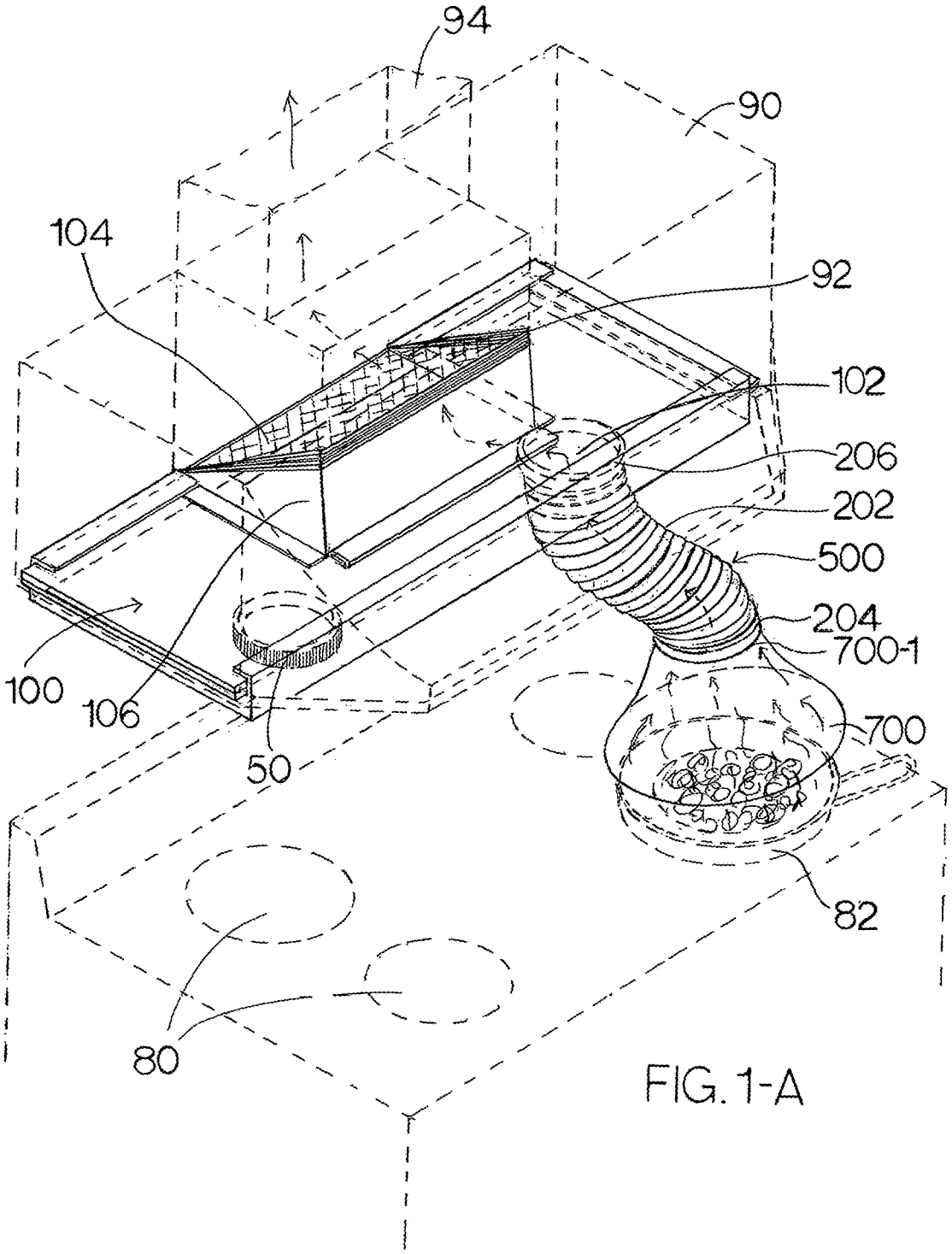
FIG. 1-A

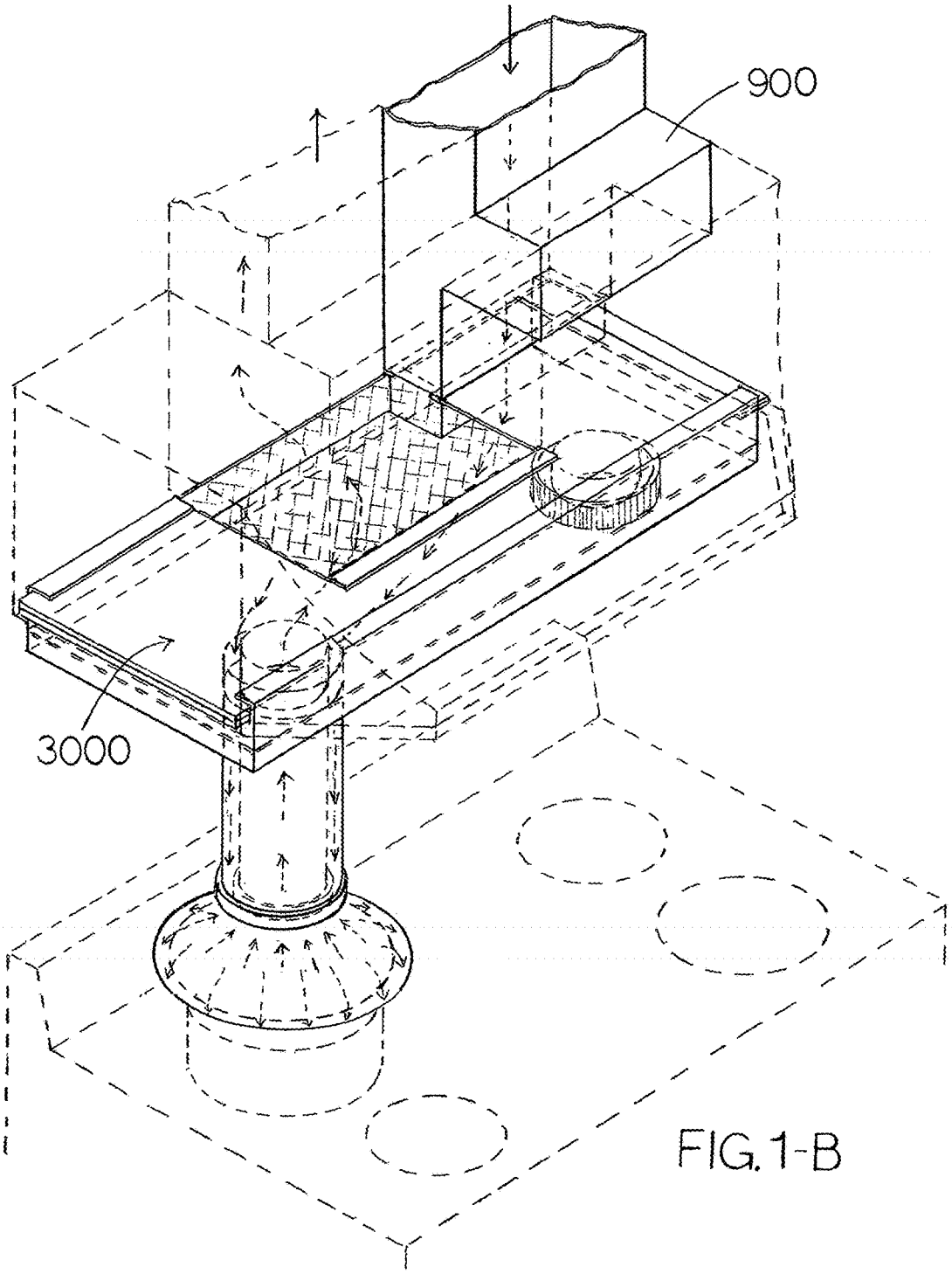
FIG. 1-B

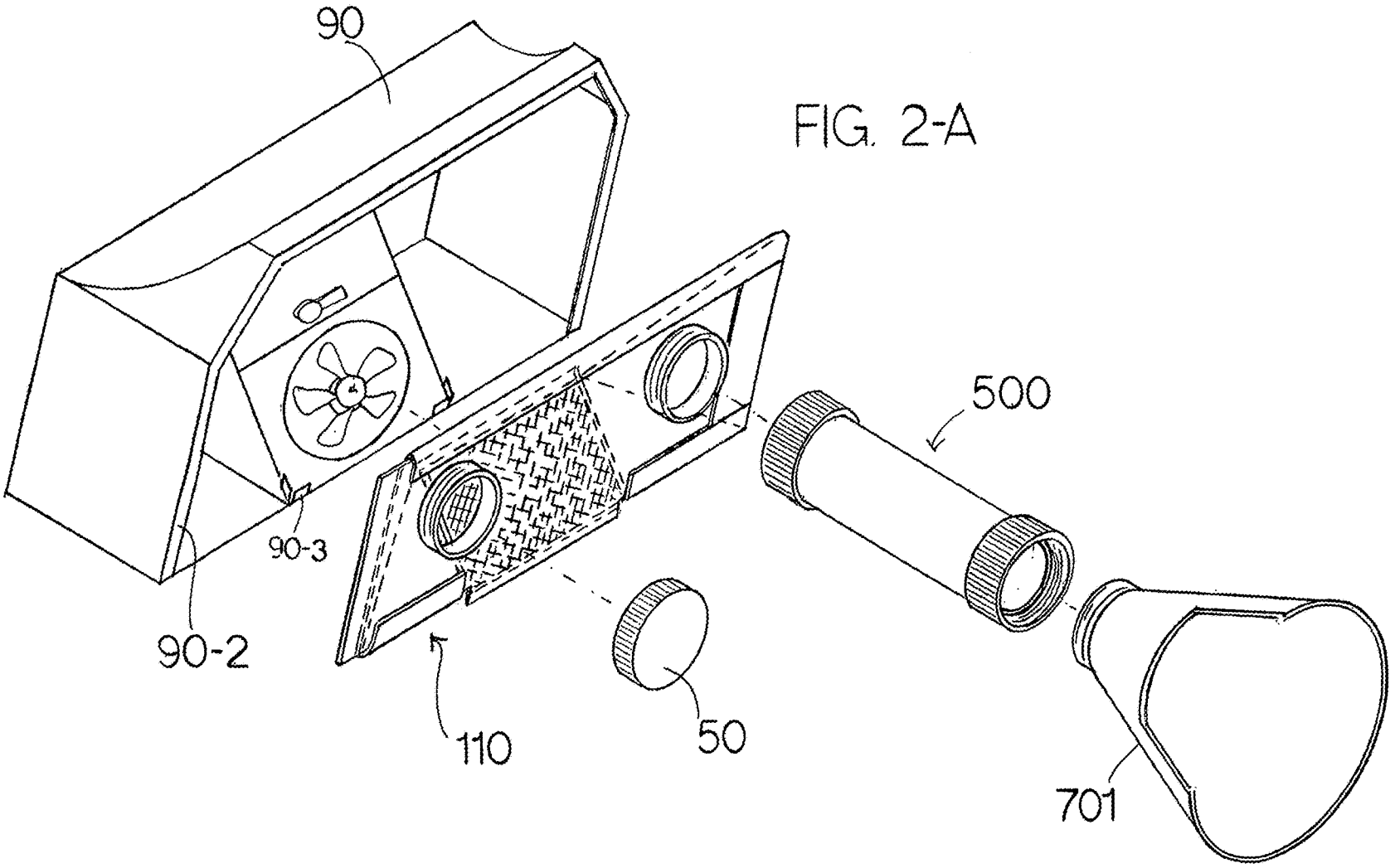
FIG. 2-A

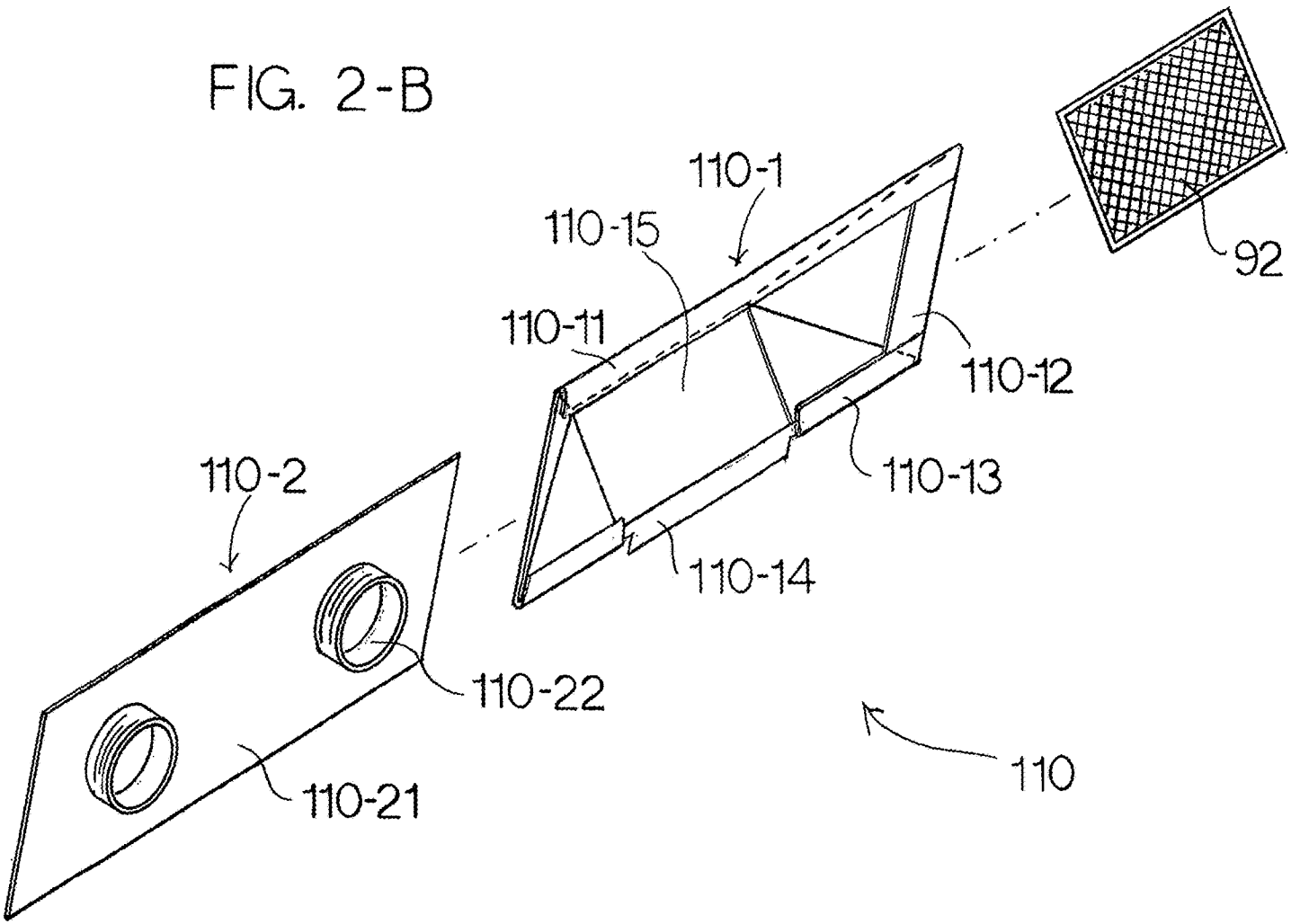
FIG. 2-B

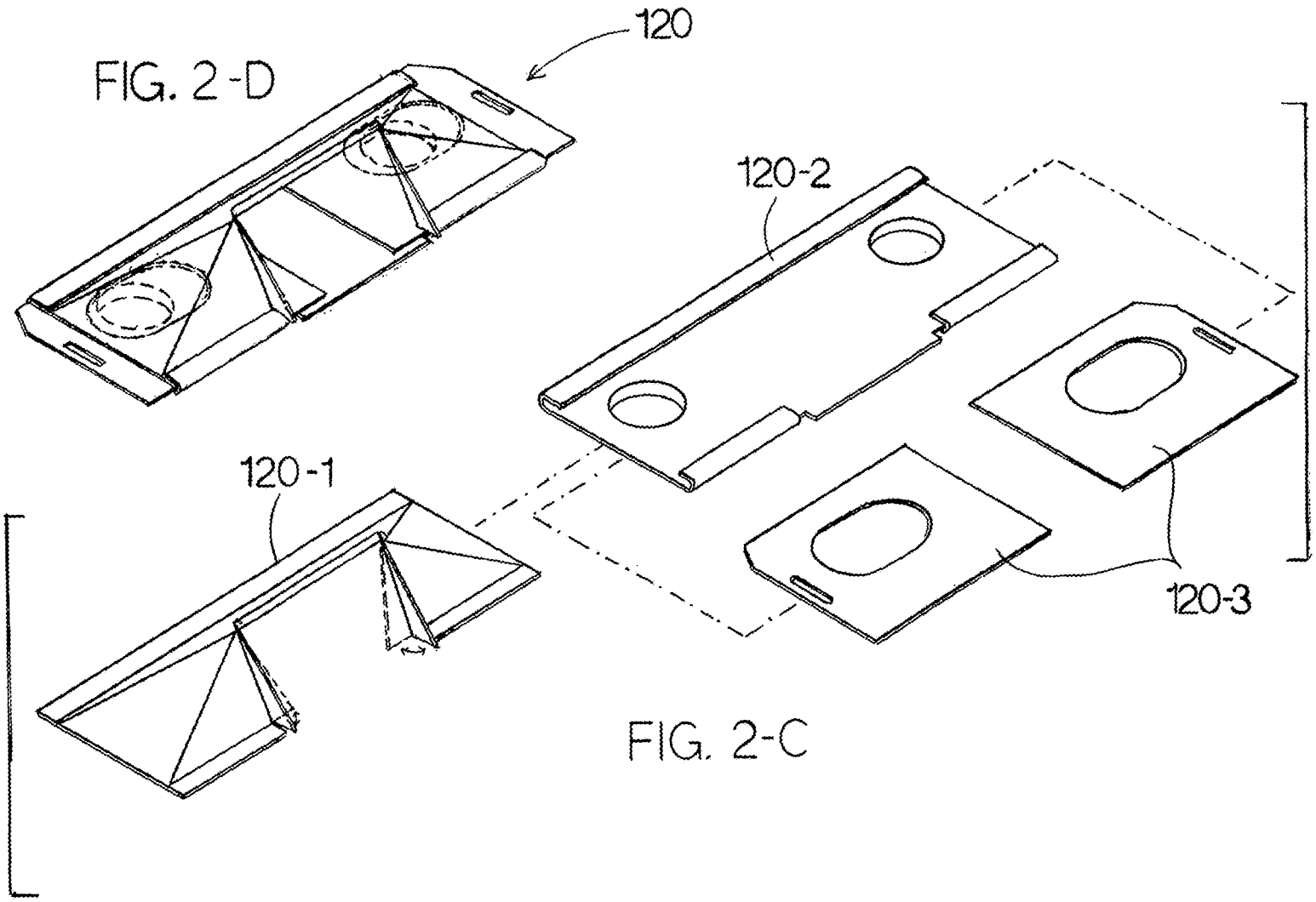
FIG. 2-D
FIG. 2-C

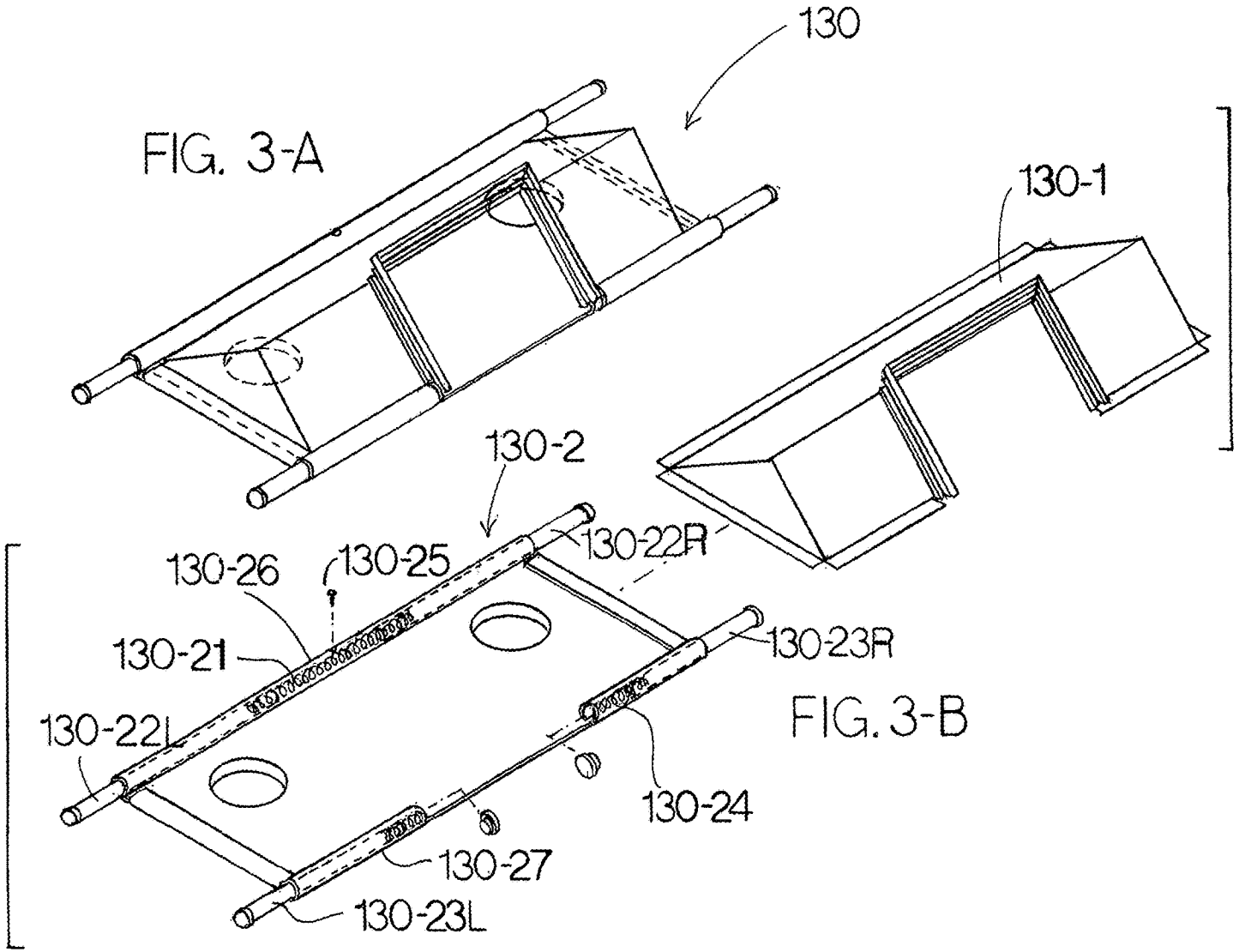
FIG. 3-A
FIG. 3-B

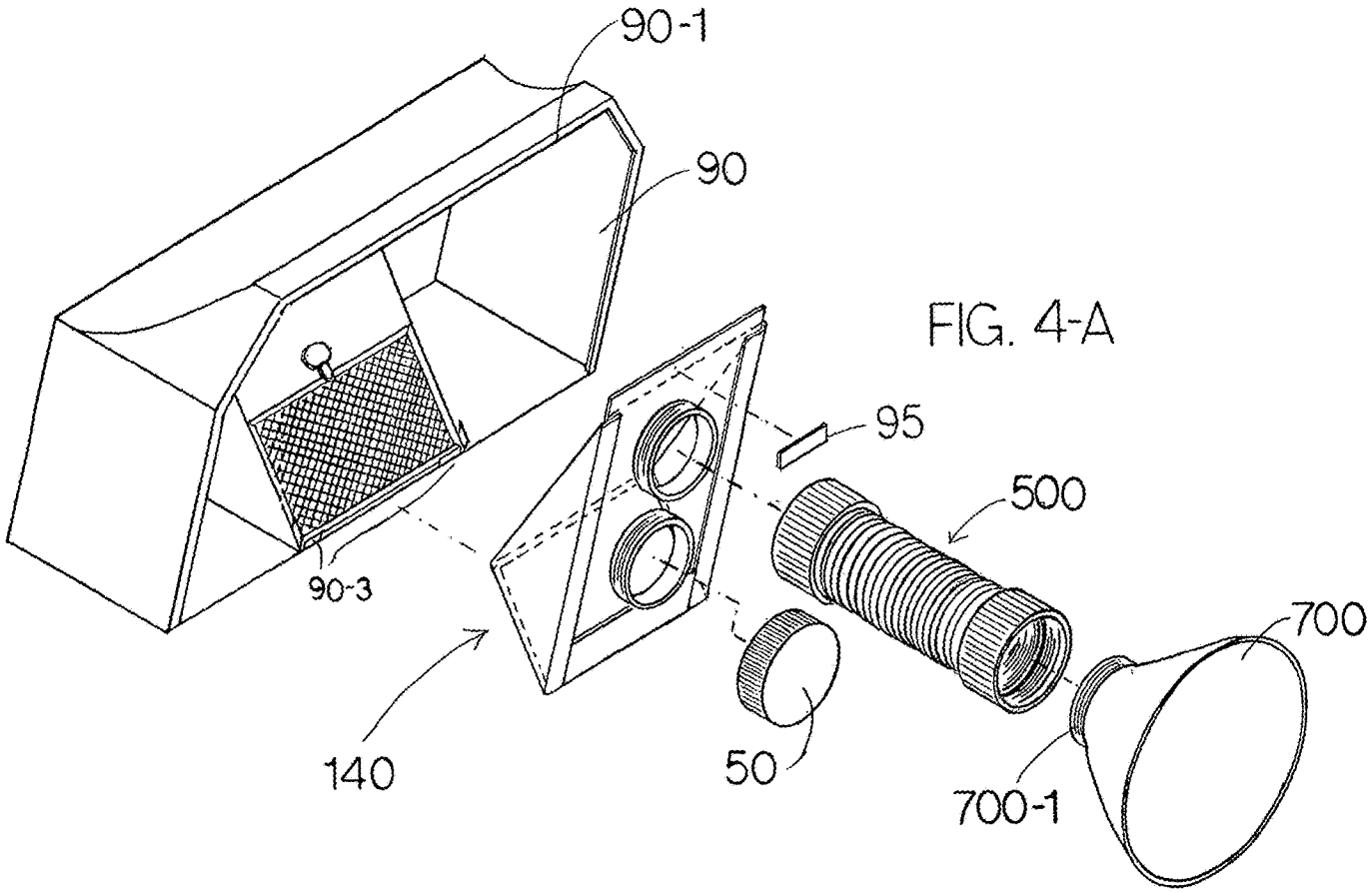
FIG. 4-A

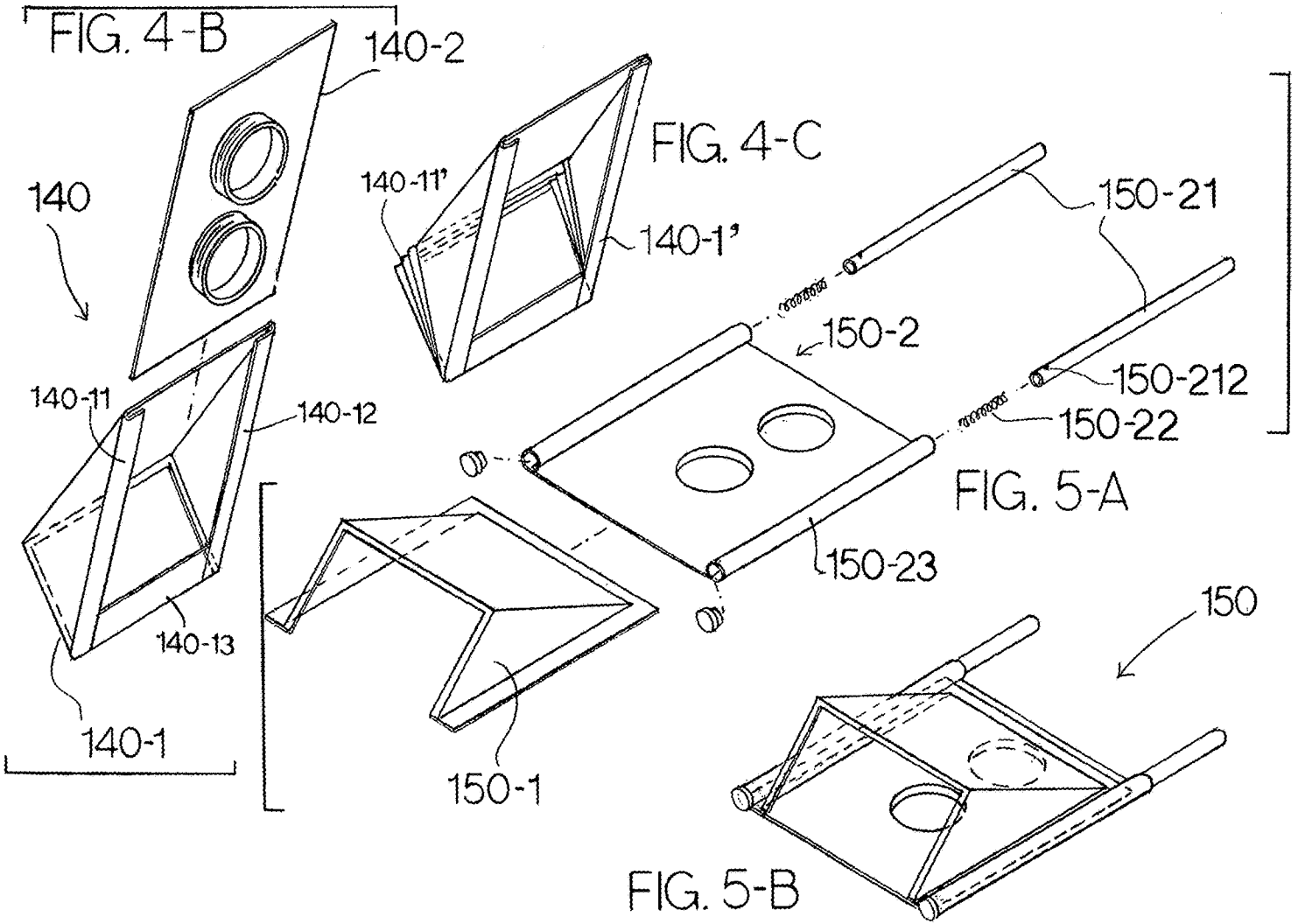
FIG. 4-B
140-2
140
140-11
140-12
140-13
140-1
FIG. 4-C
140-1'
140-11'
150-21
150-212
150-22
150-2
150-23
150-1
FIG. 5-A
150
FIG. 5-B

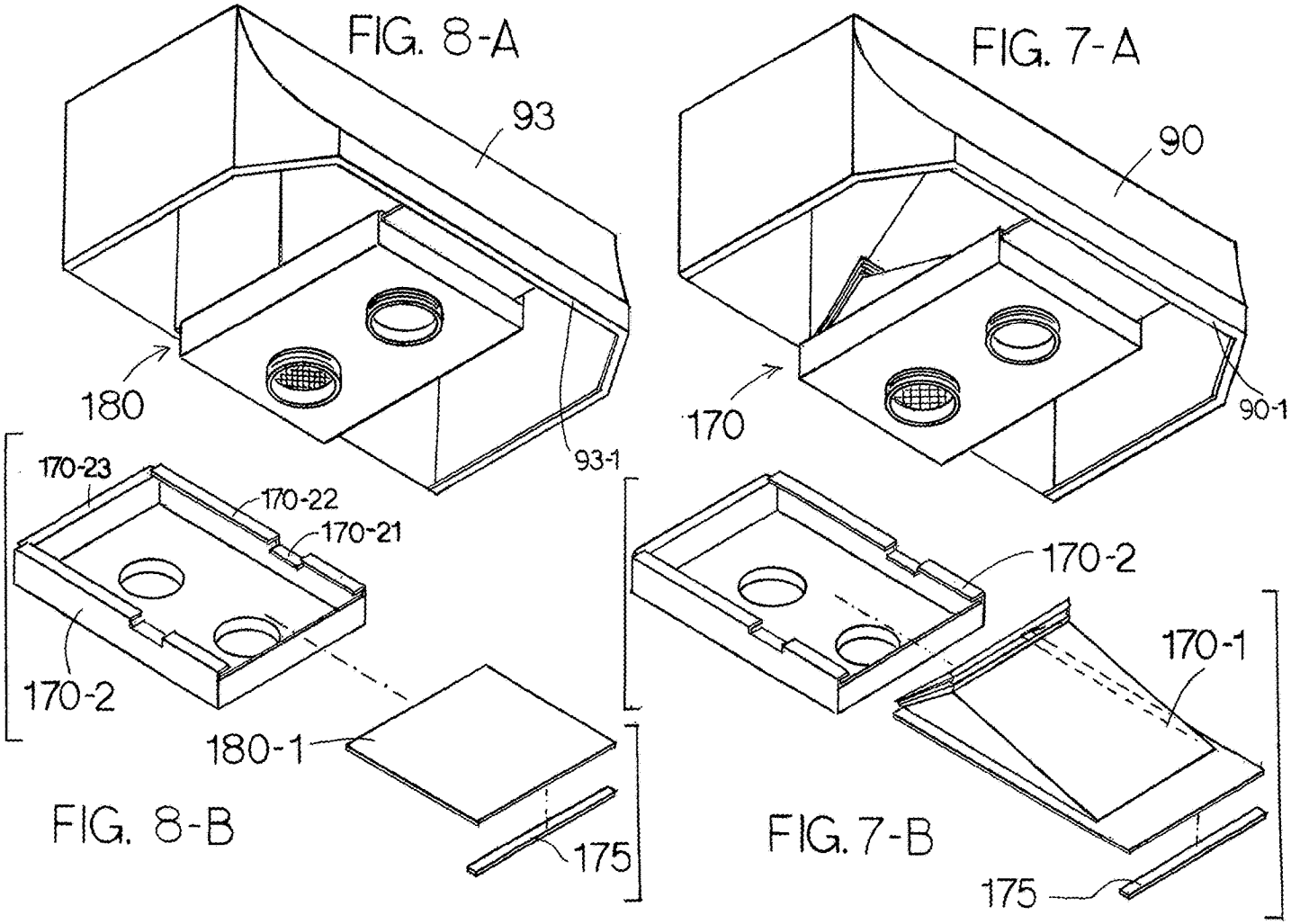
FIG. 7-A
FIG. 7-B
FIG. 8-A
FIG. 8-B

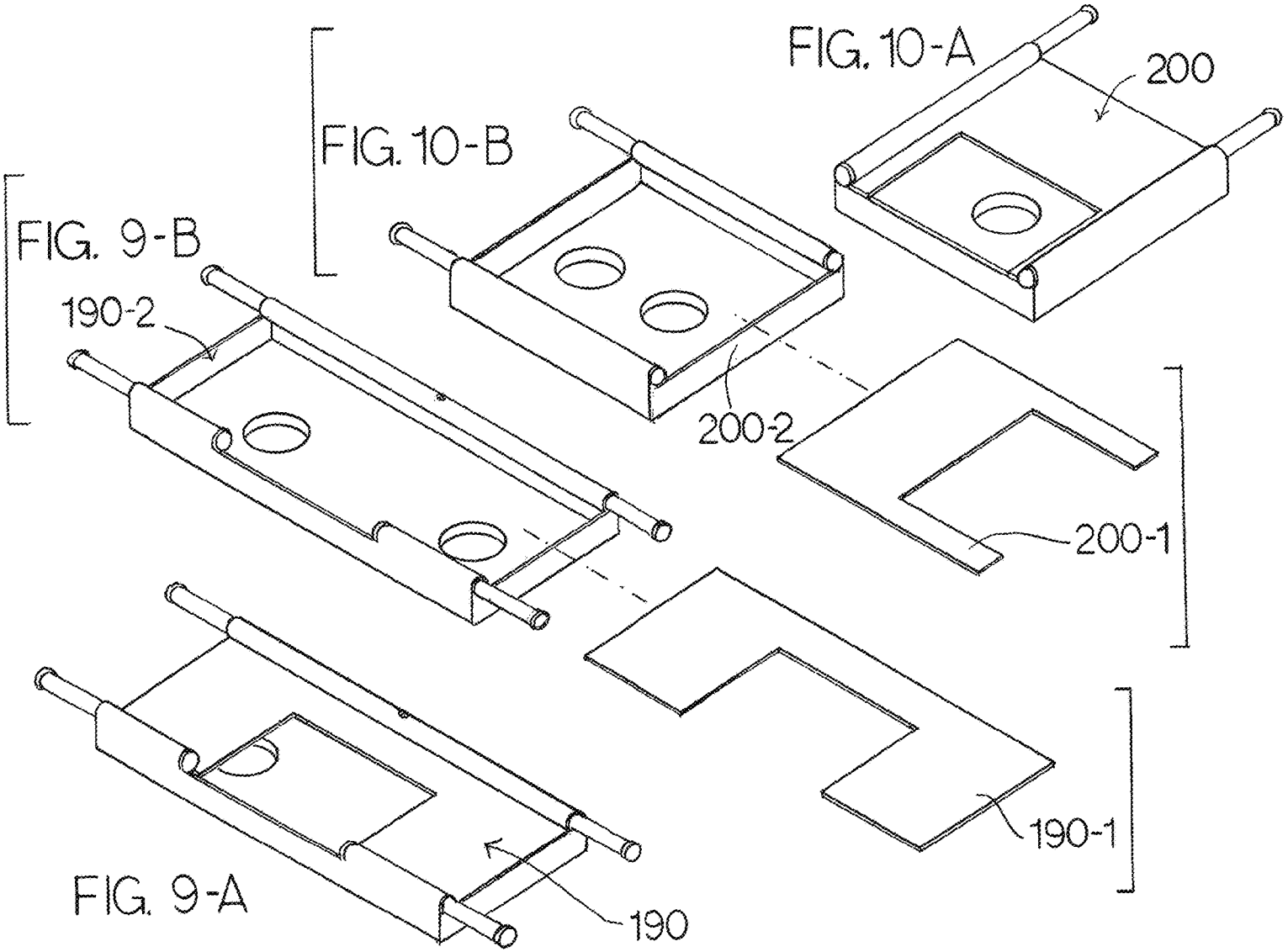
FIG. 10-A
FIG. 10-B
FIG. 9-B
FIG. 9-A

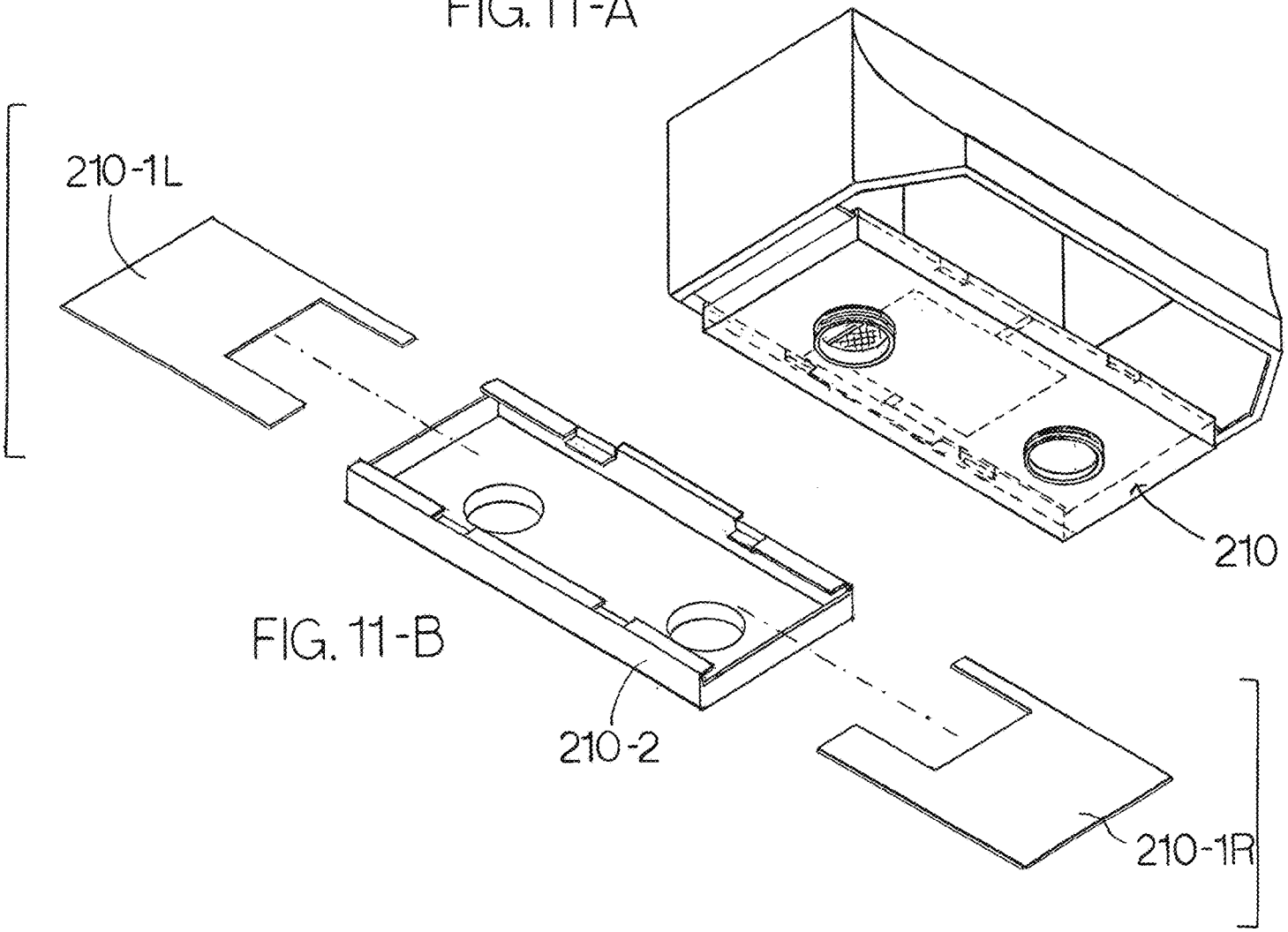
FIG. 11-A
FIG. 11-B

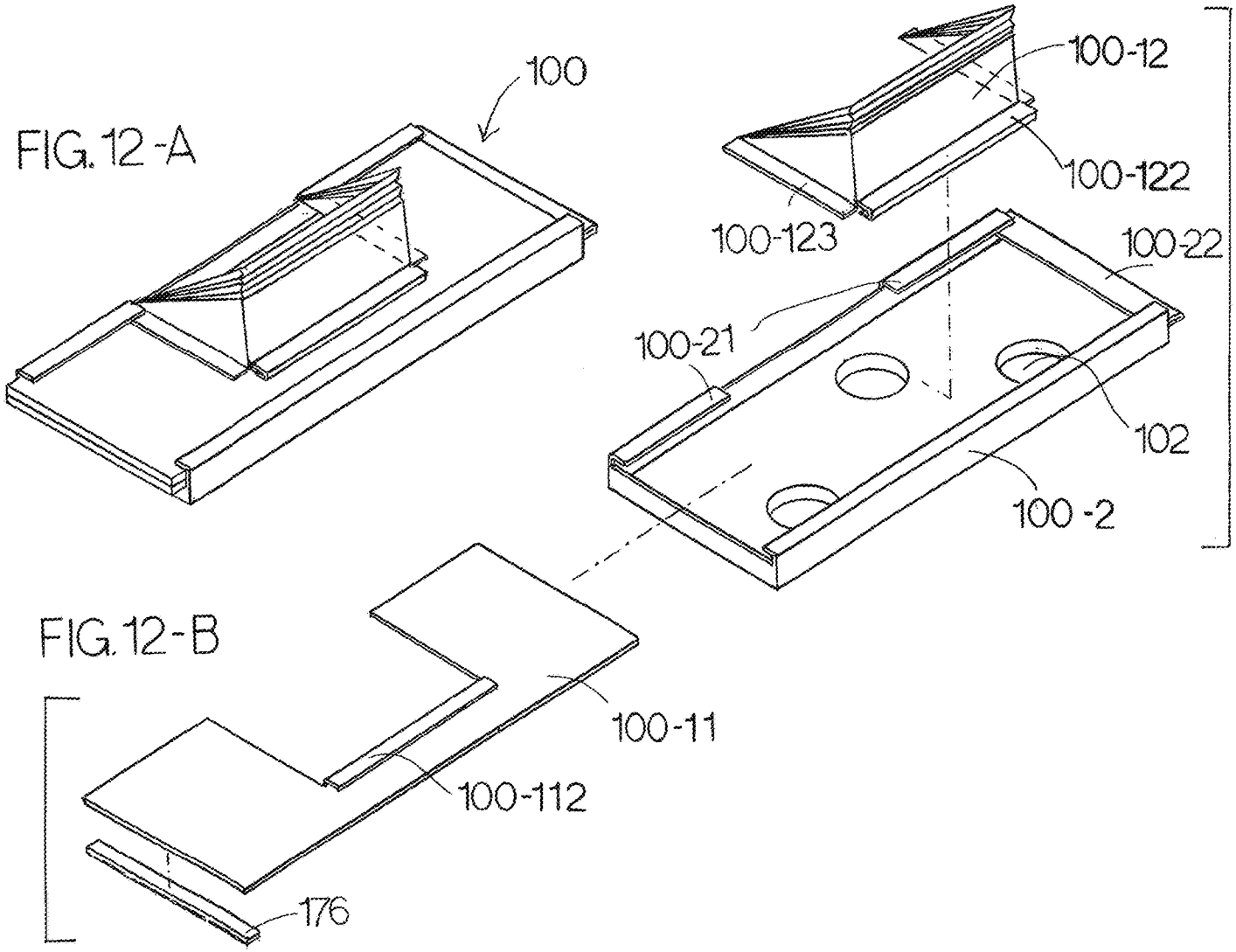
FIG. 12-A
FIG. 12-B

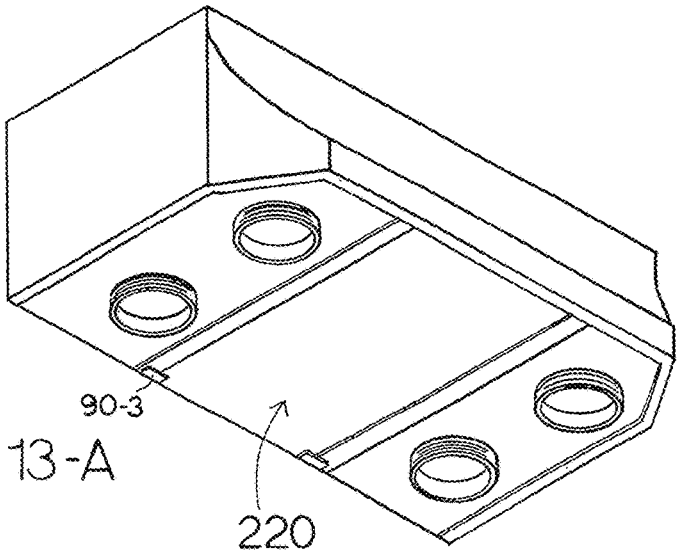
FIG. 13-A
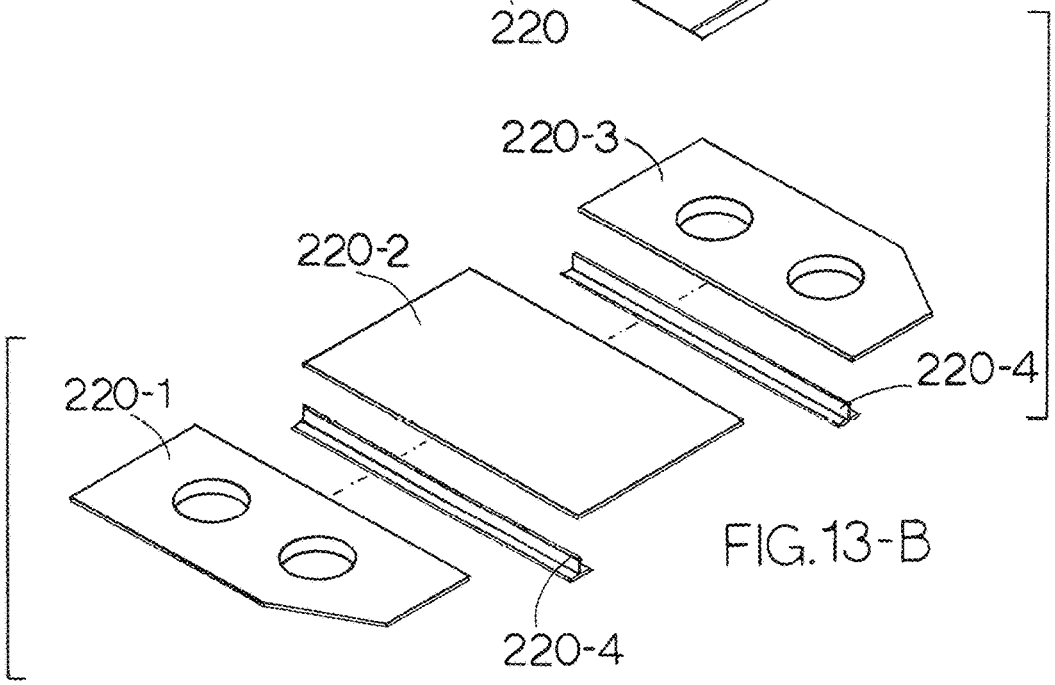
FIG. 13-B

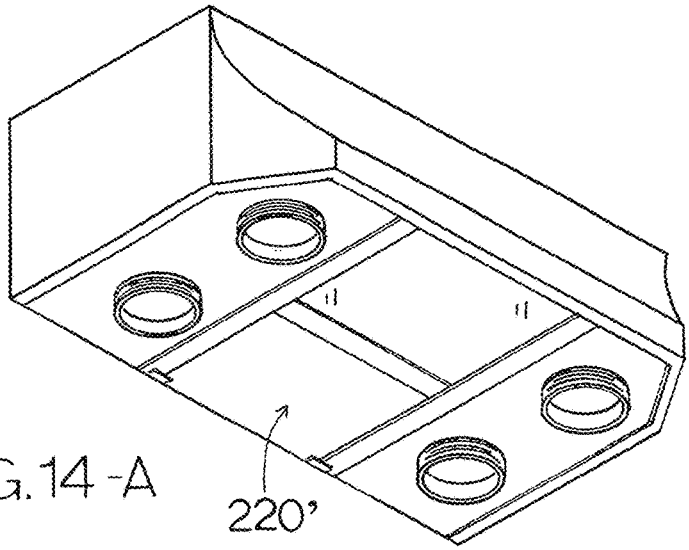
FIG. 14-A
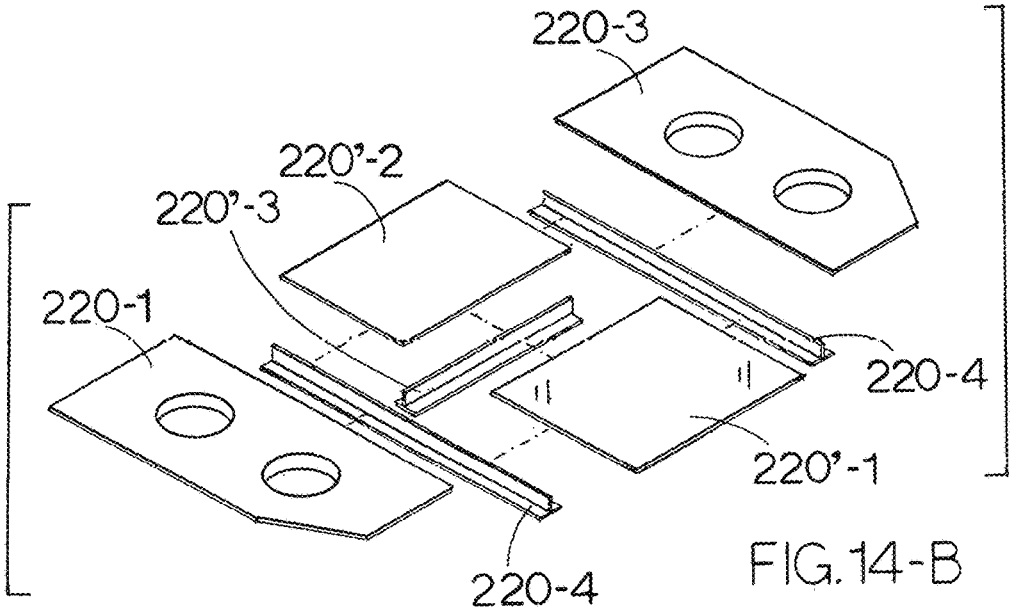
FIG. 14-B

FIG. 15-A
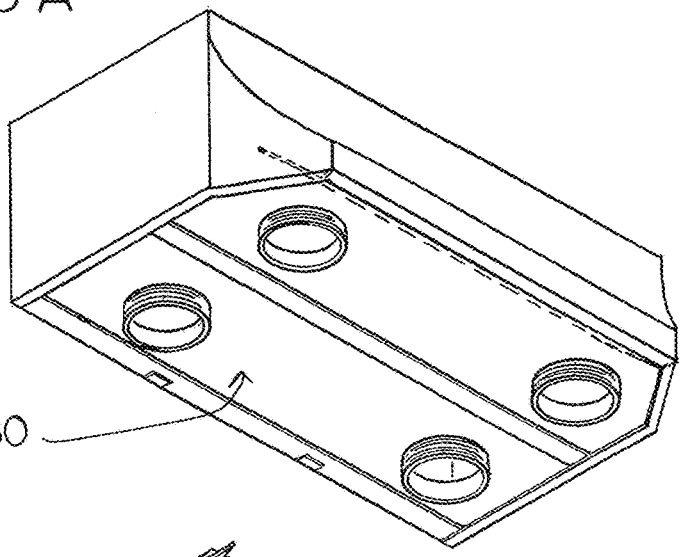
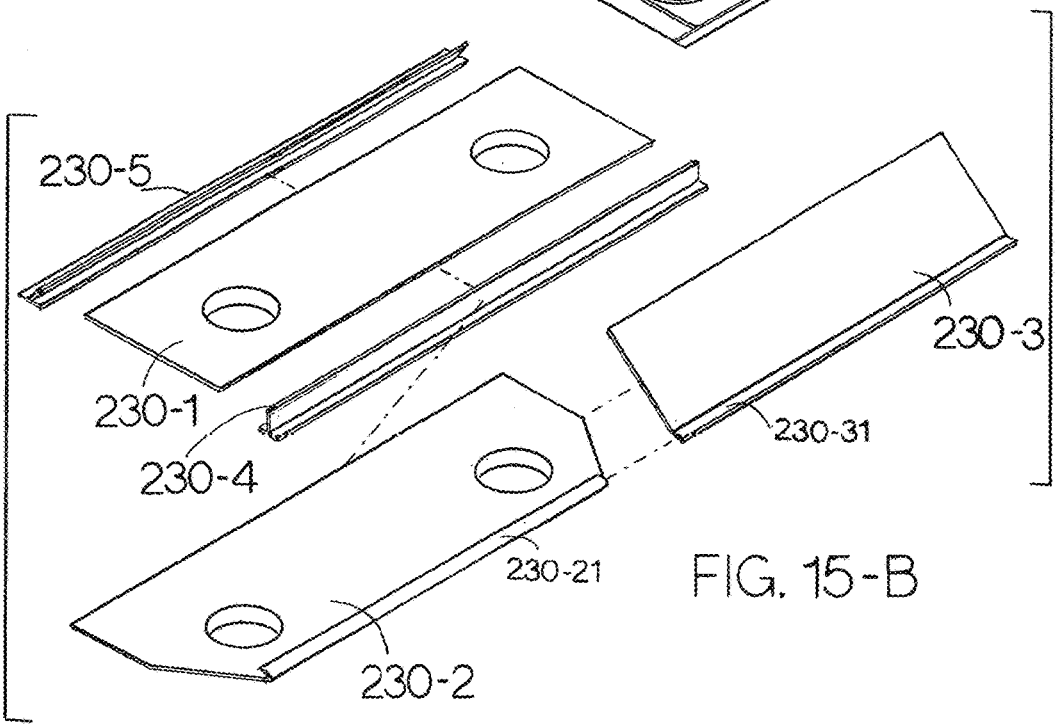
FIG. 15-B

FIG. 16-A
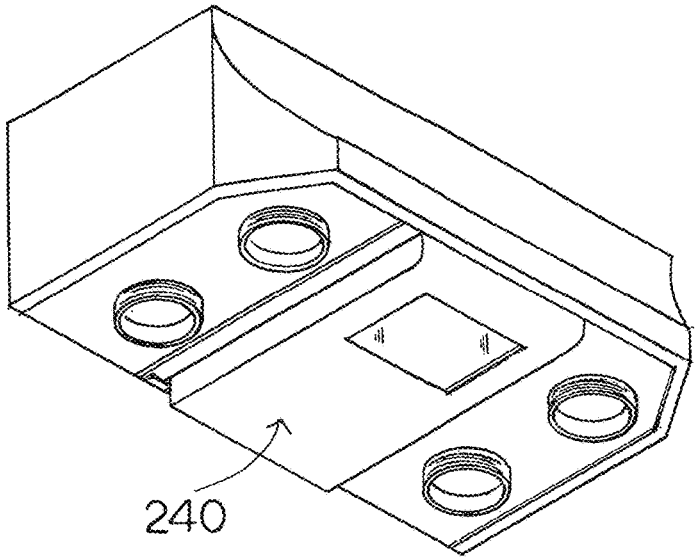
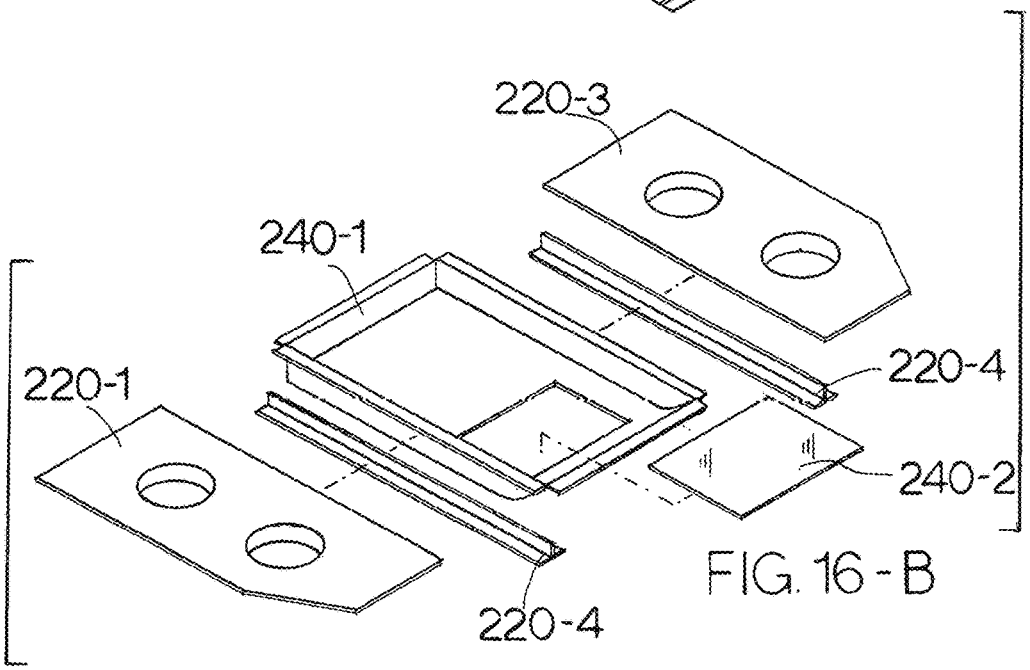
FIG. 16-B

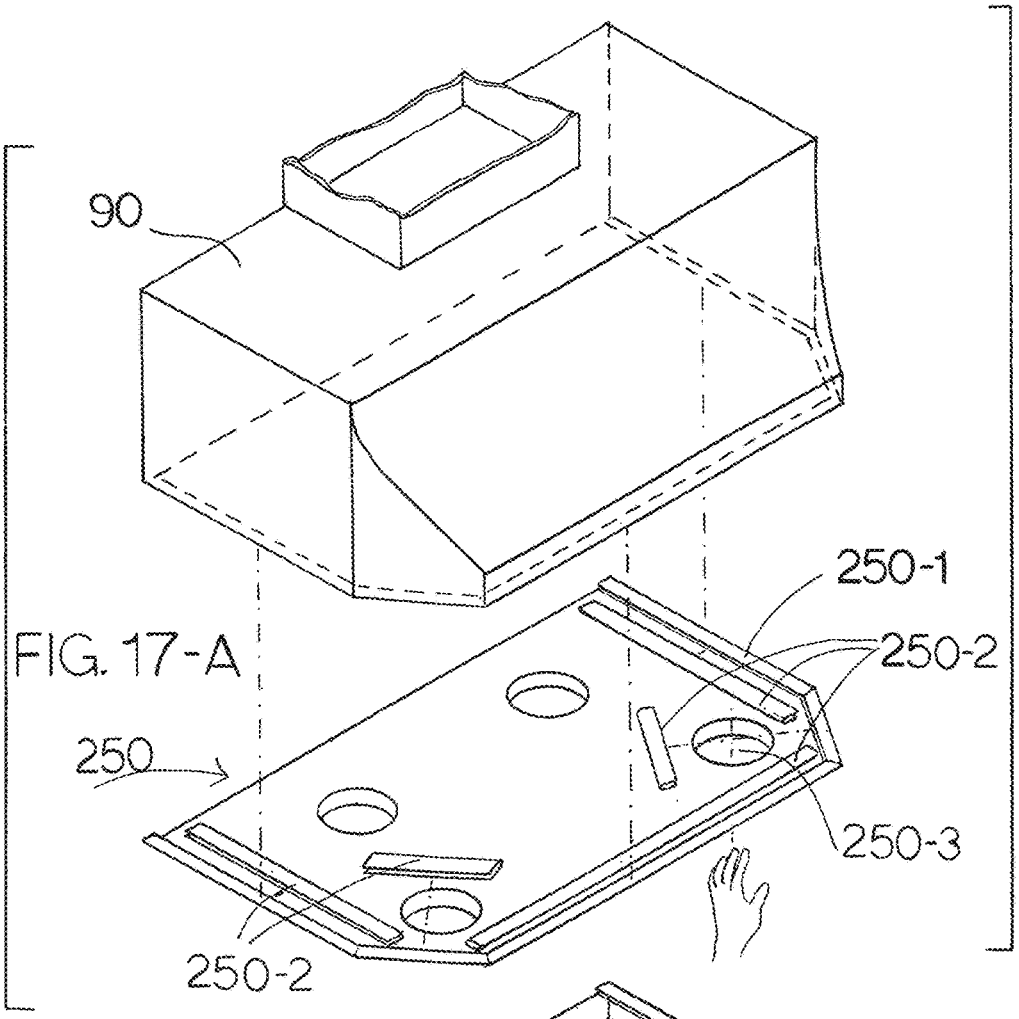
FIG. 17-A
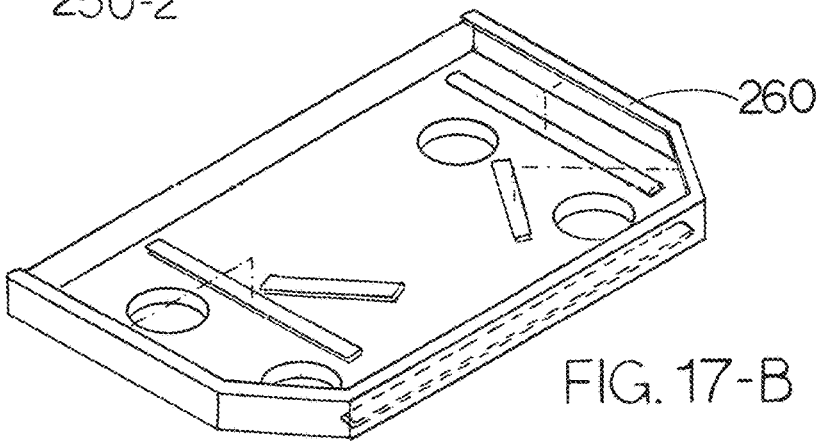
FIG. 17-B

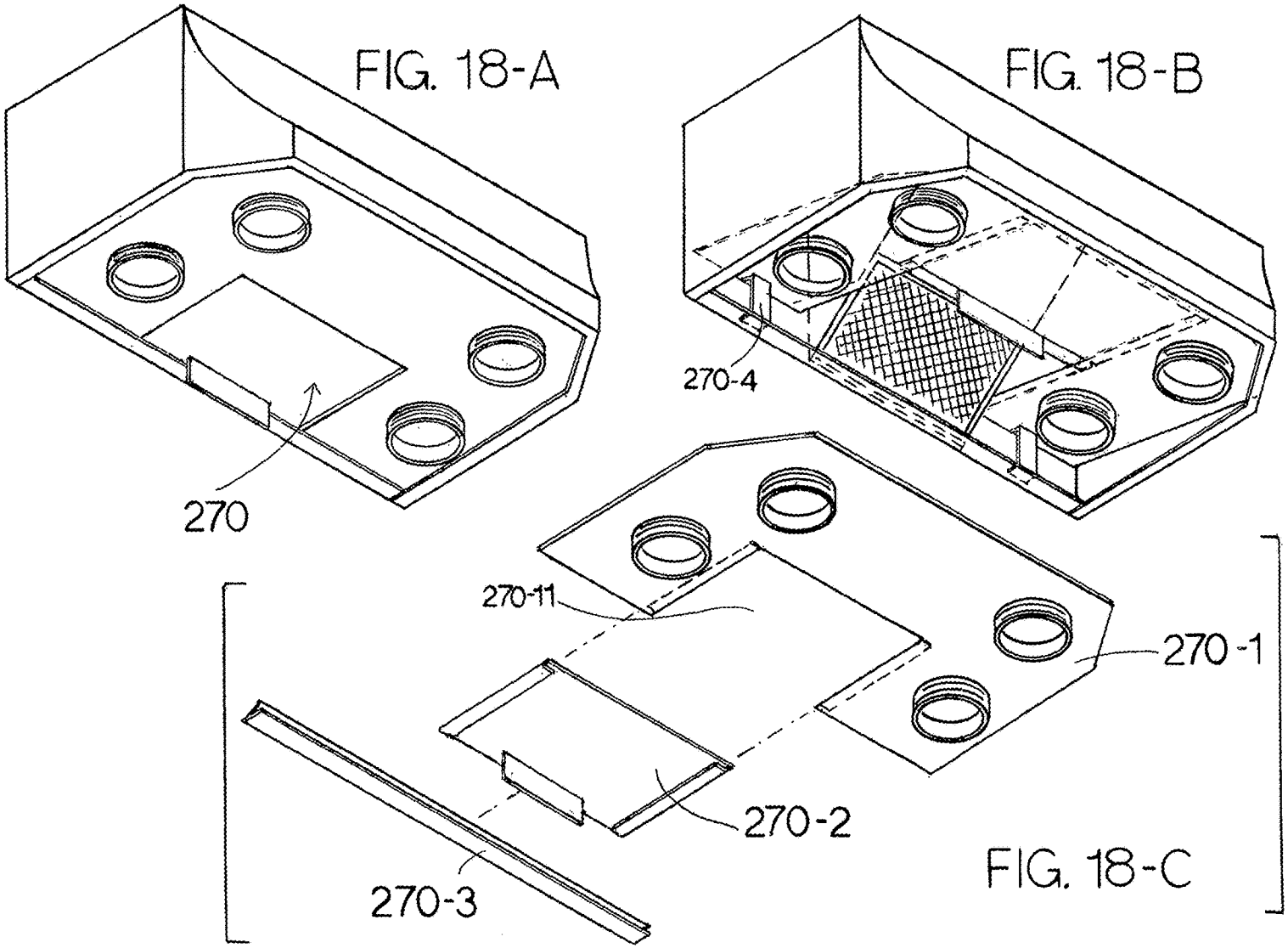
FIG. 18-A
FIG. 18-B
FIG. 18-C

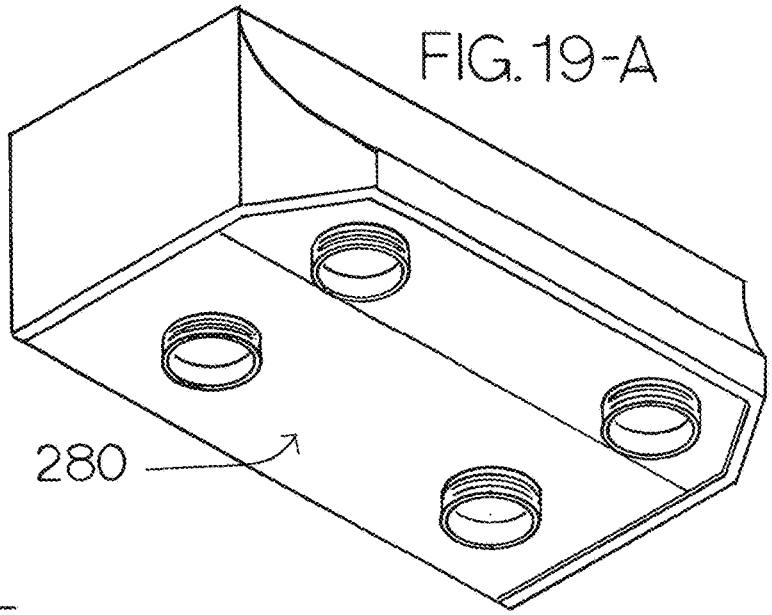
FIG. 19-A
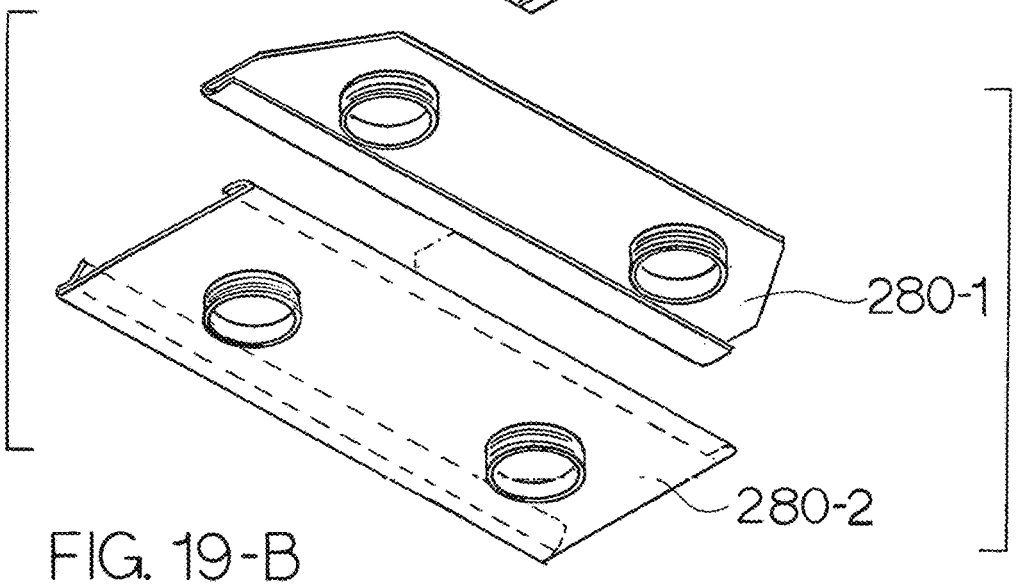
FIG. 19-B

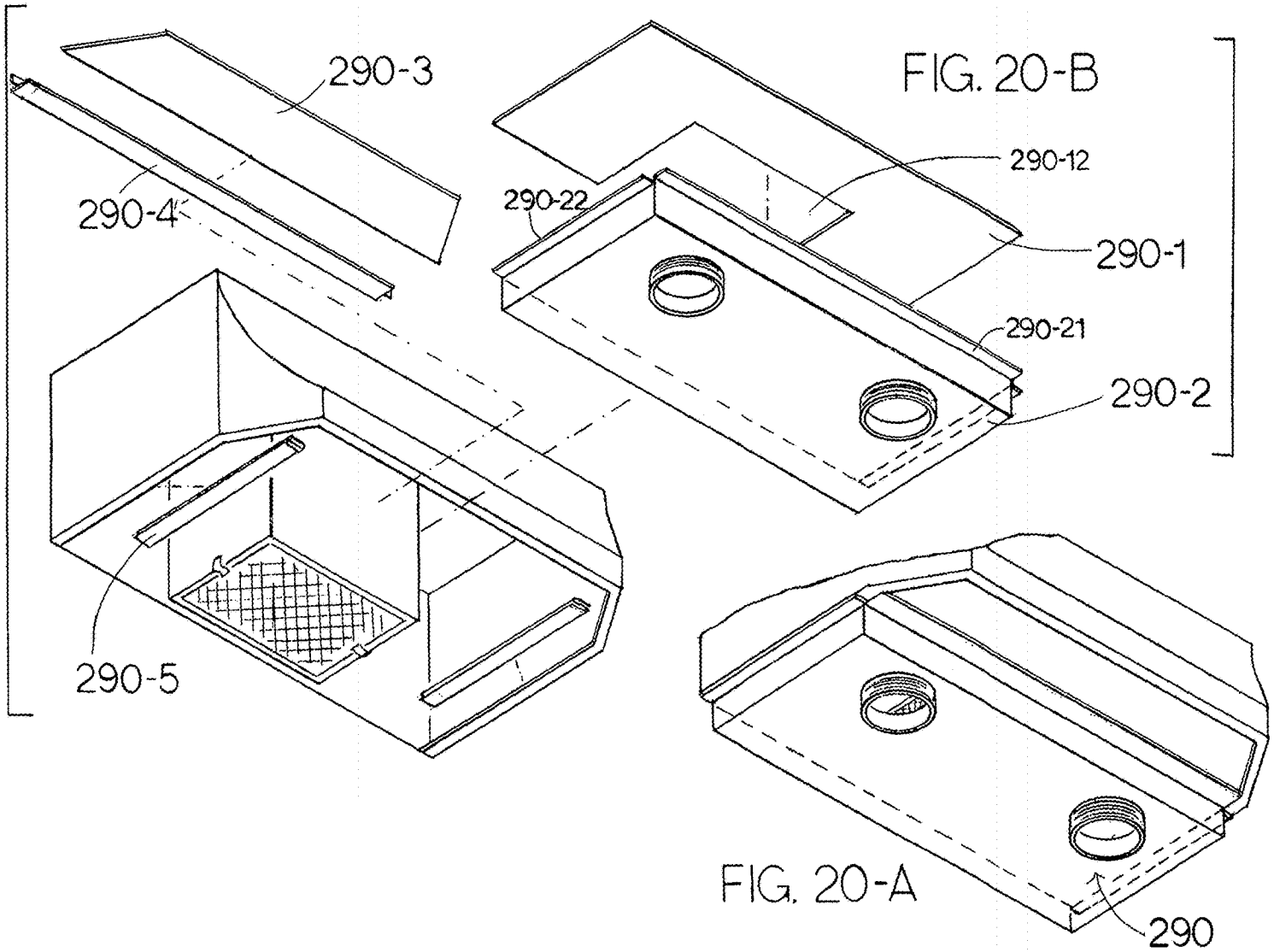
FIG. 20-B
FIG. 20-A

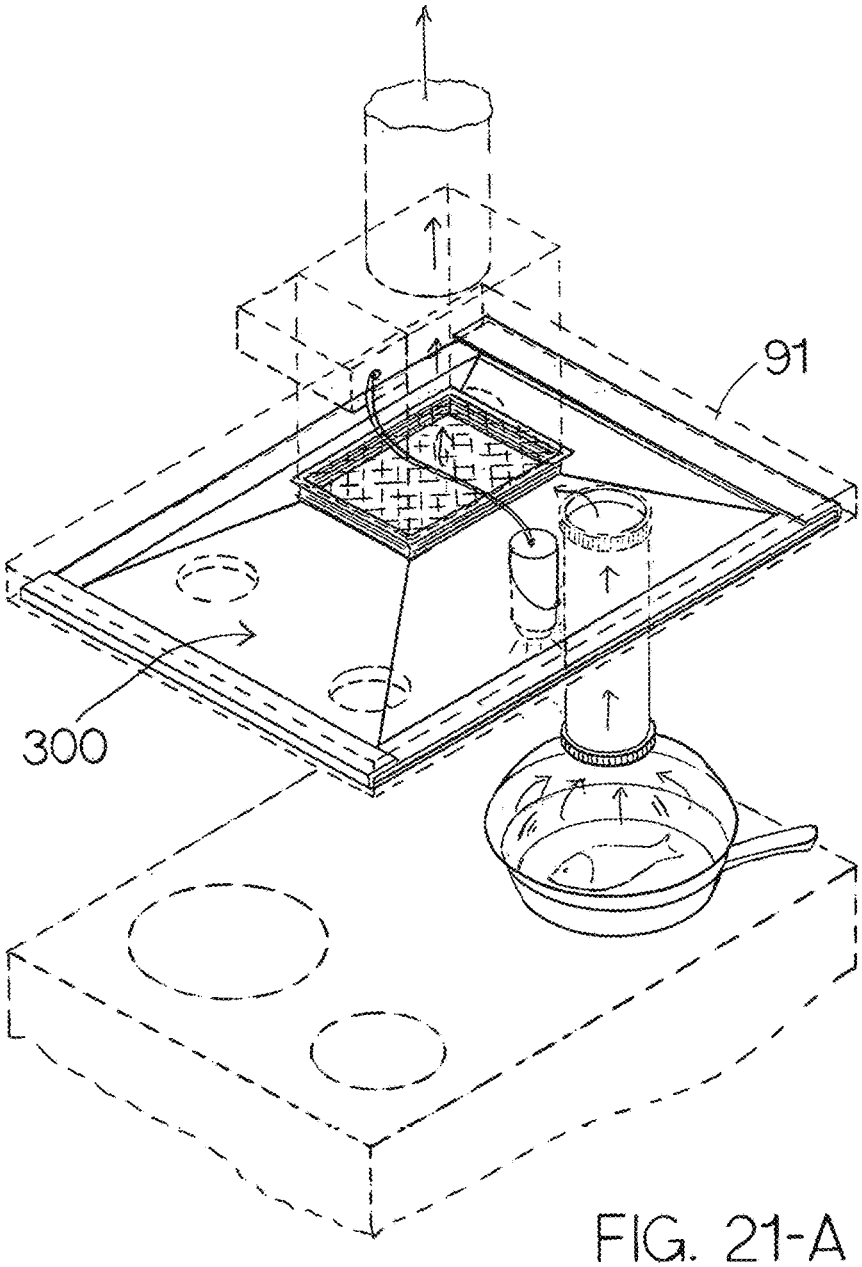
FIG. 21-A

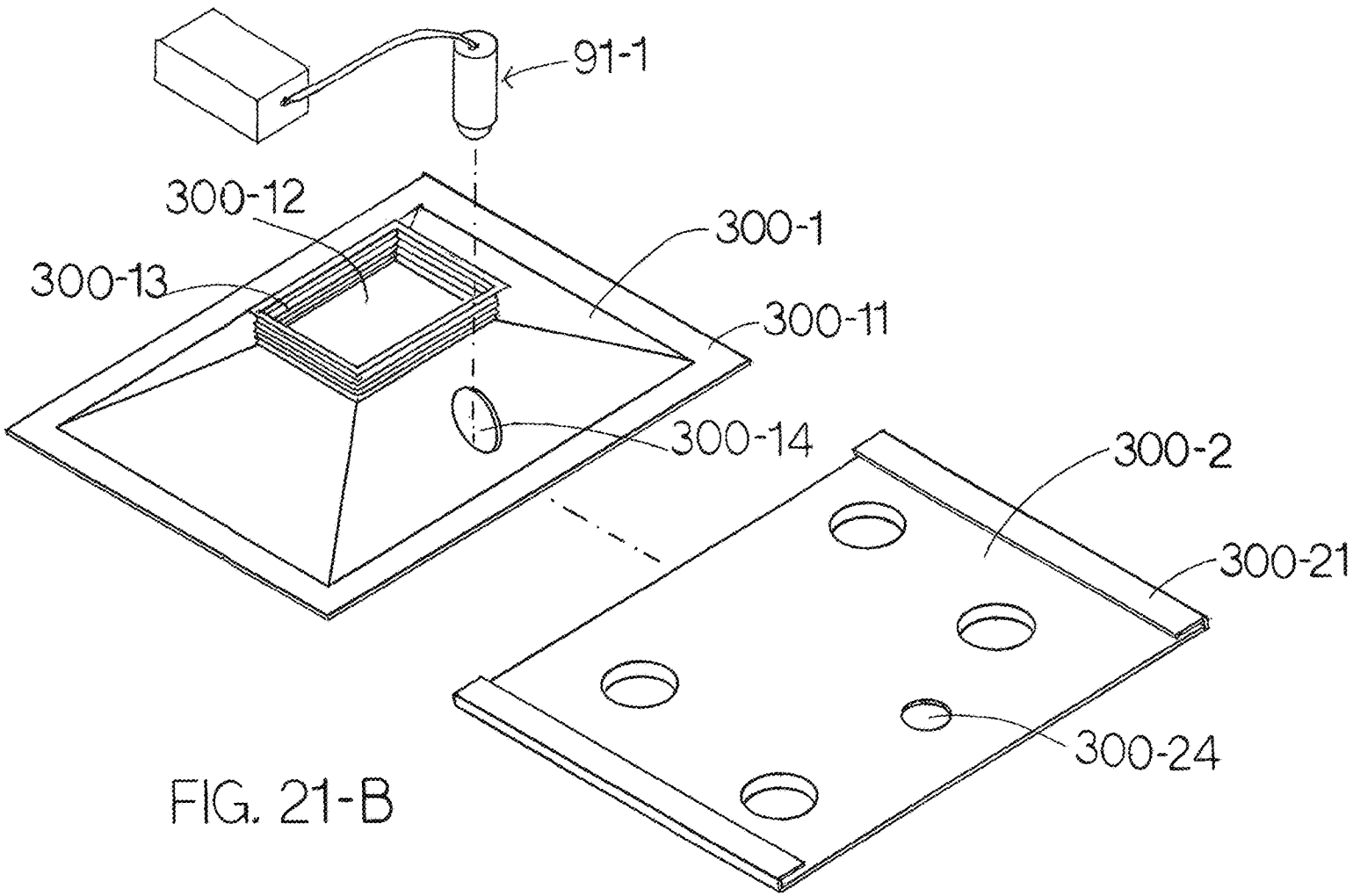
FIG. 21-B

FIG. 22-A
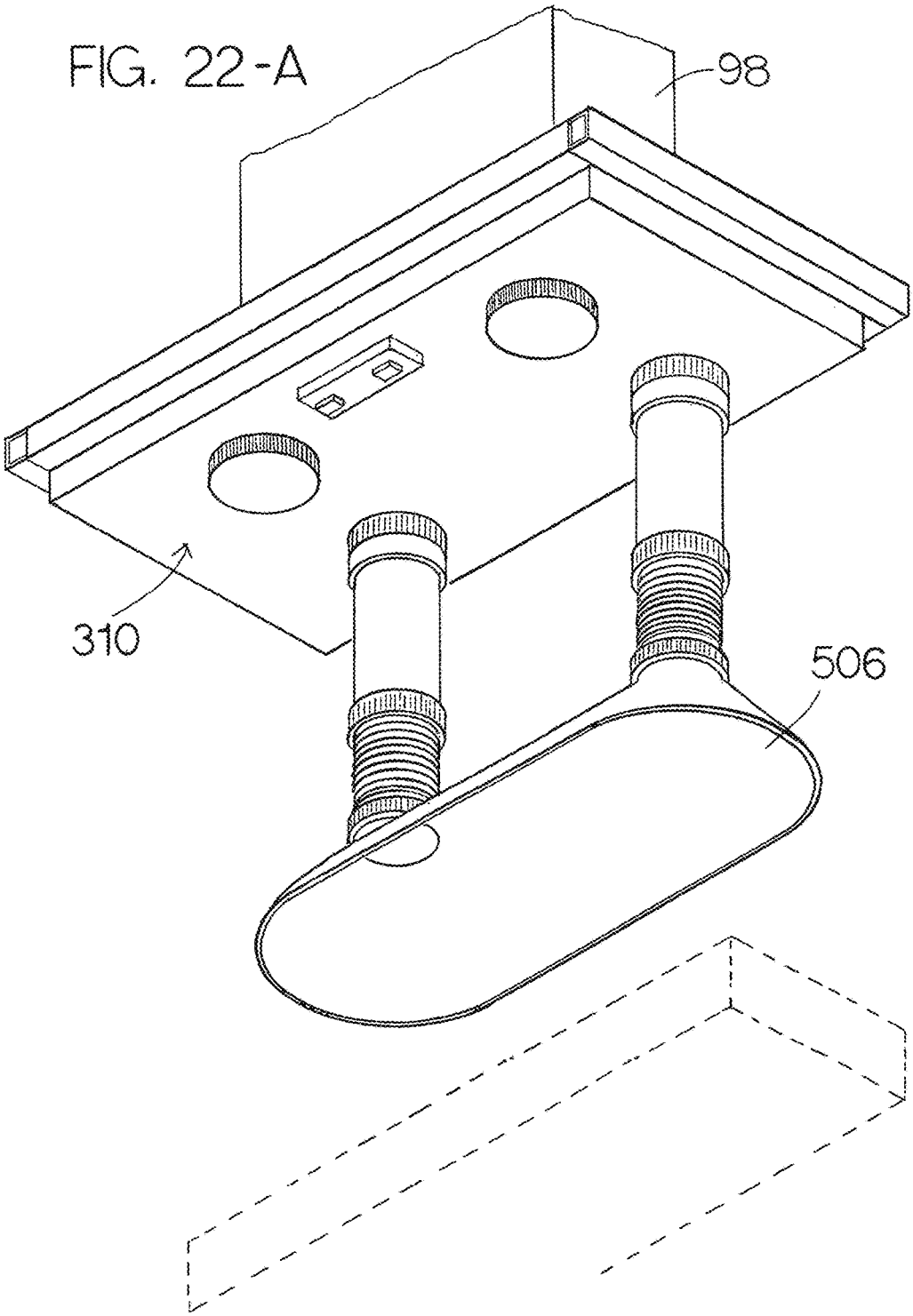

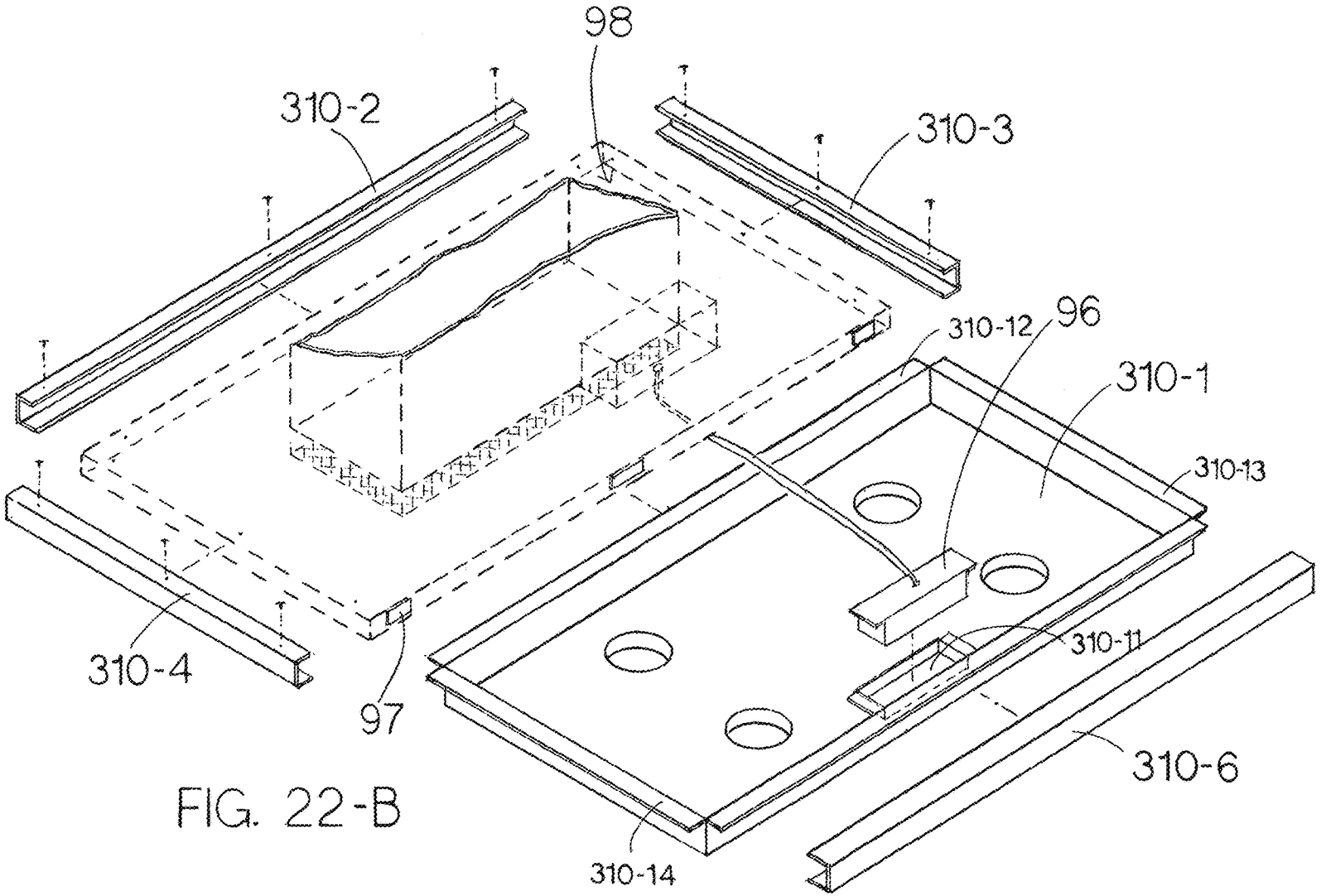
FIG. 22-B

FIG. 23-A
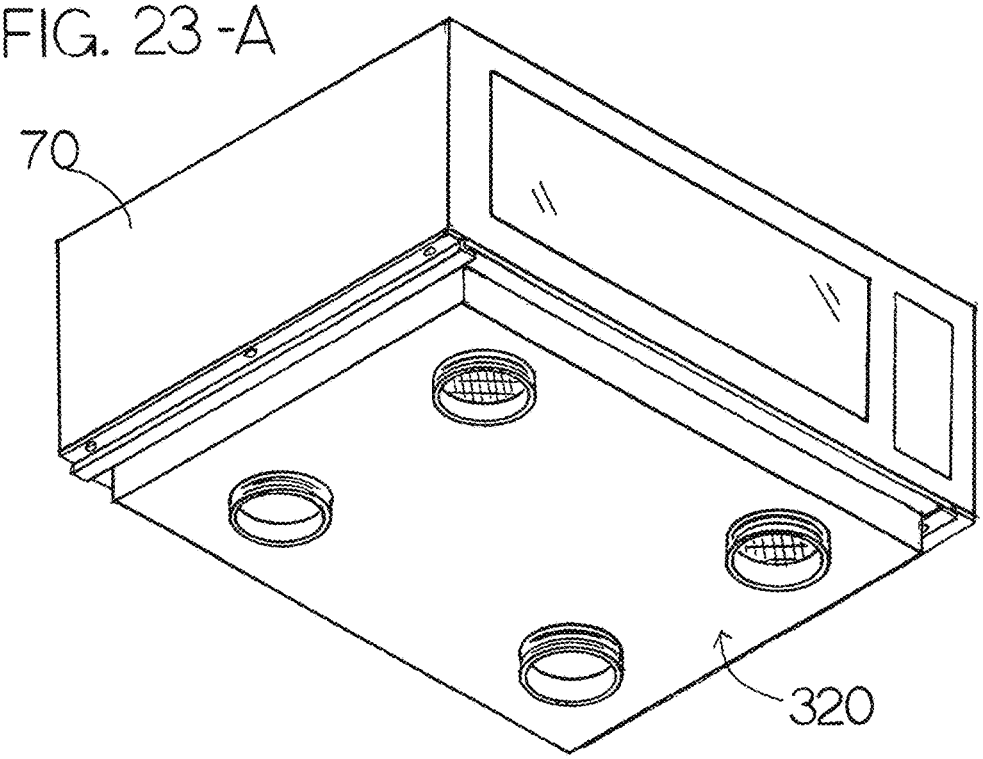
FIG. 24-A
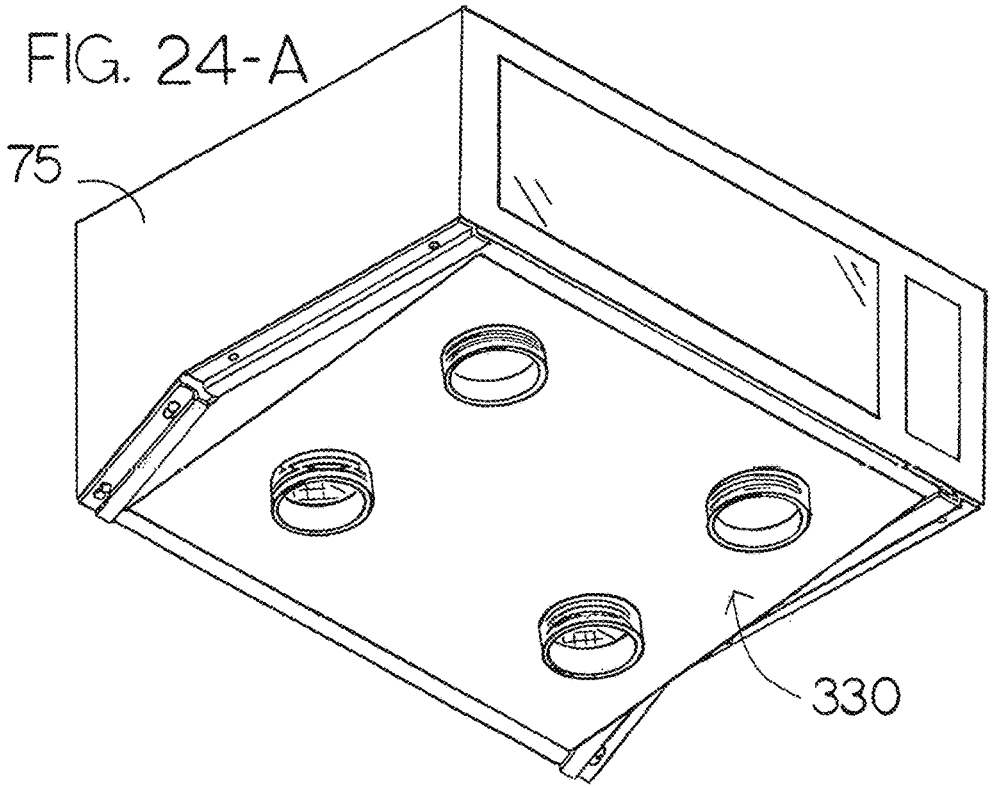

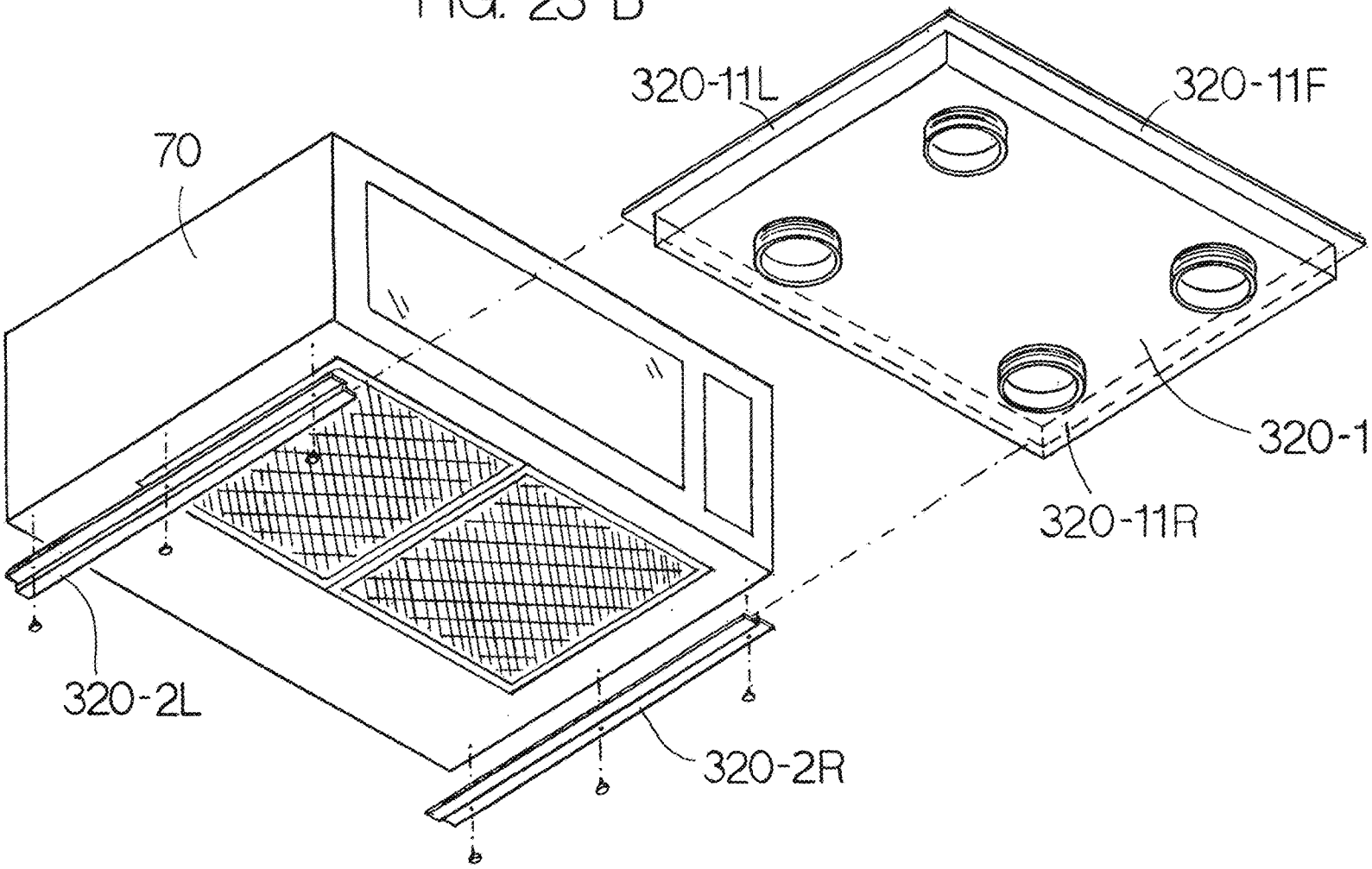
FIG. 23-B

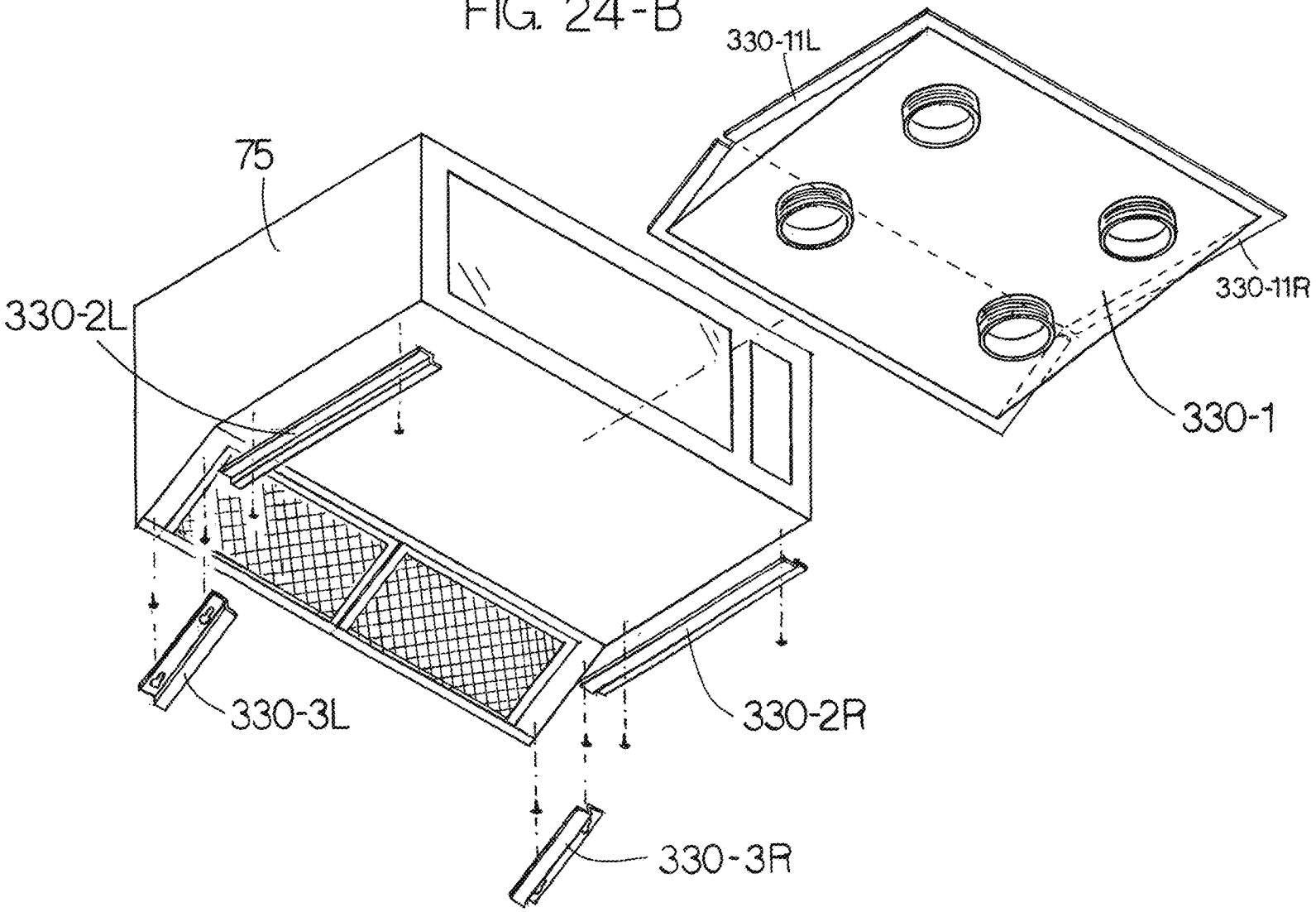
FIG. 24-B

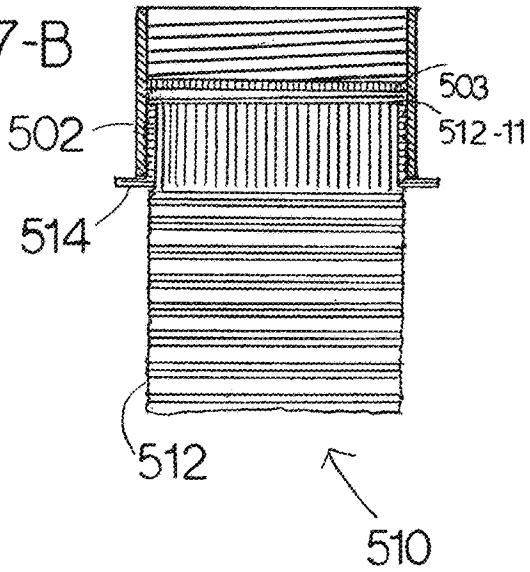
FIG. 27-B
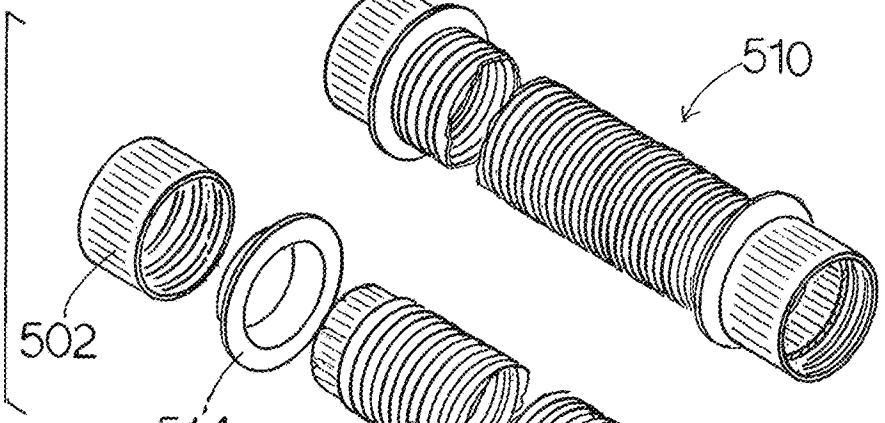
FIG. 27-A'
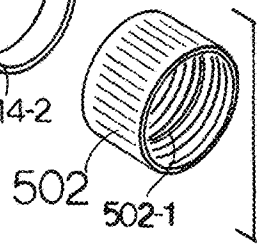
FIG. 27-A

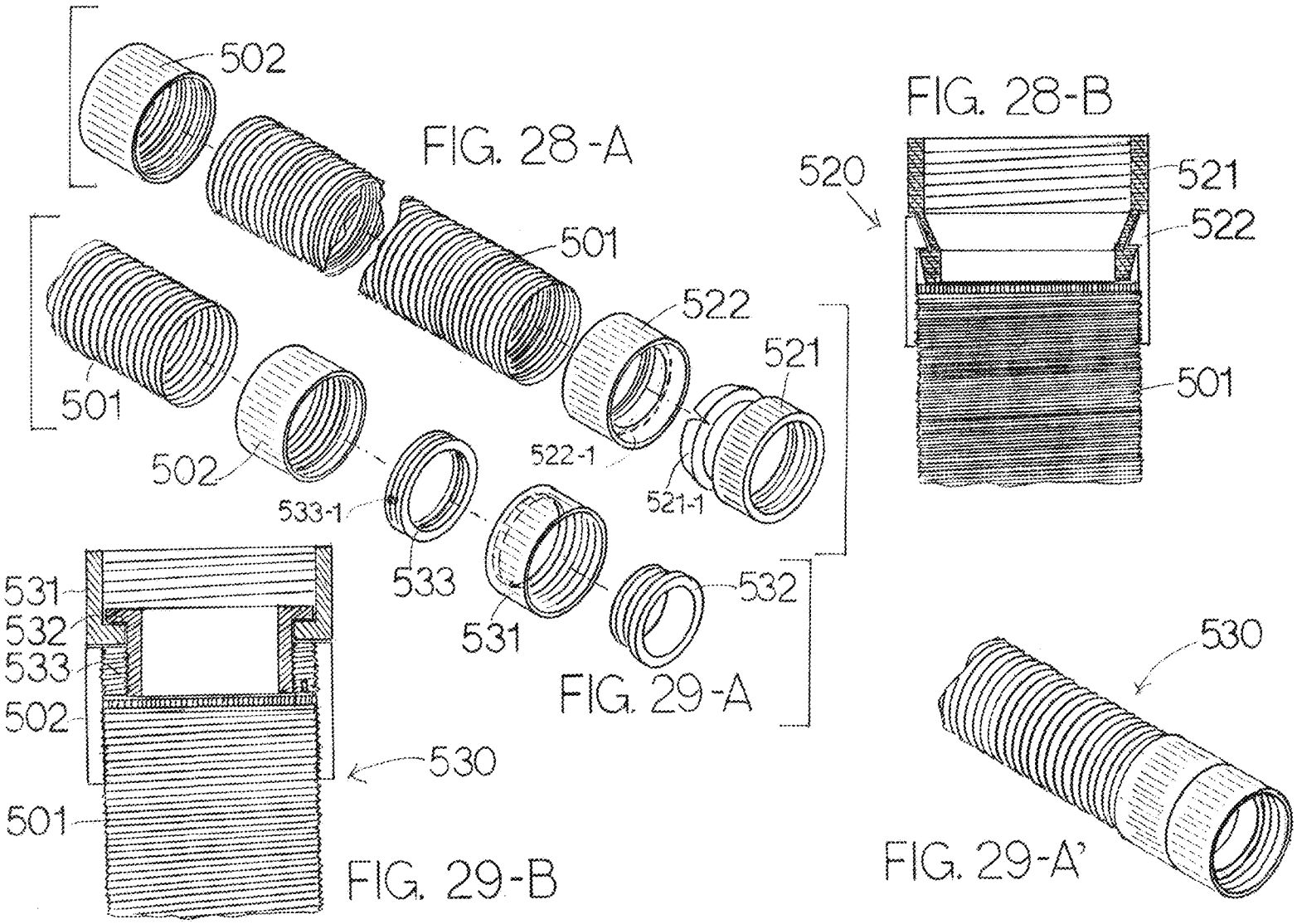
FIG. 28-B
521
522
501
520
FIG. 29-A'
530
FIG. 28-A
502
501
522
521
522-1
521-1
FIG. 29-A
532
531
533
533-1
502
501
FIG. 29-B
530
531
532
533
502
501

FIG. 30-A
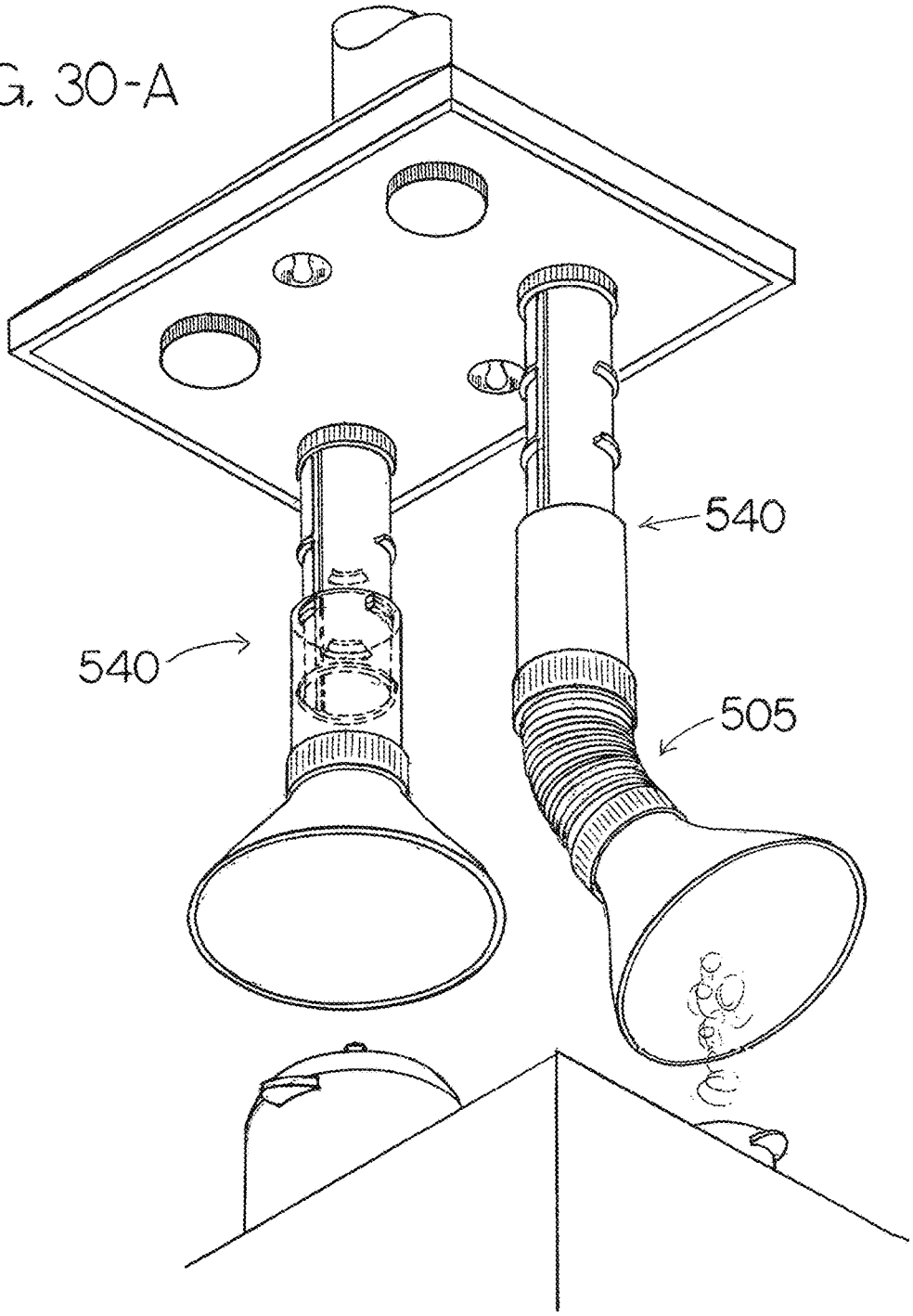

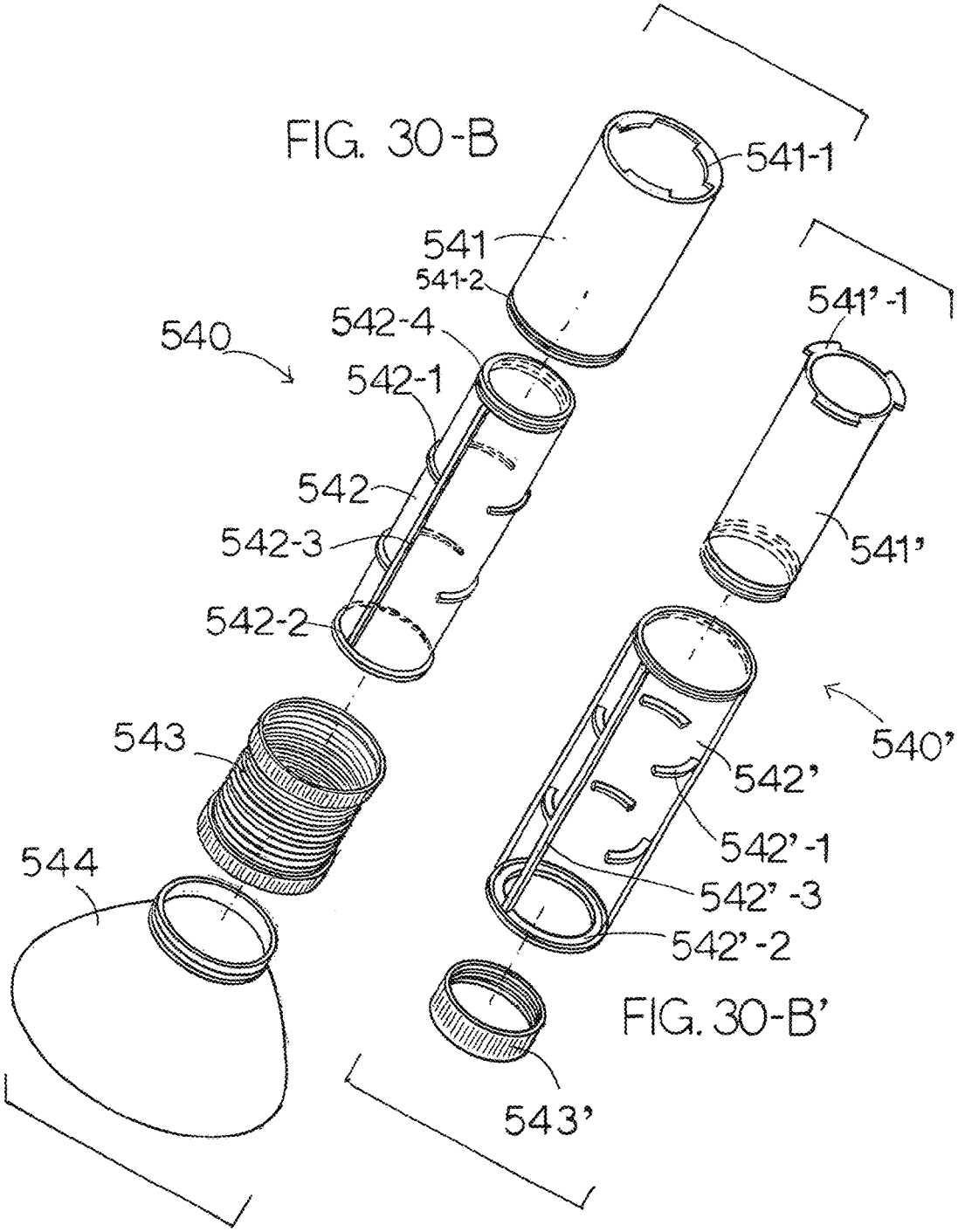
FIG. 30-B
541-1
541
541-2
540
542-4
542-1
542
542-3
542-2
543
544
541'-1
541'
540'
542'
542'-1
542'-3
542'-2
FIG. 30-B'
543'

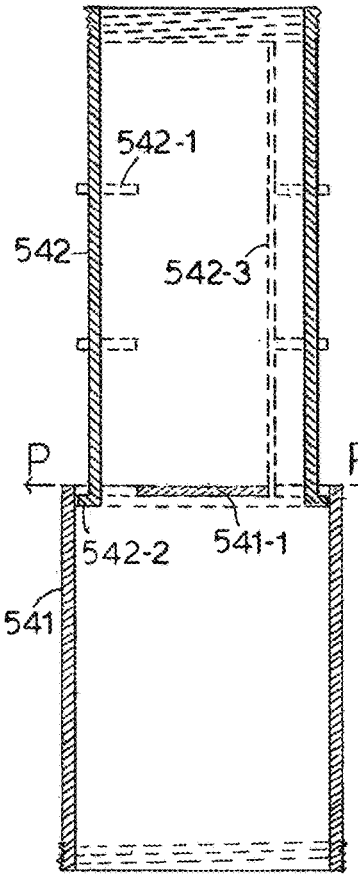
FIG. 31-A
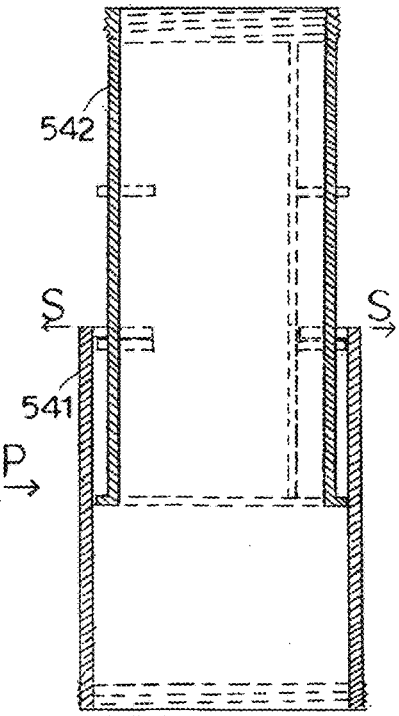
FIG. 31-B
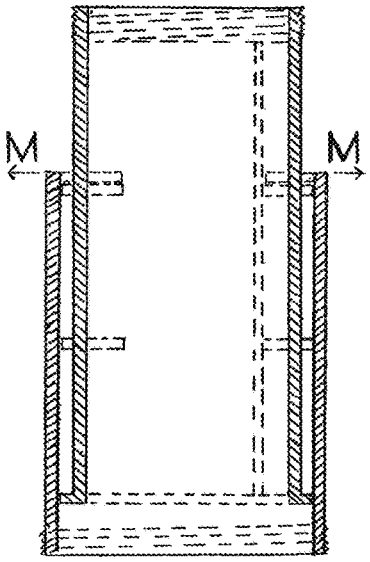
FIG. 31-C
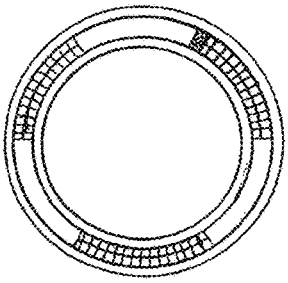
FIG. 32-B1
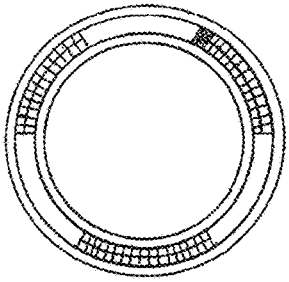
FIG. 32-B2
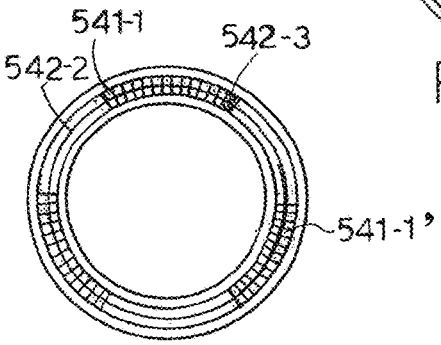
FIG. 32-A
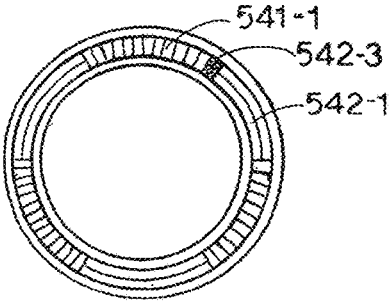
FIG. 32-C FIG. 33-A
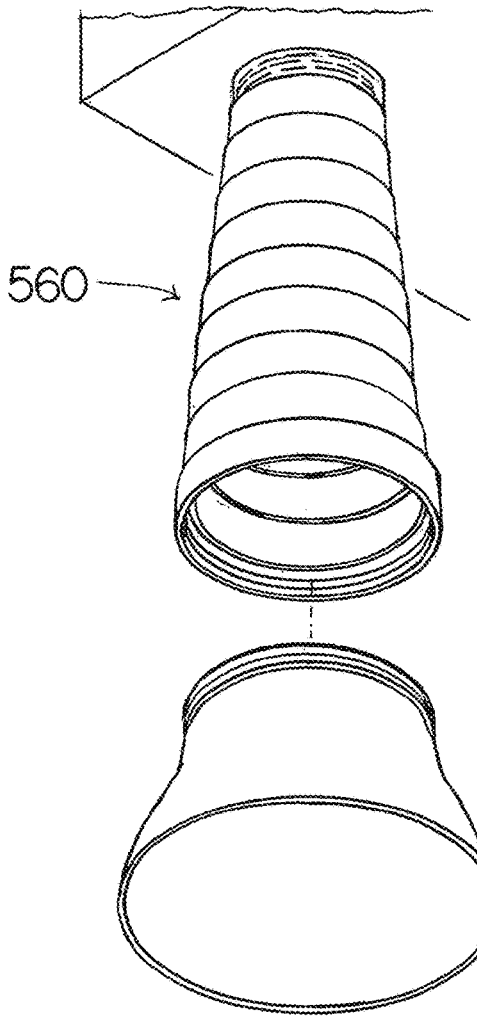
FIG. 33-B
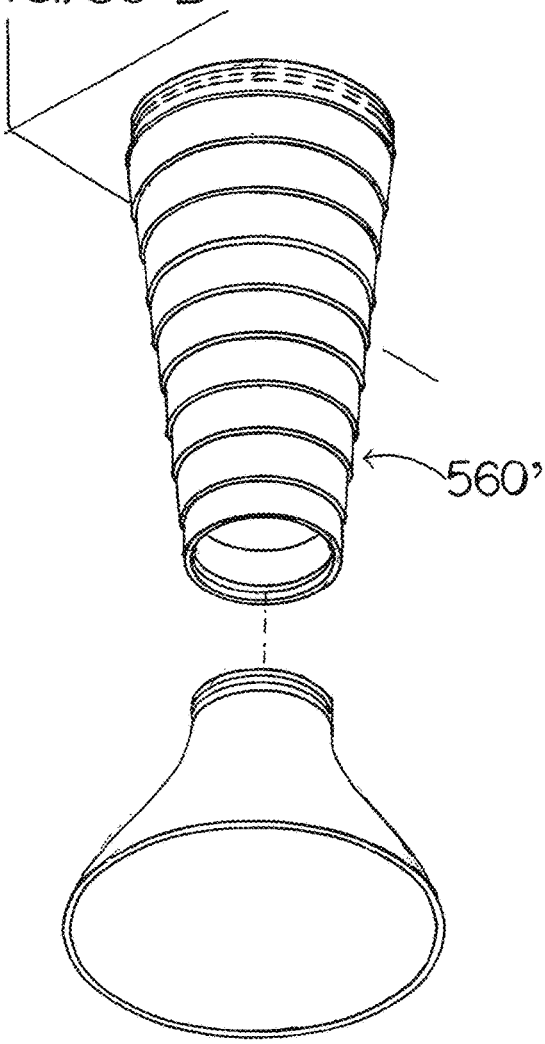
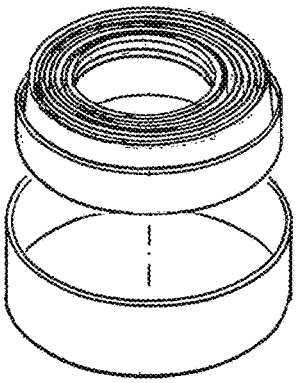
FIG. 33-C

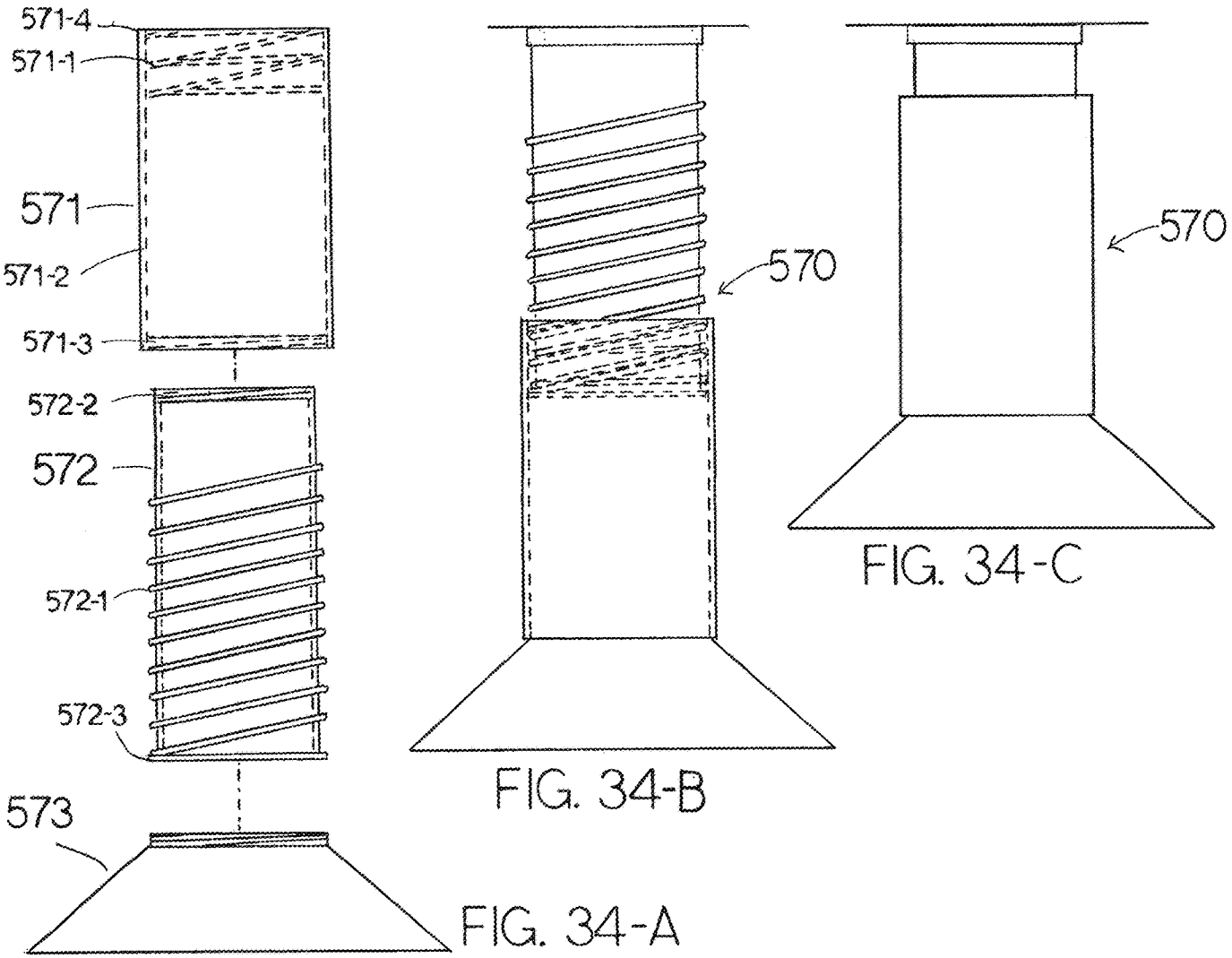
FIG. 34-C
FIG. 34-B
FIG. 34-A

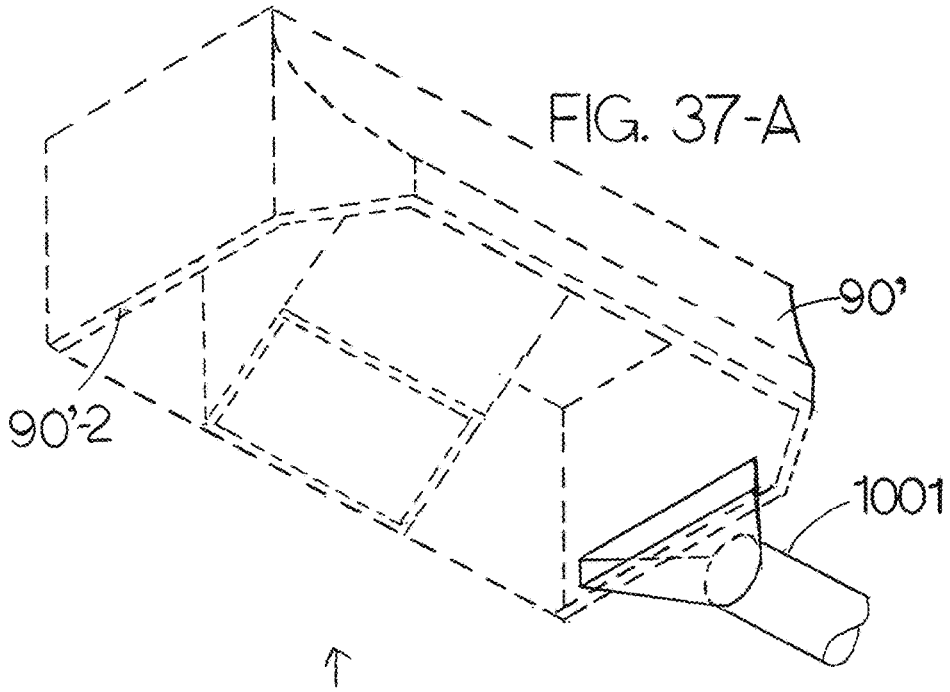
FIG. 37-A
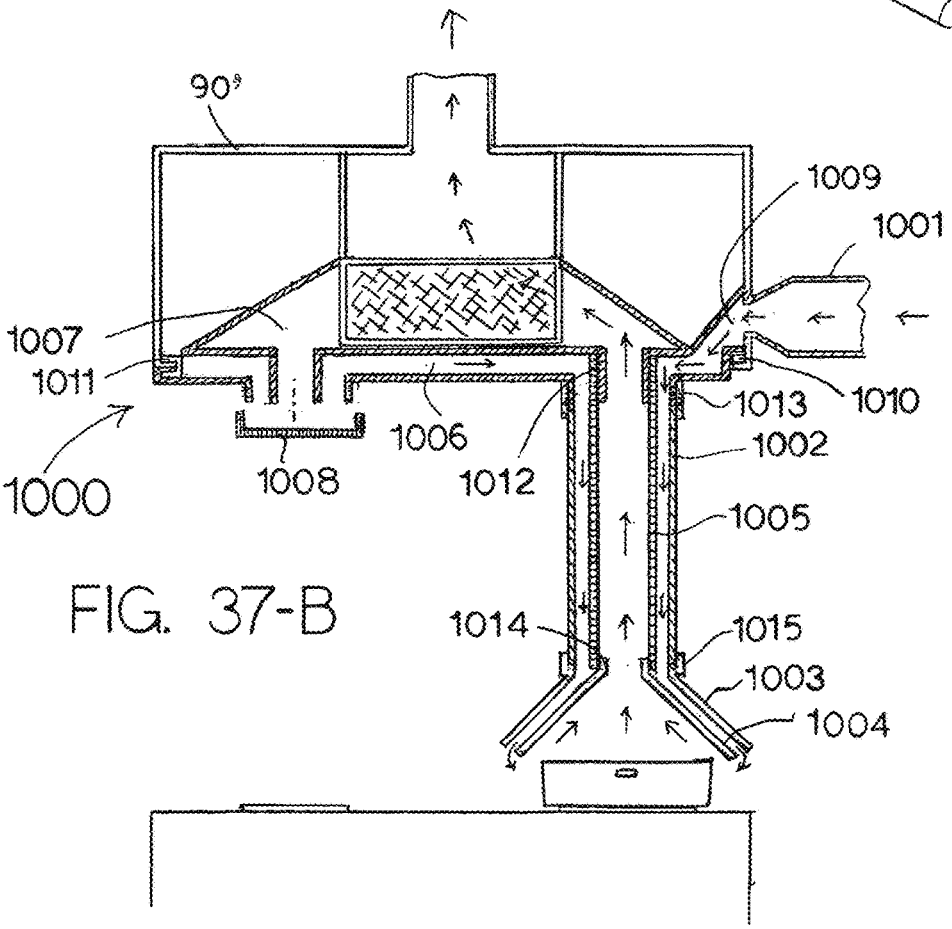
FIG. 37-B

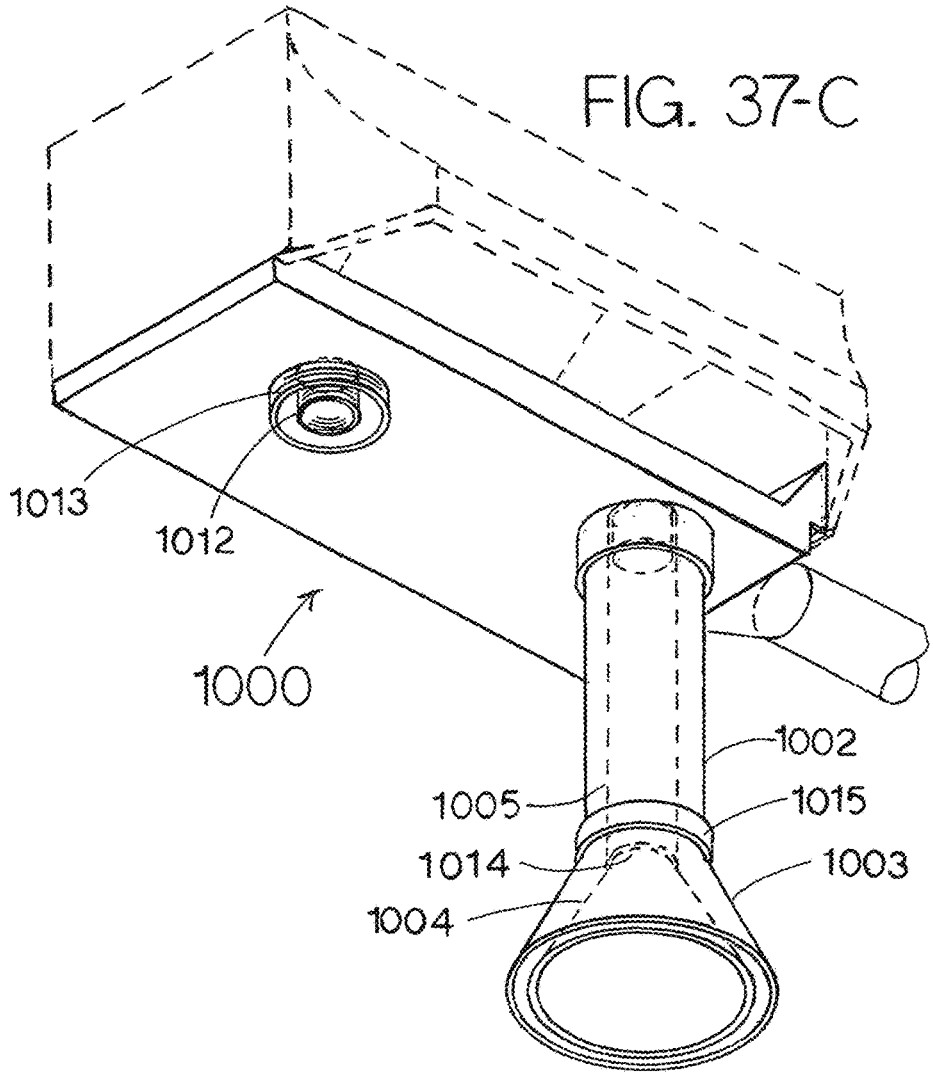
FIG. 37-C
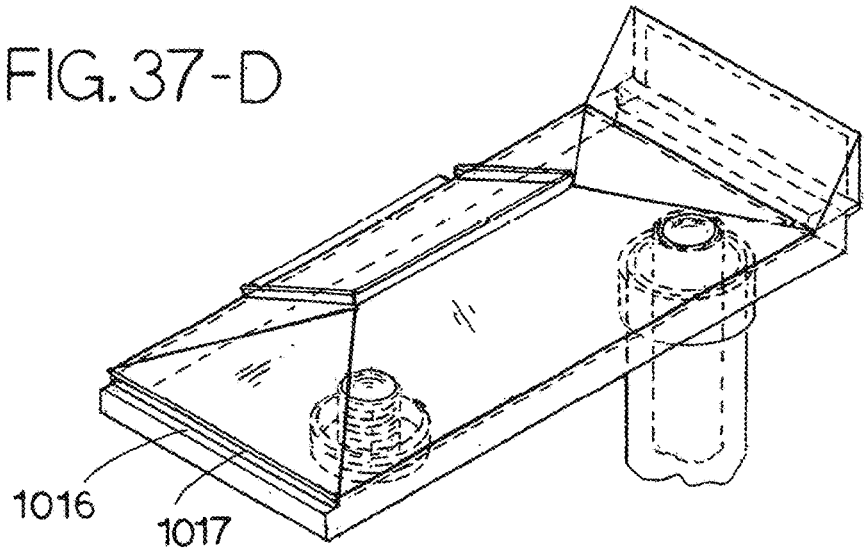
FIG. 37-D

FIG. 38-A
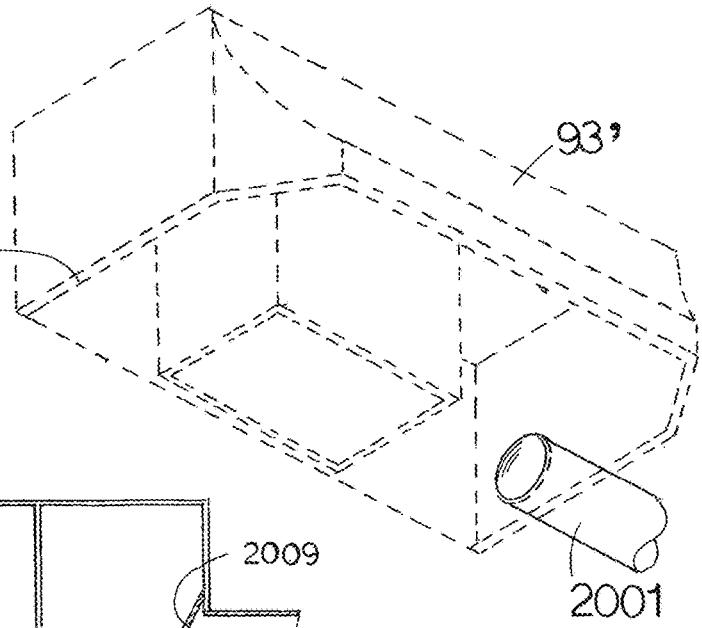
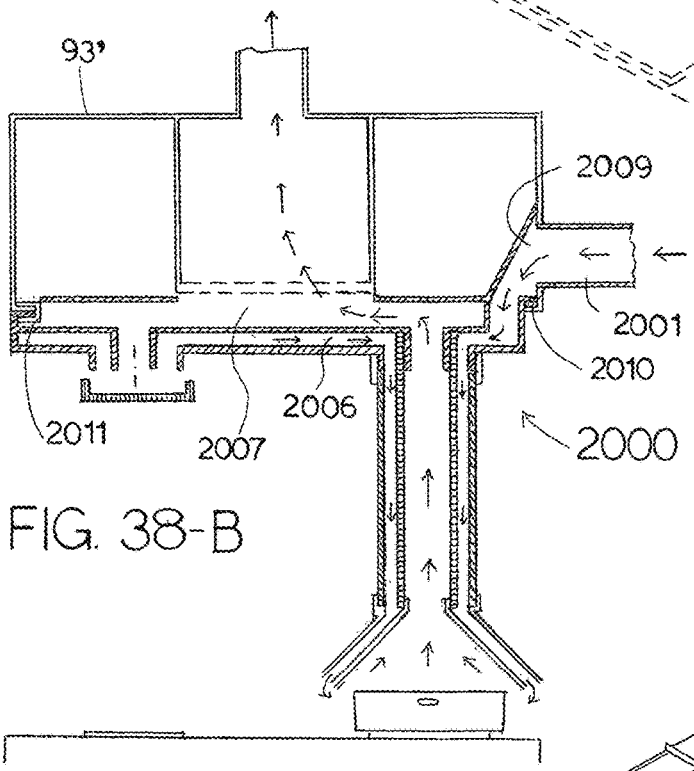
FIG. 38-B
FIG. 38-C
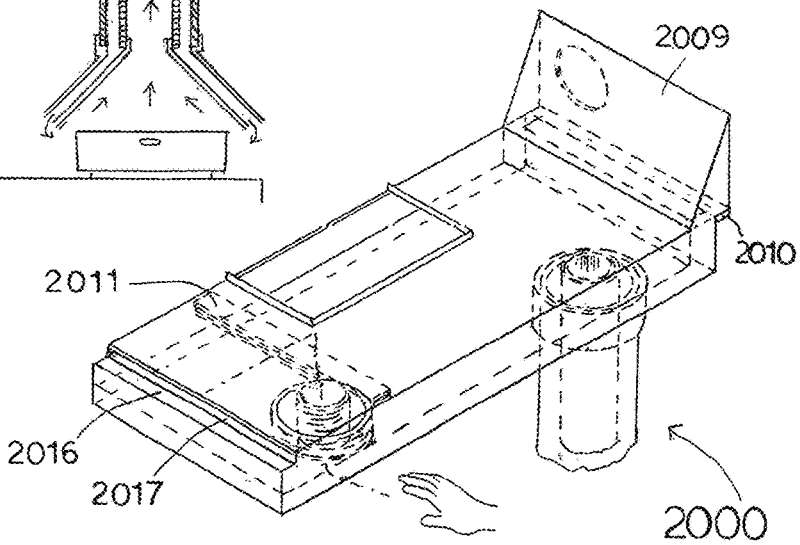

FIG. 39-A
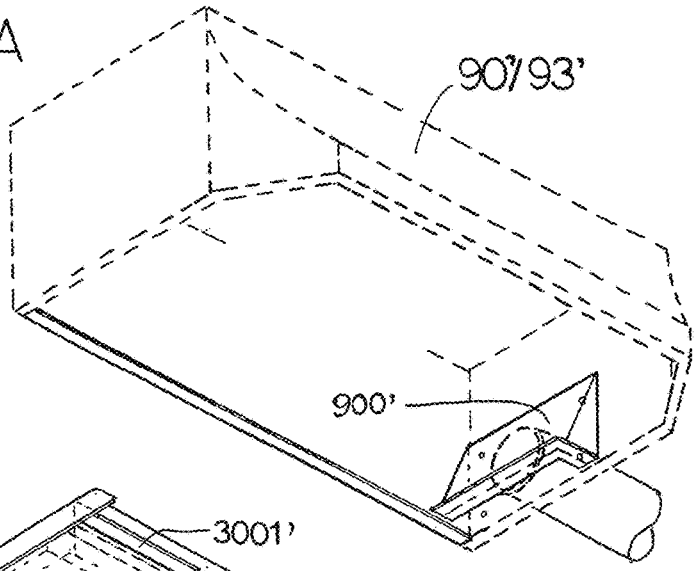
FIG. 39-B
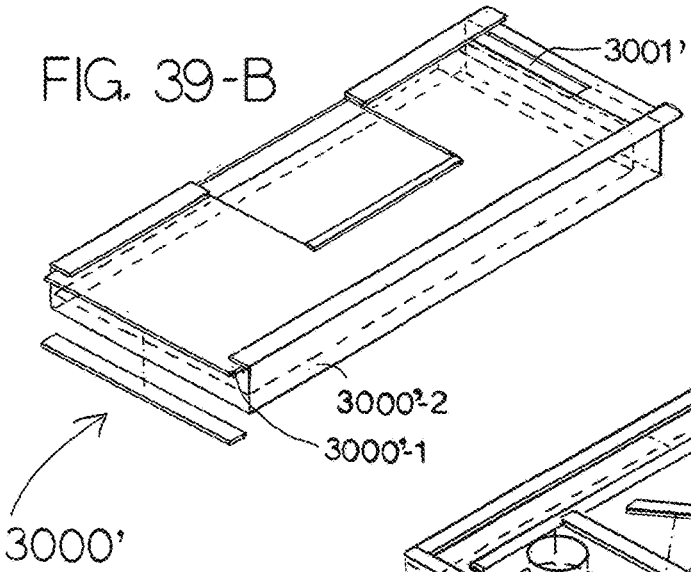
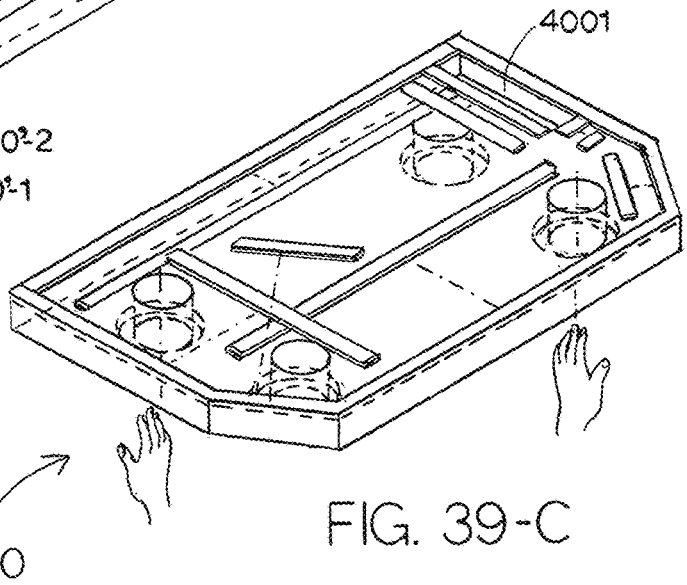
FIG. 39-C

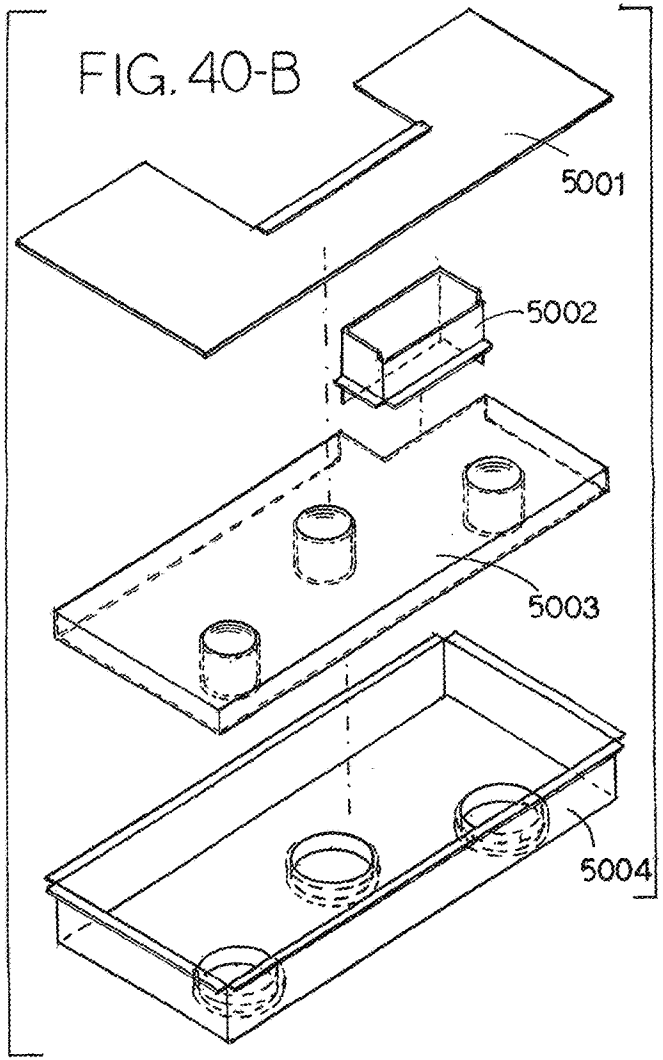
FIG. 40-B
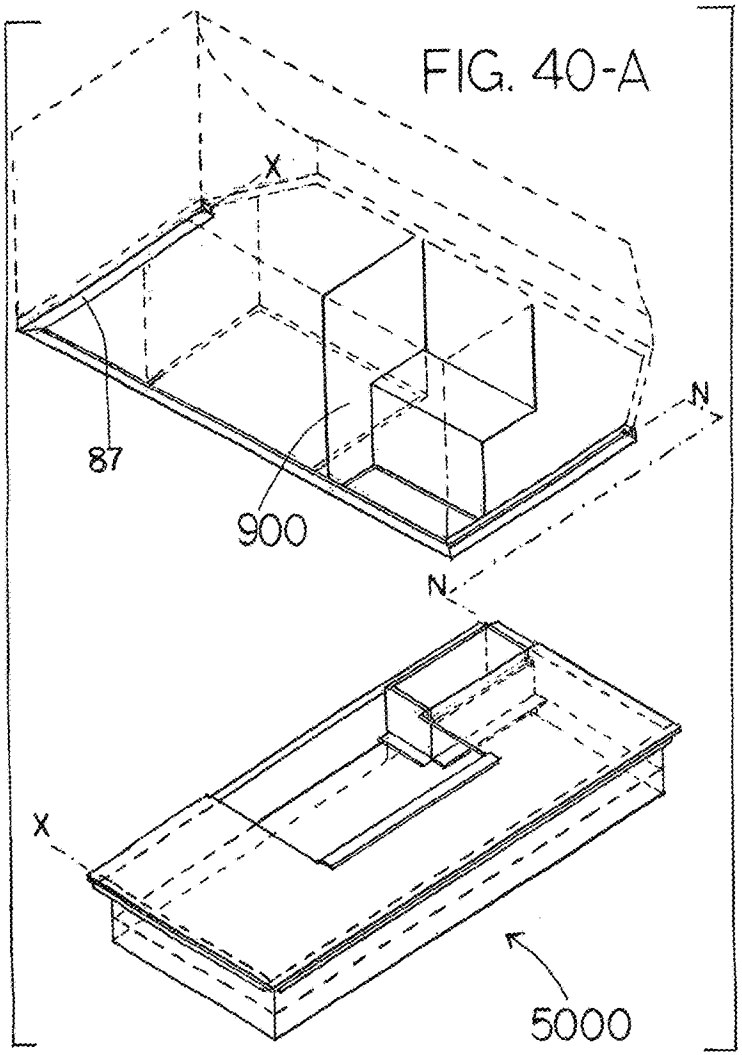
FIG. 40-A

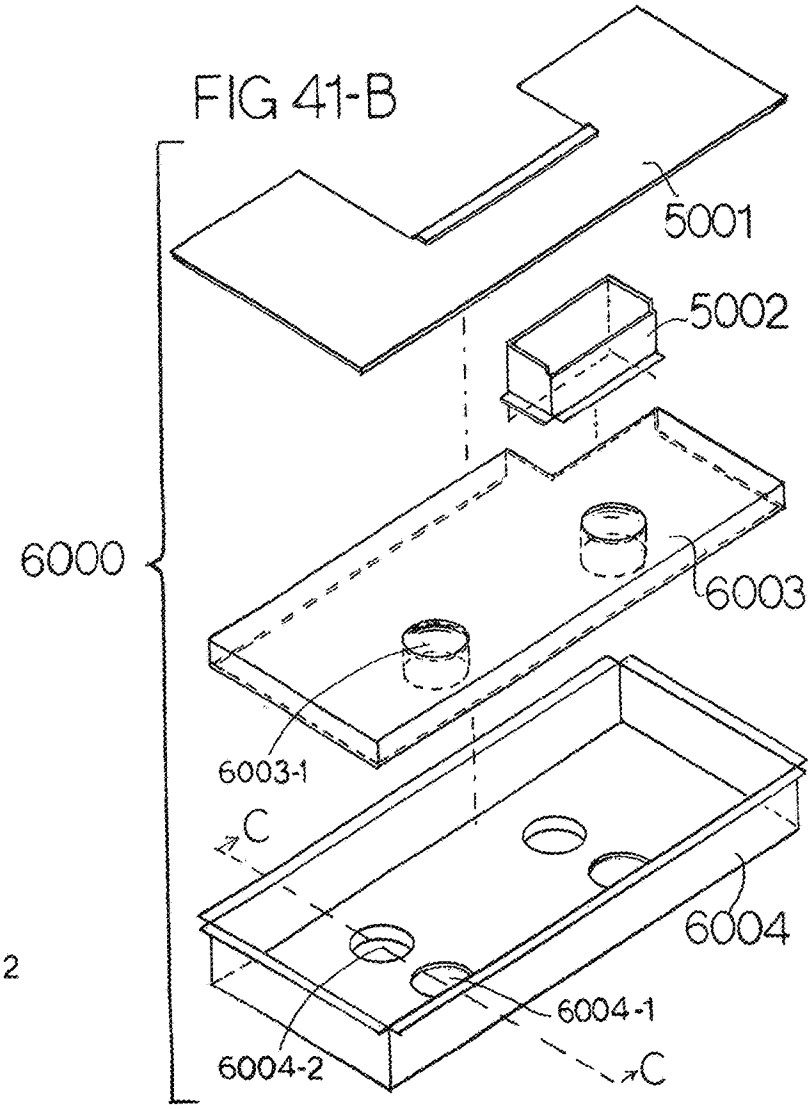
FIG 41-B
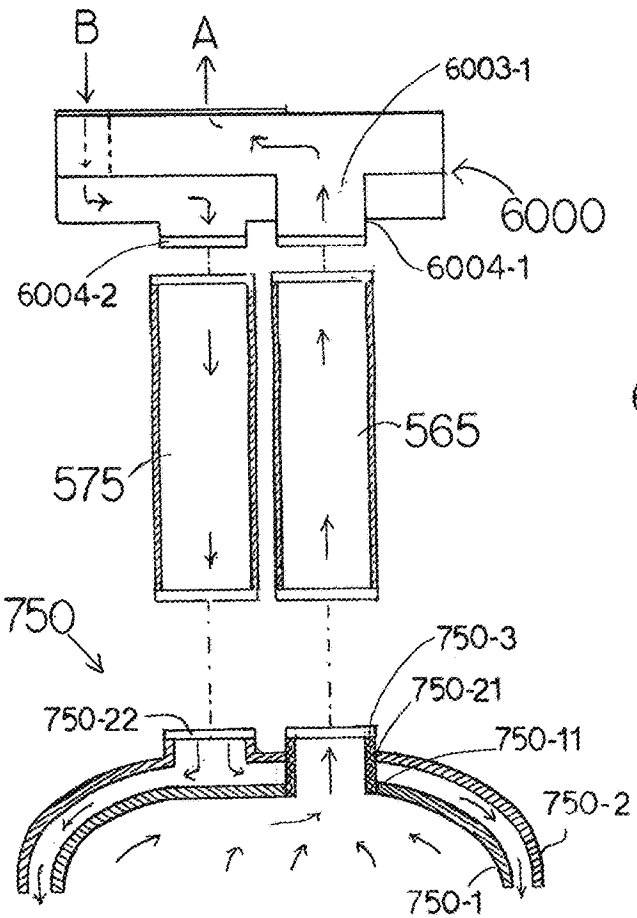
FIG. 41-A

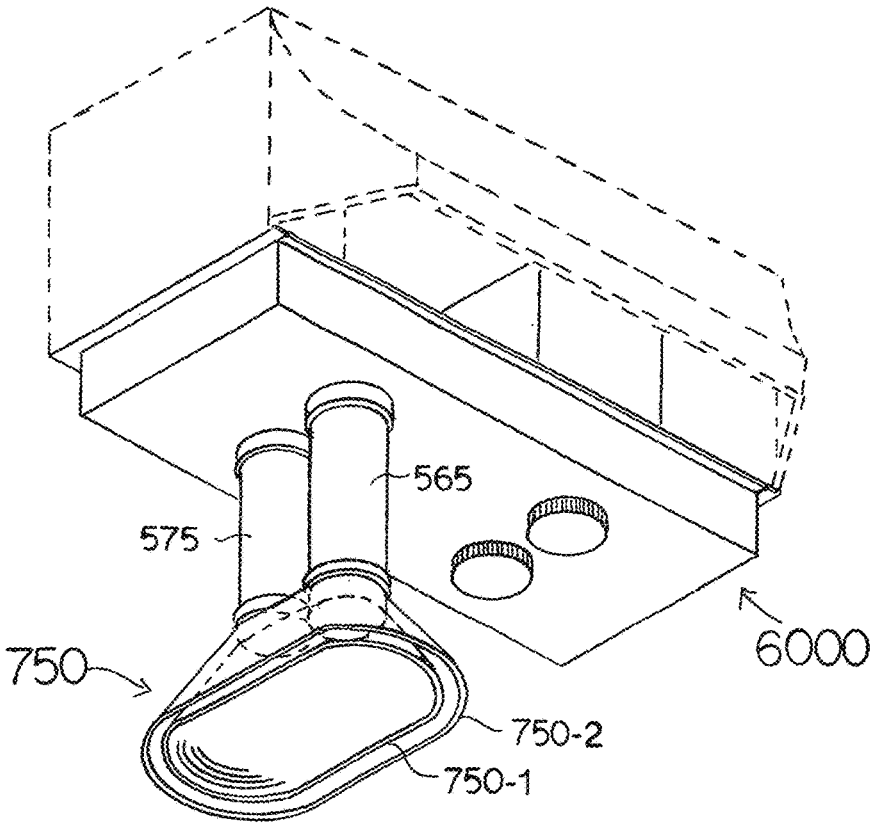
FIG. 41-C

VENT EXTENDER METHOD HAVING INTAKE AIR OPTION FOR CONVEYING VENTILATION TO CLOSE PROXIMITY OF A FUME AND ODOR SOURCE

BACKGROUND

Field of Invention

This invention relates to ventilating systems for the removal of odors, smoke, and fumes wherein there is an exhaust system comprising an over-the-range type hood, an exhaust fan or blower, and ductless or with ducting means to the outside and optional intake air.

Discussion of Prior Art

The elimination or reduction of odors, smoke, and fumes is presently addressed by the use of one or more systems. The first system is a ducted ventilating system for use in a cooking environment usually apart from the cooking range that comprises: 1) a range hood disposed at least two feet above the cooking surface and spanning about two thirds of the cooking range, 2) an exhaust fan or blower for sucking and blowing out the ambient air, 3) a filter for removing grease from the air, and 4) ducting for delivering the sucked filtered air to the outside.

A second system is also a ducted ventilating system but the air is sucked out not through a over-the-range type hood but downward through a filter-enclosed side opening and into a duct running usually below the cooking surface and leading to the outside. The upstream section of the venting system is usually an integral part of the cooking range.

A third system is a ductless one wherein the sucked air is delivered through an odor removal filter before being expelled back into the room. The air could be sucked through an over-the-range hood or through a separate free standing air purifier appliance.

Other later systems are basically variations or improvements of the above. One variation is the employment of two or more exhaust fans. A first fan would suck air rearwardly into a final exhaust duct; a second fan would blow intake air upward in the front section of the cooking range to trap cooking vapors, while a third fan could even increase the rate of suction by the first fan by blowing the air from the second fan towards the direction of the first fan.

There are variations ranging from the use of more effective odor filtering systems by increasing the number of filtering stages to the improvement of the filtering properties of each filter. Still another is the use of more powerful exhaust fans or blowers—fans that can eliminate air at speeds several times higher than the 160 cubic feet per min (cfm) speed of an economy range hood.

There is also the over-the-range hood designed for over-the-range microwave ovens. The bottom of the microwave becomes the housing for the hood. Upward fumes are now directed towards the rear of the stove and up or down behind the microwave oven.

More power is required to operate the increased number of fans as well as the increased number of filters the air has to go through. Ventilation systems with more complicated cooking range and hood designs are manufactured in order to accommodate the placement of these added fans and filters. Accordingly, the purchase price and the cost to operate and maintain them become more prohibitive to the average homeowner. These types of ventilating systems are therefore used mainly in commercial applications like food processing industries, laboratories, restaurants, and in finer modernized homes.

Most homes come equipped with the first system described above with vent units rated at 160-250 cfm. Within this range, there is also a wide range of noise level, ranging from 0.9 to 6.5 sones. Pricing is based usually on cfm and sone values. A premium is paid for higher cfm and for lower sone levels. The economy type 160 cfm model has an annoying 5.5 sone level, enough to give the cook a headache.

Under these circumstances, the exhaust fan is turned on high at the start of the cooking process and made to go on even hours after the cooking is done in order to sufficiently eliminate the cooking odors generated. If air is expelled at the rate of 200 cfm, operating the exhaust fan for just an extra hour after cooking would translate to 12,000 cubic feet of conditioned air expelled during that one hour alone.

In the winter in the coldest parts of the country, if 12,000 cubic feet of air was electrically preheated from say 0° to 25° Celsius, that would mean a heating loss of about 6 KW per hour of operation. In the inventor's part of the country, this loss presently translates to about $0.84/hr. Operating the fan one hour extra per day translates to a loss of about $25/mo.

In the summer in the hottest parts of the country, if the above air were cooled from say 50° to 25° Celsius, that would mean a cooling loss of about the same per hour of operation.

A more powerful fan that can have odors sufficiently eliminated as soon as cooking is over, is able to do so because it eliminates air at much higher speeds. Therefore, in addition to the extra operating cost of this higher-ampered fan, the heating/cooling loss from the excessive air withdrawn is still not avoided. If a 400 cfm fan is used instead of a 200 cfm one for a cooking time of one hour daily, the loss is also about $25/mo. Five months of cold season and three months of hot season can translate to a total loss of about $200 annually.

Therefore, no matter what cfm rating is on the ventilating system used, whether it is a system that expels excessive air only during cooking or a system that requires extra ventilating time after cooking, each translates to losses that can be avoided or reduced.

In addition to the exhaust fan being operated longer to adequately eliminate the odors, there is also the added discomfort of the cook "smelling like the kitchen". This is because without a shield/curtain of air or other material in the front and the sides of the stove, turbulent cooking vapors can escape in many directions. The effective power of the exhaust fan is diminished by the large open space it is exposed to. Also, the kitchen surfaces, walls and fixtures will already have absorbed some of the grease and odor from the air before that same air is eliminated during the additional venting time. There is a potentially substantial amount of labor involved in cleaning up the accumulation on these surfaces, walls, and fixtures.

The extra cost associated with a normal venting system that daily has to run hours after cooking is done can be substantial in the long run. It can be compared to that associated with having drafty windows and doors. That is why people invest highly on good quality windows or absorb the extra cost and effort to install plastic insulating covers to drafty windows winter after winter. It can be compared to paying the extra cost of owning and operating a venting system with more powerful exhaust fans or more effective filtering systems so that the exhaust fan/s do not have to run as long. It can be compared to constantly running a whole house air-cleaning machine because kitchen odors can pervade the entire household. This extra cost is something that everyone would want to reduce or eliminate.

Prior art, U.S. Pat. No. 4,346,692 (1982) teaches of a make-up air device for a range hood to minimize the loss of heated or cooled air from the house. A fan sucks unconditioned air from the outside and delivers it downwardly from the front perimeter of the range hood, like an air curtain. It is estimated that 80% of the intake air is used. Only 20% conditioned air is expelled. However, this requires installation of a new and additional ducting structure from the outside, a new electrical system, a new range hood, even a new cooking range, and extra energy cost to power the extra fan. Older homes and even most newly constructed homes for the average homeowner do not have this sophisticated ventilation system. With the standard range hood, 100% ambient conditioned air is what is lost during the venting process and replaced by outside air infiltrating from unsealed openings around the house. Their only feasible option is something affordable that can eliminate the most concentrated odor and grease laden air as soon as they are produced, thus reducing venting time and loss of conditioned air. The present invention can reduce if not close the gap between a vent system having intake air capability and a standard one that has none.

Even a ventilation system having intake or make-up air can still benefit from the use of the present invention because the venting time is reduced and the fan can be set on "low". Referring to FIGS. 42-47, the use of make-up air instead of conditioned air has little or no effect on the linear velocity of the grease and odor laden air surrounding the kitchen stove area because the openings (3 exposed sides for Prior Art I, II, V, VI and 4 exposed sides for Prior Art III and IV) for air flow remain the same. Therefore, a venting time more than that needed with the use of a vent extender is still required. Granting that having intake air is better than none, even top of the line residential hoods with ratings up to 1500 cfm do not come with intake air provisions. Only commercial hoods have them. A 1500 cfm venting system with no intake air costs about $6.40/hr. to operate.

Prior art, Patent Application Publication #20040206348 A1 (2004) teaches of a removable hood extension comprising a peripheral flap extending from the front of the hood supposedly to overhang the front area of the range top that ordinarily extends beyond the perimeter of a standard range hood. However, this hood extension still permits the entry of a large volume of conditioned air from the exposed three sides, thus does little or nothing to increase the air velocity or reduce the needed venting time. When the two front burners are used, the hood extension can restrict visibility and accessibility of the back burners especially for tall persons. Therefore, when only one or two burners are needed for use, a normal circumstance, the cook should just use the back burners because they are directly underneath the hood. The front burners can be covered and used as extra counter space.

It can be argued that using more than two ducting system with canopies of the present invention can also restrict visibility. This is not the case because burners on stove tops are arranged askew from each other and are differently sized to accommodate cookware of different sizes. Therefore, the inlets directly above them can also be skewed accordingly, and consequently the ducting system. Canopies may be provided in different sizes to approximate the size of the cookware. Finally, a flexible and extendible ducting system, the tilting ability of the canopy, the swiveling ability of the ducting system, the ability to remove the duct from the inlet, and the ability to remove just the canopy provide the instant catch-all solutions to whatever needs to be moved out of the way. Despite the drop in pressure experienced in a flexed duct, the efficiency of capturing cooking vapors is substantially the same for venting purposes for a straight duct and a flexed duct or for a level canopy and a tilted one because all are very close to the fume source.

Prior art U.S. Pat. No. 4,200,087 (1980) teaches of a flow director removably attached to the underside of the hood of a kitchen exhaust system having both air intake and exhaust blowers. The flow director has a narrow rectangular slot running along the front section to provide a high velocity of exhaust air adjacent the slot. The patent teaches that since the exhaust fumes are close to this slot, the air and fumes will also have a high velocity adjacent the slot. The flow director has a width that can vary to accommodate the width of the cooking unit. The linear velocities are maintained by narrowing the slot opening for wide widths and expanding the opening for narrower widths. This is done by forwardly and rearwardly extending a bottom wall over the slot respectively.

The high linear velocities adjacent the slot of the flow director do not translate to high linear velocities in the non-adjacent area because there is about a 24"×80" non-enclosed clearance between the slot and the source of odors and fumes. Linear velocities in this region are still low. This clearance will introduce conditioned ambient air for mixing with the turbulent cooking vapors. A part of this mixture escapes through all exposed sides and up through the front of the stove that is not covered by the hood. It is like vacuuming dust off a floor by positioning the end of the vacuum hose two feet above the floor.

While this particular type of venting system is suggested for commercial use with intake air and no back burners. In residential applications, no intake air is provided and back burners exist. These back burners are particularly at a disadvantage because the exhaust system that could have been directly overhead otherwise is now covered by the flow director whose slot is disposed only towards the front. There will be more stagnation points in the flow direction and more intermixing with ambient air, some of the mixture escaping through the sides before the slot can capture them.

Therefore, replacing the flow director even with just the hood adaptor of the present invention and opening only the inlets that are directly above the burners in use is overall a more efficient way of capturing cooking vapors than a single frontal slot because all burners can be provided with the same overhead exhaust provision resulting in less stagnation points in the flow direction. Some people prefer to use the back burners over the front ones because the front ones can be covered and utilized as extra counter space. U.S. Pat. No. 4,200,087 does not teach about another slot for the back section because there are no back burners and also because the presence of that other slot will defeat the purpose of the alleged high-velocity "air curtain" in front. Nor does it teach of a ducting system upstream of the slot to further increase vapor capture. With the present invention, the 24"×80" clearance can be reduced to practically nothing. Imagine the linear velocities that can be realized right from the odor and fume source and all the way up to the inlet opening.

There is the existence of commercial ventilation systems without intake air in other completely different fields that uses a canopy and duct. A canopy and a substantially long duct communicating to a remote exhaust system are employed to very gently eliminate dust or particle impurities from the proximal environment of micro-sized or nano-sized technical elements. The same arrangement is used to continuously vent fumes in a chemical laboratory setting. The exhaust system does not use an over-the-range type hood and does not have provision for intake air.

There is the existence of laboratory fume hoods (U.S. Pat. No. 3,425,335) with an over-the-range type hood with enclosed back and sides accessible only through a front window with variable opening. While this design can help realize high linear vapor velocities, the design is not appropriate for cooking purposes because the working area is too confined, not to mention the prohibitive cost of such a fume hood.

So far, the prior art described above are the only options available for the consumer who desires to live without the discomfort associated with cooking vapors. There is a better solution that does not require permanent new ducting installation and replacement of existing range or range hood.

SUMMARY OF THE INVENTION

The vent extender method is used to harness and convey the suction power of a ventilating system as close as possible to the vapor source, thus eliminating only the most concentrated odor laden air and minimizing the expulsion of clean ambient air, without the use of extra or more powerful exhaust fans, extra or more effective filters, or extra venting time. It does not involve a flap or front extension of the hood. It utilizes the existing hood underside for its purpose. It comprises of an adaptor to the existing venting system and a length of exhaust tube. One end of the exhaust tube connects to the adaptor while the other end may be attached to a heat resistant exhaust canopy positioned right over the cooking vessel or other odor or fume sources.

An improvement involving the use of intake air comprises the use of an intake air source and the addition of an intake tube and intake canopy enveloping the exhaust tube and exhaust canopy respectively through which intake air is delivered right to the mouth of the fume and odor source.

Another improvement comprising the use of a double-walled canopy allows the exhaust and intake tubes to be separate or non-concentric.

Objects and Advantages

FIG. 48 is a graph of linear velocities realized right at the mouth of the fume and odor source versus the number of ducting systems of the vent extender used and was derived based on the following:

a) use of a typical 30"×17.5" Prior Art I or II range hood (FIG. 42 or 43) with different cfm ratings,
b) the range hood is positioned 24" above a 30"×25" stove,
c) a 13" canopy is positioned 4" above the top of a slightly smaller-sized frying pan,
d) the hood without the vent extender is represented by an arbitrary high number of ducting systems in use 99.

FIG. 49 is a graph of operating cost per month versus different cfm (cubic ft. per min.) ratings of range hoods for different % usages of intake air and was derived based on the following:

a) cost of heating air from 0° to 25° Celsius, equal to cost of cooling air from 50° to 25° Celsius,
b) air behaves as an ideal gas
c) power rate is $0.14 per kwh
d) typical 160 and 200 cfm hoods each require 2.5 amps to operate,
e) typical 300 cfm hoods require 3 amps,
f) typical 400 cfm hoods require 4 amps,
g) typical 600 cfm hoods require 5 amps,
h) typical 1500 cfm hoods require 6 amps,
i) intake air used is 0% for no intake air option,
j) 80% usage of intake air is claimed by prior art,
k) Practically 100% intake air usage is claimed by the present invention,
l) 1 hour of operation,
m) all hoods are commercially available with intake air option even though they are not,
n) pressure drops are not accounted for, assumed negligible,
o) depreciation cost is negligible, Accordingly, the following are several objects and advantages of the vent extender.

1. The vent extender can substantially reduce energy consumption from the use of the venting system.

With the use of the present invention, the ventilating system does not need to operate for extended periods of time after cooking. It is reasonable to assume that it should take extra venting time of at least equal to the expired cooking time. In practice, the needed venting time is actually longer especially for lower rated 160-200 cfm hoods. Therefore, the operating cost can also be viewed as the savings realized by not having to vent that extra time. As such, the most costly to operate stands to gain the most benefit from the use of the present invention. As gleaned from Graph II above, the use of the vent extender on a 200 cfm rated vent system with no intake air provides savings of about $25/mo. This is about the same as the savings provided by the vent extender on a 600 cfm rated hood with 80% intake air usage. The use of a 160 cfm hood with intake air at 80% efficiency provides savings of about $7.50/mo.

2. The present invention can help reduce the advantage of a ventilation system with intake air capability over a standard one that has none.

A 1500 cfm rated hood with 80% intake air capability is probably the minimum used in commercial kitchen venting systems. From FIG. 49, its operating cost is comparable to that for a 350 cfm hood without intake air. Referring to FIG. 48, a 350 cfm venting system can still meet the OSHA linear velocity standard of at least 100 ft/min with the simultaneous use of even up to three ducting systems of the present invention. Therefore, why should valuable resources be wasted on expensive 1500 cfm commercial venting systems with intake air capability if one can accomplish the same with an affordable 350 cfm unit with no intake air and the vent extender? Likewise, if a 452 cfm unit can meet the OSHA standard even with simultaneous use of four ducting systems of the present invention, why waste resources on anything costing more? The present invention can help reduce the advantage of a commercial ventilation system that has intake air capability over a standard one that has none to the relief of the average homeowner.

3. The present invention provides the means to seal the outlet opening to the outside for further energy conservation.

Dampers installed downstream of the existing ducting system do not give a tight seal even when the fan or blower is not operating. Clean heated or cooled air from the house can still slowly escape through them because of what is called the "chimney effect" caused by differences in elevation between the outside and inlet openings. With time, large energy losses are accumulated without the homeowner being aware of. Inlet openings of the vent extender can be sealed with covers thus solve this problem upstream of the existing ventilation system.

4. The present invention provides structure for an air intake system that is practically 100% efficient.

An improvement of the present invention involves air intake that require minimal structural modifications to existing basic vent hoods. A source of intake air is connected to the underside and a second tube and canopy further directs the intake air right to the top perimeter of the fume and odor source. Because it is simple, it is hoped that affordable residential vent hoods with intake air option can be made available to everyone. The cost should be less than twice the cost of a standard ventilation system with no intake are. The intake opening in the underside of the hood may simply be sealed closed if the intake air option is not desired. Referring to FIG. 49, the operating cost with 100% intake air is negligible because power to operate just the exhaust fans is minimal. The entire area below the 0% and 100% intake curves us the savings still to be tapped.

5. The present invention provides for a cleaner kitchen. Surfaces, walls, fixtures, and air are cleaner because the grease and odor laden air are expelled as soon as they are produced with minimal or no chance to escape and mix with ambient air.

6. The present invention prevents "cooking smell" from people in the cooking area.

No odors are absorbed by the people present in the kitchen because the cooking vapors that naturally rise upward are powerfully sucked towards the vent extender and immediately directed away from the cook, 7. The present invention provides a more effective exhaust fan at minimal cost.

The entire power of the exhaust fan less a minimal pressure drop can be utilized by one, two, three, four or more burners at a time as needed. The use of one extender can increase the air's linear velocity by about 11 times. Under ideal conditions, simultaneous use of two, three, and four ducting systems can increase the linear velocity by 5.5 times, 3.7 times and 2.7 times respectively.

The power from the vent extenders may be adjusted down if the aroma of a particular food is desired in the area or if the resulting linear velocity is otherwise too strong or if the venting system cannot be adjusted down further. This can be done by raising the canopy or simply uncovering one or more of the remaining adaptor inlets or adjusting the opening of the inlets. To increase linear velocity, lower the canopy further or reduce the number of extenders being used simultaneously and keep the other inlets covered.

8. The present invention can be used to effect an above standard fume hood at home.

The standard set by the Office of Safety and Health Administration (OSHA) for fume hoods is 100 ft./min minimum linear velocity proximal to the fume source. While air laden with cooking odors may not be considered hazardous like toxic chemical fumes, the OSHA standard gives an idea of what is needed to instantaneously rid the air of any newly generated vapors.

Referring to FIG. 48, a 160 cfm ventilating system can at best provide a linear velocity of only about 13 ft./min. adjacent the cooking pot. A 200 cfm system provides a linear velocity of about 16 ft/min. Judging from experience, the speed at which cooking fumes are generated must be much higher than these causing some of them to mix with ambient air before the power of the fan could get to them.

At best, a minimum of 1240 cfm ventilating system would be needed to meet the 100 ft/min OSHA standard. An external blower would have to replace the exhaust fan to bring the noise level to an acceptable level. A system of this rating is beyond the financial reach of the average homeowner—considering both fixed and operating cost. Imagine the heating or cooling loss of that large volume of air expelled—roughly $190/mo. It is for this reason that intake air should be a must with this type of venting system. The fume hood standards cannot be possibly met at an average home.

With the vent extender, even the 160 cfm economy-type hoods can produce approximately 142 ft/min linear air velocity adjacent the fume and odor source when using a single inlet. Even if the canopy were raised up to 5" or tilted up to 10" on one side, high linear velocities meeting OSHA standards remain. At these velocities, there is no chance for the fumes to escape. Again, only a 1240 cfm venting system can match these velocities without the use of the vent extender.

Looked in another way, the vent extender can turn an outside vented economy hood into a fume hood when needed. For example, there are times when the kids have to spray paint and dry school projects or perform experiments with volatile chemicals indoors at home in the winter. The vent extender can make this safely possible to the average family. A couple of hours under the canopy of the vent extender are usually all it takes to dry painted objects for a minimal total vent operating cost of about $1.40 using a 160 cfm venting system. No trace of paint odor is detected.

The purchase of a vent extender is justified even for occasional use only if it is simply reserved as an emergency fume hood for the home or for cooking really odor-generating food like fish.

9. The present invention provides a quieter atmosphere during and after cooking.

One end of the vent extender duct is adapted to attach to the hood upstream of the filter and fan, thus considerably sealing off part of the fan motor-generated noise during operation. The hood adaptor may also be lined with noise absorbing material to further reduce noise. Also, the exhaust fan can now be turned off right after cooking, making dinnertime more enjoyable. The resulting quieter venting system will encourage the homeowner to cook more often and to always use the venting system while cooking. This makes for healthy food and healthy air.

10. The present invention provides structural means to add one or more layers of filters to existing venting systems.

The connectors at both ends of the extension tube units can be equipped with space for insertion of extra or secondary filters if desired. Because a high linear velocity is made possible, there is ample allowance for some drop in linear velocity resulting from the use of the extra filters. The filters will substantially reduce the grease accumulation on the underside of the vent hood and on the primary filter. For non-vented hoods, the extra charcoal filters will augment the primary filter in absorbing odors. If the primary filter is the washable type, it need not be cleaned as often. The secondary filters can be made disposable. If the primary filter is costly, it need not be replaced as often.

11. The present invention is portable.

As can be seen from the figures, the vent extender comprises of parts that are adjustable, extendible, easily replaceable, interchangeable, collapsible, taken-down, taken-apart, stored-away, or packed for use in an apartment, time share, or vacation home if desired. The self-enclosing type with wings or slide out parts or compression spring extension rods may even be adapted for different-sized hoods.

12. The present invention is easy to clean.

The entire vent extender can be taken down and apart for occasional cleaning in the sink. If a self-containing vent extender type is used, the underside of the existing vent hood need never be cleaned. A removable and disposable cheap plastic liner approximating the hood dimensions or incorporating an aerodynamic shape and receivable under the hood can be mold-fabricated to go with the self-enclosed and hood-enclosed type of vent extender. A hood-enclosed type of vent extender can be made self-containing with the addition of this liner. The canopy also acts as an easy to clean spatter shield. It can obviate the use of electric deep fryers with charcoal filters. In this age of "disposables", the plastic canopy, plastic liners, and flexible duct do not cost much to fabricate that they can be considered disposable and easily replaced even just once a year.

13. The present invention can directly vent vapors from other cooking appliances that are placed on countertops.

By adding duct extension units and augmenting support for the ducting system, the vent extender can be made to reach other areas of the kitchen and not just directly below the hood. This is particularly useful for indoor tabletop grills, deep fryers, toasters, toaster ovens, pizza ovens, roasters, etc. that cannot be placed under the vent hood for some reason. If the appliance is unusually large, two ducts and two canopies or two ducts connected to a double-topped elongated canopy can be used.

14. The present invention is adaptable to most already existing ventilation systems.

There is minimal or no modifications in either the extender or the existing ventilation system with the use of the vent extender. It may be produced in colors to blend with and to complement existing venting units. The vent extender can come in several types and duct lengths to customize to the needs of the user and manner of cooking. Hood adaptor inlets and duct fittings can be standardized to fit each other for all types of hood adaptors so that the homeowner can easily choose from several types of ducting sections available.

15. The present invention is affordable to the average consumer.

Considering the extra utility, savings, and comfort realized from the use of the extender as well as the easily fabricated parts, the fixed cost is going to be within the financial reach of any homeowner. It can virtually give a return several times its purchase price.

16. The present invention provides health advantage at no extra cost

Health advantage is derived from breathing cleaner air without the associated cost of prolonged venting, the use of air fresheners or whole-house filtering/ionizing systems, and without foregoing home cooking. Because the cook is confident that undesirable cooking odors can be quickly eliminated and that the considerably reduced noise coming from the operating exhaust fan is not going to give him/her a headache, he/she is more willing to prepare more home-cooked meals and experiment with food preparation—even using fish and other exotic odorous spices or ingredients. It is a generally accepted idea that home-cooked meals are healthier than canned or take-out. Also, entertaining while cooking in the kitchen area is no longer inconvenient for people living in a modest home.

17. The present invention is safe, non-intrusive, manageable, and can be made attractive One of the means of connecting the parts of the vent extender involves threading male and female parts. This will eliminate the chance of a canopy falling off and over a hot cooking pot. The joined threaded parts are independent of other joined threaded parts. As long as the user holds onto the appropriate parts while tightening or loosening a connection, the other connections are not affected.

The ducting system is extendible up or down or sideways to conform to the location and the height of the cooking pot and to allow extra room for occasional stirring and adding of ingredients into the pot. It can be made up of one or more rigid or flexible duct units or any combination of both.

The canopy is designed to contain rising cooking vapors until the exhaust fan or blower can carry them up the duct. At high linear velocities, these vapors almost instantaneously leave the canopy. Canopies may come in many shapes and sizes to accommodate the various sizes of cookware, although one large canopy is sufficient for most uses. The top opening need not be centered to adapt to a location that is close to a wall or similar obstruction. Linear velocity is inversely related to the open area that allows ambient air into the canopy. Therefore, for greater efficiency, it is preferable that the perimeter of the canopy used be at least equal or just a little larger than that of the cookware. In practice, a distance of only about 8 inches in front of a tilted canopy between the top of the cookware and the bottom of the canopy is ideal even if food need to be stirred often.

The canopy may be made of lightweight heat resistant preferably transparent material so that the cook can still view what he or she is cooking without having to tilt the canopy substantially. Even if it is made of a heat resistant plastic material, it is preferable and understandable that it does not come into contact with the cooking vessel. An inch clearance between the bottom perimeter of the canopy and the top perimeter of the cookware is very effective. Nevertheless, in the event that the canopy becomes warped by extreme heat and becomes unattractive, it should not cost much to replace.

The canopy may also be made of metal and may be equipped with the ability to tilt to allow the cook to see his/her cooking. Because the metal canopy can safely touch the top of the cooking pot higher linear velocities become possible. Also, in the unlikely event of a flare-up or food burning, the fumes are instantaneously vented out with no chance to spread around the kitchen. A metal canopy is preferable also if the cook plans to leave the pot unattended while the food is gently simmering. In this case, a canopy touching the top of the cookware as a loose cover is considered safe and very effective that the fan can be set on "low".

The increase in effective power of the existing venting system with the use of the kitchen vent extender help minimize the risks associated with the use of gas ranges. Recommended cfm ratings for gas ranges are generally higher than that for electric ranges.

The duct and canopy can come in may different colors and designs to complement any kitchen.

18. The present invention makes the non-enclosed underside of a vent hood more attractive.

The hood adaptors fully or partially enclose the underside of a hood. When the ducting is taken down for storage and the inlets are covered, the resulting look is more attractive than that of an open underside or that of a fully enclosed underside with just the filters exposed because none of the grease laden filters are in view. Both the adaptor bottoms and covers may be made in colors and designs that blend with the rest of the hood. Open undersides serve to capture and hold cooking vapors as much as possible until the exhaust system can expel them. Enclosing these undersides defeat that purpose. With the present invention, the homeowner can enjoy the attractive neat look of a truly fully enclosed underside while enhancing the benefits derived from the open underside.

19. The present invention provides the structure to make the non-enclosed underside of a vent hood more aerodynamic.

The hood adaptor top can provide the structure for reshaping the hood underside to channel vapor flow directly, thus, more efficiently towards the primary filter and exhaust fan. Stagnation points are minimized and more power from the fan is harnessed.

20. A series of lower rated over-the-range venting hoods each using a vent adaptor having one or two inlet openings can be arranged side by side to replace a long commercial one with a high cfm rating. That way, only the vents directly overhead the burners used will be turned on, each providing higher linear velocities at a cost much lower than continuously running a single long commercial venting system.

More advantages of the vent extender will become apparent from a consideration of the drawings and the ensuing description.

DESCRIPTION OF DRAWINGS

FIG. 1-A—a perspective view of a vent hood over a range showing the use of a self-enclosed vent extender.

FIG. 1-B—a perspective view of a vent hood with intake air capability over a range showing the use of a self-enclosed vent extender with intake air provision.

FIG. 2-A—an exploded perspective view of the assembly of parts of a self-enclosed type of vent extender prior to installation onto the underside of a Prior Art I vent hood. The adaptor bottom is slid out on one side to rest on the side bottom hem of the range hood.

FIG. 2-B—an exploded perspective view of the assembly of parts of the vent hood adaptor of FIG. 2-A.

FIG. 2-C—a perspective view of another self-enclosed vent adaptor using support wings that slide out from both sides to rest on the side bottom hems of the range hood.

FIG. 2-D—a perspective view of the assembled vent adaptor of FIG. 2-C.

FIGS. 3-A and 3-B—are perspective views of another self-enclosed vent adaptor installed by pushing against the left and right inner sides of the hood using compression springs.

FIG. 4-A—a perspective view of another self-enclosed type of vent extender to be installed in the underside of a Prior Art I vent hood wherein the adaptor bottom is slid forward to rest on the front bottom hem of the range hood.

FIG. 4-B—an exploded perspective view of the assembly of parts of the vent adaptor of FIG. 4-A.

FIG. 4-C—a perspective view of a variation of the vent adaptor top 132 of FIG. 4-A wherein the outlet opening has a pleated surround, 132-1' to improve performance.

FIGS. 5-A and 5-B—perspective views of another type of self-enclosed vent adaptor installed by pushing against the front and rear sides of the hood using compression springs.

FIGS. 7-A and 7-B—perspective views of a self-enclosed vent adaptor for a Prior Art I vent hood wherein the adaptor top is slid forward to rest on the front bottom hem of the hood.

FIGS. 8-A and 8-B—perspective views of a self-enclosed vent adaptor for a Prior Art II vent hood wherein the adaptor top is slid forward to rest on the front bottom hem of the hood, and uses the same adaptor bottom as that shown in FIGS. 7-A and 7-B.

FIGS. 9-A & B, 10-A & B, and 11-A & B—exploded and assembled perspective views of some types of self-enclosed adaptors for a Prior Art II vent hood.

FIG. 12-A—a perspective view of the self-enclosed hood adaptor of FIG. 1-A.

FIG. 12-B—an exploded perspective views of the assembly of parts of the hood adaptor of FIG. 1-A.

FIG. 13-A—a perspective view of a hood-enclosed type of vent adaptor installed in the underside of a Prior I range hood using T bars placed parallel to the sides of the range hood.

FIG. 13-B—an exploded perspective view of the assembly of parts of the vent adaptor of FIG. 13-A.

FIG. 14-A—a perspective view of a hood-enclosed type of vent adaptor with a light transmitting panel installed in the underside of the vent hood shown in Prior Art I using T-bars placed parallel to the sides of the range hood.

FIG. 14-B—an exploded perspective view of the assembly of parts of the vent adaptor of FIG. 14-A.

FIG. 15-A—a perspective view of another hood-enclosed type of vent adaptor installed in the underside of a Prior Art I vent hood using T bars placed parallel to the back or front of the range hood. A spray guard is added.

FIG. 15-B—an exploded perspective view of the assembly of parts of the vent adaptor of FIG. 15-A.

FIG. 16-A—a perspective view of a hood-enclosed type of vent adaptor for Prior Arts I and II type of hoods using T bars placed parallel to the sides of the range hood wherein at least a section underneath the filter is sunken for air-flow space.

FIG. 16-B—an exploded perspective view of the assembly of parts of the vent extender of FIG. 16-A.

FIG. 17-A—a perspective view of the assembly of parts of another hood-enclosed type of vent adaptor that can be installed onto the underside of a Prior Art I hood using C cleats.

FIG. 17-B—a perspective view of the assembly of parts of another hood-enclosed type of vent adaptor installed in the underside of either a Prior Art I or Prior Art II hood using C cleats.

FIG. 18-A—a perspective view of a hood-enclosed type of vent adaptor having a window slidable towards a direction meant to expose the existing filter in case the use of the extender is not desired. This is applicable to a Prior Art I type of vent. The use of spacers and cleats are avoided because the window opening enables the unit to fit and slide into the underside before finally resting on the hemmed bottom.

FIG. 18-B—a perspective view of the vent adaptor of FIG. 18-A showing an optional ability to be tilted to better expose the filter for Prior Art I.

FIG. 18-C—an exploded perspective view of the assembly of parts of the vent adaptor of FIG. 18-A.

FIG. 19-A—a perspective view of a hood-enclosed type of vent adaptor divided into two sections in order to easily fit into the underside of existing Prior Art I vent hoods and hang over the hemmed bottoms without the use of cleats or T bars.

FIG. 19-B—a perspective exploded view of the assembly of parts of the vent adaptor of FIG. 19-A.

FIG. 20-A—a perspective view of a hood-enclosed hood adaptor for a Prior Art I and Prior Art II hoods installed using S cleats, a T-bar, and a front panel.

FIG. 20-B—an exploded perspective view of the assembly of parts of the hood adaptor of FIG. 20-A.

FIG. 21-A—a perspective top view of a Prior Art III vent hood with a deep underside and light source over an island or peninsula range showing the use of a self-enclosed vent extender.

FIG. 21-B—an exploded view of the detachable parts of the vent adaptor used in FIG. 21-A. Like in all self-enclosed extenders, the top parts easily slide out for easy cleaning.

FIG. 22-A—a perspective view of a vent hood extender installed in a Prior Art IV vent hood using two ducts and one canopy having two top openings.

FIG. 22-B—an exploded perspective view of the assembly of parts of the hood adaptor used in FIG. 22-A.

FIG. 23-A—a perspective view of a possible hood adaptor for a Prior Art V venting system.

FIG. 23-B—an exploded perspective view of the assembly of parts of the hood adaptor of FIG. 23-A.

FIG. 24-A—a perspective view of a possible vent adaptor for a Prior Art VI venting system.

FIG. 24-B—an exploded perspective view of the assembly of parts of the hood adaptor of FIG. 24-A.

FIG. 25-A—an exploded view of the assembly of parts of a type of ducting system of the vent extender using a flexible duct attached to an inner threaded coupler by a simple screwing motion at each end. Also shown is a secondary filter.

FIG. 25-A'—an exploded view of two shorter units of the ducting system of FIG. 25-A that can be joined together end to end to form a longer duct.

FIG. 25-B—a cross-sectional front view along the longitudinal midsection of one end of the ducting of FIG. 25-A.

FIG. 27-A—an exploded perspective view of the assembly of parts of a type of ducting system of the vent extender using a duct with ends attached to a swivel insert attached to a coupler.

FIG. 27-A'—a perspective view of the assembled ducting section of FIG. 27-A.

FIG. 27-B—a cross-sectional front view of one end of the assembled ducting section of FIG. 27-A'.

FIG. 28-A—an exploded perspective view of the assembly of parts of a type of ducting system using a two-part swiveling connector.

FIG. 28-B—a cross-sectional view of the swiveling end of the assembled ducting system of FIG. 28-A.

FIG. 29-A—an exploded perspective view of the assembly of parts of a type of ducting system using a length of duct attached to a 3-part swiveling connector attached to a coupler.

FIG. 29-A'—a perspective view of one end of the assembled ducting section of FIG. 29-A. This is almost the same for that of FIG. 28-A.

FIG. 29-B—a cross-sectional front view of one end of the assembled swiveling ducting system of FIG. 29-A.

FIG. 30-A—a perspective view of a vent extender installed on a Prior Art III vent using a type of ducting system wherein an outer tube moves up or down over an inner tube to shorten or lengthen the duct respectively.

FIG. 30-B—an exploded perspective view of the assembly of parts of the ducting system of FIG. 30-A.

FIG. 30-B'— an exploded perspective view of a type of ducting system wherein an inner tube moves up or down inside an outer tube to shorten or lengthen the duct respectively. The outer tube is rendered transparent to show the supporting flanges inside.

FIG. 31-A—a back cross-sectional view of the assembled ducting system of FIG. 30-B taken along its longitudinal midsection when the duct is at its maximum length and right after assembly.

FIG. 31-B—a back cross-sectional view of the assembled ducting system of FIG. 30-B taken along its longitudinal midsection when the duct is at a length intermediate the possible highest and lowest.

FIG. 31-C—a back cross-sectional view of the assembled ducting system of FIG. 30-B taken along its longitudinal midsection when the duct is at its minimum length.

FIG. 32-A—a top cross-sectional view of the ducting system of FIG. 31-A taken along a plane PP which is right on top of the outer tube immediately after assembly.

FIG. 32-B1—a top cross-sectional view of the ducting system of FIG. 31-B taken along a plane SS.

FIG. 32-B2—a top cross-sectional view of the ducting system of FIG. 31-C taken along a plane MM.

FIG. 32-C—a top cross-sectional view of the ducting system of FIGS. 31-A, 31-B, and 31-C cut along a plane parallel to and above planes PP, MM, and SS respectively when the outer tube is being lifted towards an alternate position.

FIG. 33-A—a perspective view of a type of ducting system wherein a duct length is made up of a series of tapered tubes arranged from smallest to largest and is collapsible.

FIG. 33-B—a perspective view of a type of ducting system wherein a duct length is made up of a series of tapered tubes arranged from largest to smallest and is collapsible.

FIG. 33-C—a perspective view of the collapsed ducting system of FIGS. 33-A and 33-B removed from the inlet for storage in a container.

FIG. 34-A—an exploded front view of the assembly of parts of a type of ducting system comprising of nesting tubes lengthened and shortened by moving along mating threads.

FIG. 34-B—a front view of the assembly of parts of the ducting system of FIG. 34-A at its longest configuration.

FIG. 34-C—a front view of the assembly of parts of the ducting system of FIG. 34-A at its shortest configuration.

FIG. 37-A—a Prior Art I vent hood with provision for intake air through a narrow rectangular opening at its right side.

FIG. 37-B—a front cross-sectional view of a self-enclosed version of vent extender with intake air option for the vent hood of FIG. 37-A.

FIG. 37-C—an elevational perspective view of the vent extender of FIG. 37-B installed on a Prior Art I vent hood with intake air using a C cleat and magnets.

FIG. 37-D—a perspective view of the hood adaptor of FIG. 37-B.

FIG. 38-A—a Prior Art II vent hood with provision for intake air through a circular opening at its right side.

FIG. 38-B—a front cross-sectional view of a self-enclosed version of vent extender with intake air option for the vent hood of FIG. 38-A.

FIG. 38-C—a perspective view of the vent adaptor of FIG. 38-B.

FIG. 39-A—an elevational perspective view of either a Prior Art I or Prior Art II vent hood with provision for intake air through an intake air director at its right side.

FIG. 39-B—a perspective view of a self-enclosed version of hood adaptor with intake air option for the Prior Art II vent hood of FIG. 39-A showing the use of magnets to install it.

FIG. 39-C—a perspective view a hood-enclosed version of hood adaptor with intake air option for the Prior Art I vent hood of FIG. 39-A showing the use of C cleats to install it.

FIG. 40-A—a perspective view of an improved Prior Art I type hood by the addition of an intake air provision and extra hemmed side and rear bottoms to readily accept a self-enclosed dual vent adaptor.

FIG. 40-B—a perspective view of an assembled self-enclosed dual vent adaptor of FIG. 40-A.

FIG. 41-A—a cross sectional view cut along the plane CC of a vent extender using a double-walled canopy.

FIG. 41-B—an exploded perspective view of the assembly of parts of the vent adaptor of FIG. 41-A.

FIG. 41-C—an elevational perspective view of the vent extender using a double-walled canopy installed in a Prior Art II hood with option for intake air.

DESCRIPTION OF THE INVENTION

Figure 6:
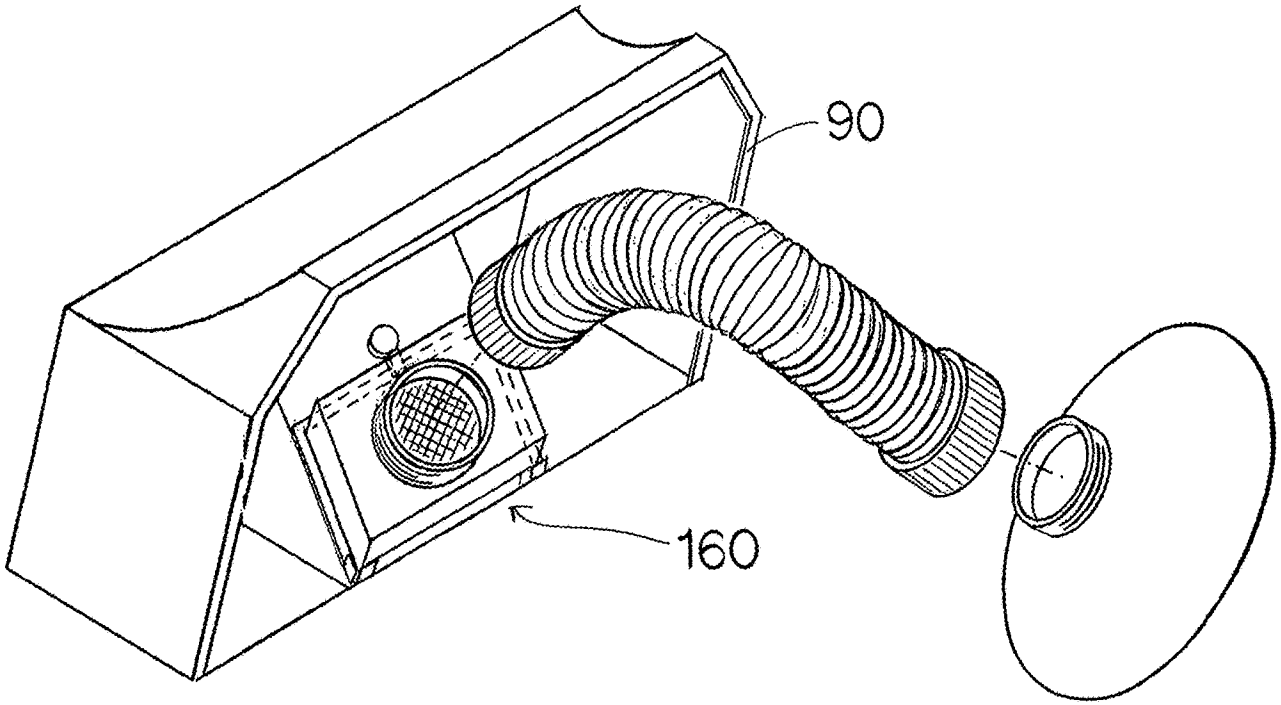
FIG. 6—an exploded perspective view of a vent extender that is adapted directly onto the holding means for the existing filter for use with Prior Art I-VI vents.

FIG. 1-A shows the parts and utility of the basic vent extender method for any over-the-range type hood. The invention comprises the use of a vent hood adaptor 100 (shown in solid lines inside a representative range hood 90 shown in broken lines) and a ducting system 500. The vent hood adaptor 100 comprises an exhaust enclosure to confine the exhaust power of the fan. The exhaust enclosure comprises of airflow cavity 106, an inlet opening 102, and an outlet opening 104. The outlet opening 104 encloses the mouth of duct 94 that houses the fan or blower (not shown). The outlet opening 104 may also enclose a primary filter 92. The exhaust power is therefore derived from outlet opening 104 and is released through one or more inlet openings 102.

The ducting system 500 comprises a length of tube 202 having a final upstream end 204 and a final downstream end 206. The top opening 700-1 of a canopy 700 is connected to the final upstream end 204 of the ducting system and the final downstream end 206 is connected to the inlet opening 102 of the vent hood adaptor 100.

The canopy 700 is positioned above a cooking vessel 82 that is being heated on top of one of the range burners 80. The fumes and odors emanating from the cooking vessel are captured first inside the canopy 700, then sucked up through the ducting system 500, through the hood adaptor inlet opening 102, through the enclosure cavity 106, and finally out through the outlet opening 104 where they proceed on their usual way.

FIG. 1-B shows the vent extender method with intake air capability 3000, the intake air coming from a source 900 within the underside of the range hood and directed through a second ducting system enveloping the basic ducting system for delivering intake air closer to the fume and odor source.

Figures showing the use of a double-walled canopy with the vent extender method with intake air are presented in FIGS. 41-A to 41-C.

The vent extender method of the present invention can be applied even to ventilation systems that do not use an over-the-range type hood for a more efficient and energy saving method of harnessing exhaust power and intake air.

For purposes of illustration, the hood adaptor for use with the method of the present invention can be classified into two main types namely: a) a self-enclosed hood adaptor (SE), and b) a hood-enclosed hood (HE) adaptor.

The self-enclosed type is one that does not necessarily depend on the exact dimensions of the perimeter of the range hood in order to encapsulate the exhaust power of the fan or blower. Its own top and bottom parts comprise the enclosure. The dimensions that it needs are those of the primary filter or mouth of the duct housing the exhaust fan as well as parts of the range hood it has to attach to or hang from. In some cases the bottom part could completely enclose the bottom of the hood. In this case, the top also serves as an underside liner that can be easily cleaned in the kitchen sink.

The hood-enclosed type depends on the exact dimensions of the perimeter of the range hood because it utilizes the existing hood underside as the top part of its enclosure. A self-enclosed type can become the hood-enclosed type simply by the removal of a top part provided the bottom part completely covers the underside of the range hood. The underlying idea is unchanged.

The inventor has chosen to put the idea into practice using the most common types of range hoods available to the average homeowner. These types are shown in FIGS. 42-47 (Prior Arts I through VI) and may have vertical, horizontal or downward exhaust systems. They will be hereon referred to as simply Prior Art I, II, III, IV, V, or VI type hoods. Commercial over-the-range hoods can be classified under one of these types. Over-the-range hood designed to communicate with a downdraft exhaust systems like that shown in U.S. Pat. No. 6,647,978

"Over-the-range" hoods can be designed to communicate with exhaust systems that are flush with or in close proximity to the top of a cooking range and usually the downdraft type. Such hoods are included as part of over-the-range type hoods.

Self-Enclosed Hood Adaptor for the Vent Extender

FIG. 2-A shows an example of a self-enclosed type of vent extender with a hood adaptor 110 to be installed on a Prior Art I range hood 90. The adaptor bottom is pulled out slightly for the unit to rest on the bottom hem 90-2 of the range hood. The canopy 701 is shown with a side opening for accessing the vapor source without the need to tilt or lift the canopy.

FIG. 2-B shows the assembly of the parts of the hood adaptor 110 in FIG. 2-A. The self-enclosed (SE) hood adaptor top 110-1 is a convex member having a missing bottom and having an outlet opening 110-15 sized to accommodate the primary filter 92. The slope of the side with the outlet opening approximates the slope of the filter housing in a Prior Art I range hood. It also has folded edges 110-11, 110-12, and 110-13. An optional filter base 110-14 can also be provided for the open "side" of the outlet opening 110-15 in order to help support the filter if it is desired to attach the filter directly to the adaptor before the hood adaptor is installed. The SE hood adaptor bottom 110-2 is a panel 110-21 having inlet openings 110-22. It is sized to slide into the folded edges 110-11, 110-12, and 110-13 of SE hood adaptor top 110-1 thus providing a bottom for the top. The folded edge 110-12 is made wide enough so that the enclosure stays "sealed" even when the hood adaptor bottom 110-2 is pulled out slightly for resting on the side bottom hem 90-2 of range hood 90. Magnets may be used to anchor the entire assembly onto the range hood.

FIGS. 2-C and 2-D show another self-enclosed hood adaptor 120 transferable for use with Prior Art I range hoods having the same filter size but different hood widths. It works basically the same way as the hood adaptor of FIG. 2-A except for the addition of adaptor wings 120-3 that slide out of both ends to maintain the central location of the outlet opening relative to the range hood. The hood adaptor bottom 120-2 has folded edges and inlet openings. Hood adaptor top 120-1 slides into the folded edges of hood adaptor bottom 120-2. Adaptor wings 120-3 placed between top 120-1 and bottom 120-2 are pulled out slightly during installation to allow the entire unit to rest on the bottom hem of the range hood. The wing openings 120-31 stay clear of the inlet openings within the extension range of the adaptor wings. Magnets may be used to anchor the entire assembly onto the range hood.

FIGS. 3-A and 3-B show another self-enclosed hood adaptor 130 for use with Prior Art I range hoods. The hood adaptor bottom 130-2 includes compression springs compressed by tubes. Tubes 130-22L and 130-22R and compression spring 130-21 are nested inside an outer tube 130-26 at the rear edge of adaptor bottom 130-2. Spring 130-21 is anchored by a screw 130-25 onto outer tube 130-26. The outer tubes 130-27 on the front edge of adaptor bottom 130-2 encloses two separated compression springs 130-24 and two inner tubes 130-23L and 130-23R. Adaptor top 130-1 simply slides onto adaptor bottom 130-2. The exposed ends of tubes 130-22L, 130-22R, 130-23L and 130-23R push against the inner sides of the hood to anchor the adaptor.

FIGS. 4-A and 4-B show still another self-enclosed hood adaptor 140 for use with Prior Art I range hood 90. Hood adaptor top 140-1 is just an upright version of hood adaptor top 110 of FIG. 2-B. Hood adaptor bottom 140-2 slides into folded edges 140-11, 140-12, and 140-13 and is pulled out for resting on the front bottom hem 90-1 of range hood 90. The rear edge 140-13 is made to rest on filter supports 90-3. Also in FIG. 4-A is the basic ducting system 500 with canopy 700. A cover 50 for the inlet opening and magnet 95 for anchoring are also shown.

FIG. 4-C show a hood adaptor top 140-1' having a pleated expandable outlet opening 140-11' for better sealing of the exhaust opening in an existing range hood.

FIGS. 5-A and 5-B show another self-enclosed type of hood adaptor 150 using compression springs 150-22 anchored by a crimped portion 150-212 inside inner tubes 150-21. The inner tubes 150-21 and springs 150-22 nest inside tubular edges 150-23 of adaptor bottom 150-2. Adaptor top 150-1 simply slides onto adaptor top 150-2.

FIG. 6 shows still another hood adaptor 160 that utilizes the same attachment means as the primary filter 92. The outlet opening in the other SE hood adaptor tops can be viewed as an entire SE hood adaptor top while the hood adaptor 160 as the adaptor bottom. In this regard, this type of hood adaptor can be considered as both self-enclosed (SE) and hood enclosed (HE) and may be used for all prior art types. The figure shows only one inlet opening but more could be accommodated by allowing several branches to emanate from that single inlet or by increasing the depth of the hood adaptor inorder to fit more inlets on the exposed sides.

SE 170 of FIGS. 7-A and 7-B and SE 180 of FIGS. 8-A and 8-B are adapted to a Prior Art I type of range hood 90 and a Prior Art II 93 respectively. An air-flow space is created below the filter and consequently the hood adaptor bottoms 170-2 for both may go below the bottom of the range hood. A flange 170-23 of adaptor bottom 170-2 is made to rest on filter supports 90-3. In FIG. 7-B the adaptor top 170-1 is shaped to enclose the slanted exhaust opening of a Prior Art I hood. In FIG. 8-B the adaptor top 180-1 is simply a flat panel. Tops 170-1 and 180-1 are made to slide between folded edges 170-22 and 170-21 and pulled out slightly to rest on the front bottom hems 90-1 and 93-1 of their respective range hoods and anchored with magnets 175. These types of hood adaptors are appropriate for use with range hoods having a lighting fixture disposed at the side of the primary exhaust filter.

More possible embodiments of self-enclosed hood adaptors 190 and 200 anchored using inner tubes and compression springs for a Prior Art II hood are shown in FIGS. 9-A, 9-B, 10-A and 10-B. Adaptor top 190-1 simply slides onto adaptor bottom 190-2, the entire assembly anchored to the left and right inner sides of the hood; Adaptor top 200-1 slides onto adaptor bottom 200-2, the entire assembly anchored to the rear and front inner sides of the hood.

FIGS. 11-A and 11-B show a self-enclosed hood adaptor 210. Its adaptor bottom 210-2 works just like adaptor bottom 170-1 of FIG. 7-B except for size and orientation. Its adaptor tops 210-1L and 210-1R slightly slide out from both ends to rest on the side bottom hem of a Prior Art II range hood, thus maintaining the central location of the outlet opening. Made with a width as narrow as the hood's primary filter, this type of adaptor can be suitable for a range hood with an existing light fixture disposed at the front of the filter. The symmetrical design of the adaptor tops also make this adaptor suitable for filters of different dimensions.

FIGS. 12-A and 12-B show the hood adaptor 100 of FIG. 1-A. This type of adaptor is suitable for used with either a Prior Art I or Prior Art II hood. The adaptor top may comprise of one or two parts. If it is used for a Prior Art II hood, only top base 100-11 need be used to top adaptor bottom 100-2. If it is used for a Prior Art I hood, top riser 100-12 need to be added to top base 100-11. A front C-cleat type of extension 100-122 of top riser 100-12 is made to slide into an outwardly folded edge 100-112 of top base 100-11. A rear section of its side flanges 100-123 are tucked under inwardly folded edges 100-21 of adaptor bottom 100-2. To install, folded edge 100-22 of base 100-2 is first made to rest on the right side bottom hem 90-2 of the range hood and the left end of top base 100-11 is slightly pulled out and equipped with magnet 176 to rest on the left side bottom hem 90-2.

Hood-Enclosed Hood Adaptor for the Vent Extender

FIGS. 13-A and 13-B show an HE hood adaptor 220 for a Prior Art I hood comprising of three bottom panels and two T-bars to facilitate the enclosing of the entire underside of the range hood even if the panels used are rigid. Assembly is as follows:

a) Panel 220-3 is placed in the right underside of the range hood, temporarily supported on the right side by bottom hem 90-2, b) Panel 220-1 is placed in the left underside of the range hood, temporarily supported on the left side by bottom hem 90-2, c) Panel 220-2 is placed in the middle underside of the range hood, its front edge temporarily supported by front bottom hem 90-1, d) A T-bar 220-4 is placed in between panels 220-1 and 220-2; its front end supported by the front hemmed bottom 90-1; its back end supported by a filter support 90-3, e) With hand access through its inlet openings, panel 220-1 is urged down onto the T-bar 220-4 of (d), f) Another T-bar 220-4 is placed in between panels 220-2 and 220-3 its front end supported by the front hemmed bottom 90-1; its back end supported by filter support 90-3, and g) With hand access through inlet openings, panels 220-2 and 220-3 are urged down onto T-bar 220-4 of (f).

FIGS. 14-A and 14-B show an HE hood adaptor 220' wherein the middle panel comprises of two parts, 220'-1 and 220'-2. Panel 220'-1 can be a light transmitting panel. The assembly is basically the same as the previous adaptor 220. There is the addition of a third T bar 220'-3 placed between parts 220'-1 and 220'-2. Another advantage derived by dividing the middle panel into two parts is that the panel just above the filter may be popped up and out if the use of the ducting system is not desired or when only the filter needs cleaning or replacement.

The entire underside may be enclosed using any number of panels and T-bars for more flexibility in the placement of inlet openings and light-transmitting panels. One example is the hood adaptor 230 shown in FIGS. 15-A and 15-B. Two horizontally placed panels 230-1 and 230-2 and two T-bars 230-4 and 230-5 are used. The slanted T-bar 230-5 is provided to better support the long side of panel 230-1 at the rear. Slanted T-bar 230-5 may be supported on its midsection by filter support 90-3 if necessary and on the ends by the side bottom hem 90-2. The slant on the T-bar 230-5 follows the slant of the primary filter in a Prior Art I hood. Also shown is an optional flow director 230-3 with an angled edge 230-31 that is slid through an inwardly folded edge 230-21 of panel 230-2. This flow director not only helps in reducing stagnation points in the path of the exhaust air; it also acts as a spray shield for the underside of the range hood.

FIGS. 16-A and 16-B show an HE hood adaptor 240 use in either Prior Art I or Prior Art II hoods. Hood adaptor 240 is basically the same as hood adaptor 220 of FIG. 13-A except for the middle section. Middle panel 220-2 of hood adaptor 220 is replaced by a box panel 240-1 to provide air-flow space below the primary filter. A light source opening 240-12 can be covered with a light transmitting sheet 240-2.

FIG. 17-A shows an HE hood adaptor 250 for a Prior Art I hood with edges 250-1 that are folded flat inwardly to provide more rigidity to an otherwise flexible material. In this case, five C-cleats 250-2 may be used for installation. Assembly is as follows:

a) two side C-cleats with magnets are installed onto the side hemmed bottom of the hood, b) the remaining three C-cleats are temporarily placed on top of adaptor 250, c) the edges 250-1 of (b) are slid through the C-cleats in (a) all the way to the rear, and d) the three C-cleats of (b) are accessed through inlet openings 250-3 and each of them is slipped onto their respective positions for clamping the bottom hem and flanges together.

It is possible that step (d) above can be eliminated for HE hood adaptor 250 if the side C-cleats are adequately providing support for the entire hood adaptor and ducting system. The front edges are self-sealing.

Hood adaptor 260 of FIG. 17-B is a box version of adaptor 250 of FIG. 17-A. It is suitable for both Prior Art I and II range hoods. Installation steps are the same.

FIGS. 18-A, 18-B, and 18-C show an HE hood adaptor 270 comprising of a main bottom 270-1 with an opening 270-11 for a window 270-2. The window is slid forwardly on the main bottom to expose the primary filter in the event that the use of the vent extender is not desired. The main bottom 270-1 may also be popped up at the rear to further expose the filter. A slanted T-bar 270-3 may be used to augment support for adaptor 270 and for providing support for the optional pop-up risers 270-4.

If window 270-2 is too heavy for the exhaust fan to suck up, it does not have to slide into the main bottom. It can just be positioned over the opening 270-11 ready to be popped up and out when needed.

The opening 270-11 enables the rigid main bottom 270-1 to be inserted into the underside of the hood as one piece without the use of S or C cleats.

FIGS. 19-A and 19-B show an HE hood adaptor 280 made up of two rigid panels 280-1 and 280-2. There is no need for S or C cleats as each panel can be inserted without the need to be flexed. The combined parts rest on the hemmed bottom of the hood. The folded edges of the panels provide rigidity obviating the use of T-bars.

FIGS. 20-A and 20-B show an HE hood adaptor 290 with a 3-dimensional or box bottom that can be used for Prior Art I and II range hoods. The rigid box bottom 290-2 of hood adaptor 290 has an outwardly extending front flange 290-21 that is slightly higher than the outwardly extending side flanges 290-22. The assembly is as follows:

a) S-cleats 290-5 are slipped onto the side hemmed bottom 90-2 or 93-2 of the range hood as shown, b) front panel 290-3 is temporarily placed on top of adaptor bottom 290-2, c) side flanges 290-22 of (c) are slid into the S-cleats all the way to the rear, d) front panel 290-3 is moved towards the front and made to rest on the available bottom hems, and e) T-bar 290-4 is inserted between flange 290-21 and the rear edge of panel 290-3.

The box bottom 290-2 can be easily converted into an SE type of hood adaptor by the addition of an enclosing top 290-1 that has an outlet opening 290-12.

Prior Art III and IV

FIG. 21-A shows an SE vent extender with a vent adaptor 300 installed in a Prior Art III hood 91 for island or peninsula cooking ranges. Hoods of this type usually have a deep underside space between the filter and the bottom hem such that a rigid hood adaptor can be urged inside and made to rest completely on the hemmed bottom 92-1. This type of hood also usually spans the entire top of the cooking range allowing the inlet openings to be designed to fall directly above the burners. The ducting section will need very little or no flexing.

FIG. 21-B shows the basic parts of a typical hood adaptor 300 for this type of hood. The hood adaptor bottom 300-2 is sized to completely rest on the bottom hem of hood 91. It has folded edges 300-21 through which the edges 300-11 of a hood adaptor top 300-1 can slide through and be held in place. The inlet openings can be positioned directly above each of the burners if the location of each of the burners is known. Hood adaptor top 300-1 has an outlet opening 300-12 rimmed with a flexible or pleated material 300-13 to minimize leakage and thus harness the full power of the exhaust fan. It may also have one or more openings 300-14 that connects with another opening 300-24 of adaptor bottom 300-2 through which one or more lighting fixtures 91-1 can be easily inserted and just as easily be popped up just before the hood adaptor is taken down for cleaning.

If the hemmed bottom of hood 91 is substantially on the same plane as the filter, a box hood adaptor bottom and S or C cleats may be used as shown earlier for Prior Art II hood adaptors. The discussion on Prior Art IV hood adaptors following may also be applicable.

FIGS. 22-A and 22-B show an HE vent extender with a hood adaptor 310 installed in a Prior Art IV hood 98. The primary filter and the bottom of the hood are on the same plane. C-brackets 310-2, 310-3, and 310-4 are installed in the perimeter of the hood 98 through which the outwardly directed flanges 310-12, 310-13, and 310-14 of a box bottom hood adaptor 310-1 are slid through respectively. The front C-bracket 310-6 may be installed with magnets 97 or hook and loop closure or other releasable attachment means to allow easy removal for cleaning. Also shown is an opening 310-11 through which a switch box 96 for the exhaust fan and light can be easily popped in and out.

Prior Art V and VI

FIGS. 23-A and 23-B show an HE hood adaptor 320 installed in a Prior Art V hood 70. Channels 320-2L and 320-2R are installed on the sides the hood through which the outwardly directed flanges 320-11L and 320-11R of a box bottom 320-1 are slid through. Any space between the bottom of the microwave and the top of the front flange 320-11F of bottom 320-1 may be sealed with another channel made releasable with magnets, hook and loop closure, or other similar means if necessary. If the flange and channel combination already gives a snug fit, the front flange 320-11F becomes self-sealing. Because the filter and the bottom of the hood are in the same plane, hood adaptors for a Prior Art IV hood may also be adapted to a Prior Art V hood. The idea of a provision of a clearance between the inlet opening and the filter is the same.

FIGS. 24-A and 24-B show an HE hood adaptor 330 installed in a Prior Art VI hood 75. The portion of the adaptor directly under the microwave is supported on both sides by channels 330-2L and 330-2R. The side flanges 330-11L and 330-11R of the box bottom 330-1 is slid from the front through channels 330-2L and 330-2R respectively. The exposed edges of the front and the slanted rear section may be self-sealing or may be further sealed using removable channels 330-3L and 330-3R having "key hole"-like holes for screws or using magnets, hook and loop closure or other similar means.

Ducting System for the Vent Extender

The ducting system of the vent extender guides the fumes and odors from the source towards the exhaust system at the underside of the hood. It is basically a length of tube with an upstream end and a downstream end. The downstream end connects to an inlet opening of the hood adaptor. The upstream end has the ability to be positioned as close as possible to the fume and odor source. This length of tube may be made up of a combination of one of more duct units that may be rigid, flexible, or extendible. These duct units are connected to one another with couplers that can accommodate filters as well as other convenience options like swiveling abilities, flanges for holding on to when setting up and dismantling, expanding and reducing to accommodate duct of different sized openings, and the like.

FIGS. 25-A and 25-B show a basic ducting system 500 using a length of tube 501, a first coupler 502 on the downstream end of the tube, and a second coupler 502 on the upstream end of the tube. Coupler 502 has threaded inner walls sized to fit the ends of tube 501. The tube can be rigid or flexible. A rigid tube would have outer threads on the end connects to a coupler 502. A flexible duct has "threads" built-in along its entire length. A first end of the first coupler 502 is fitted onto a first end of tube 501 about halfway through. A second end of the first coupler 502 has the ability to be fitted onto an inlet opening in a hood adaptor. A first end of the second coupler 502 is fitted into a second end of tube 501 about halfway through. A second end of the second coupler 502 has the ability to be fitted onto a canopy. The total length of one tube 501 and the couplers at each end comprise the entire basic ducting system. A filter 503 can be easily inserted inside any coupler 502 prior to connection to an inlet opening or to a canopy.

Figure 26:
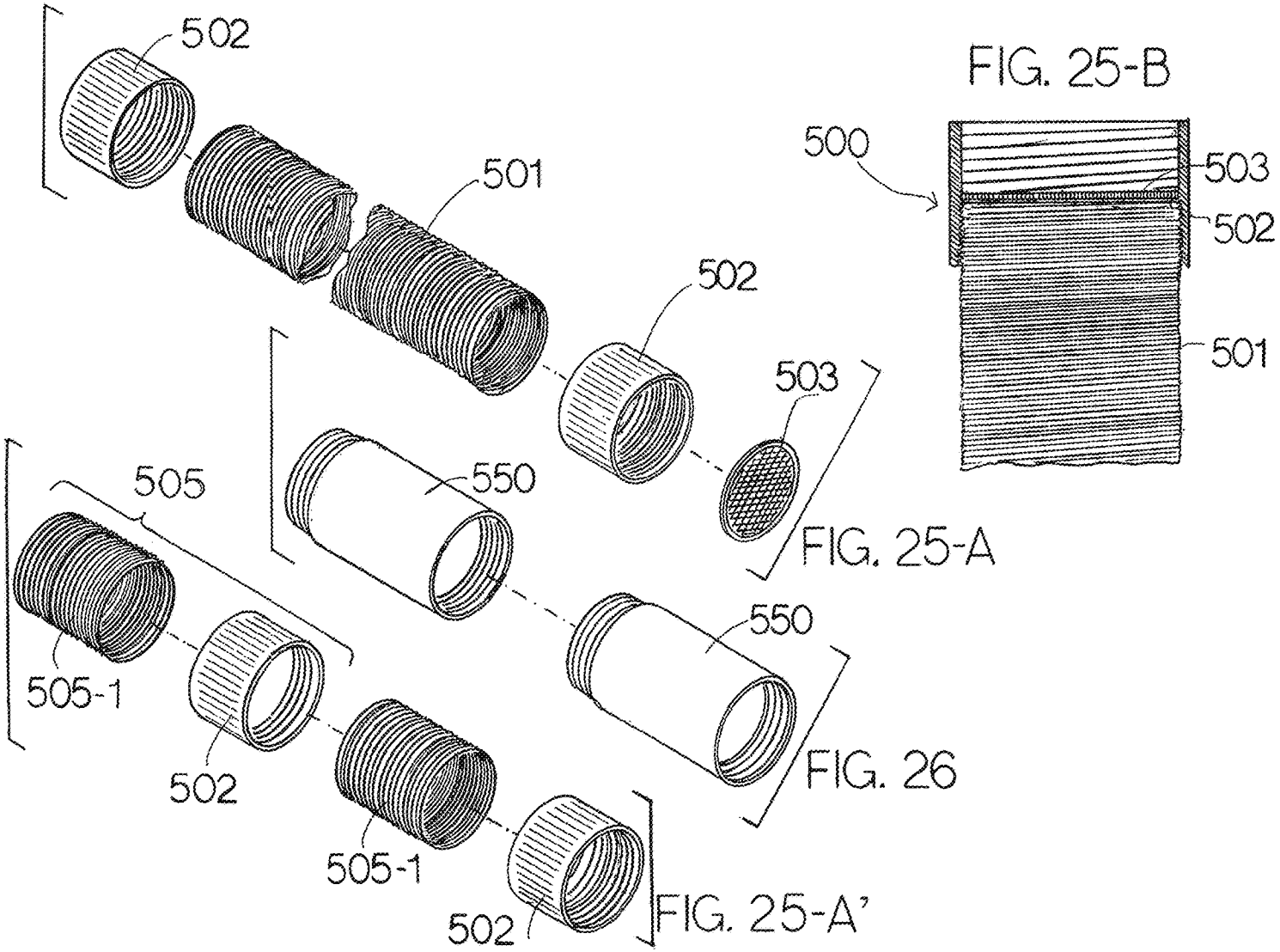
FIG. 26—an exploded view of two shorter units of a ducting system using a rigid duct that can be joined end to end to form a longer duct.

A length of duct can be sub-divided into several duct units that can be connected together to reach any desired length. Because the distances between the range hoods and the range burners are not fixed, some hoods need a longer ducting system than others. FIGS. 25-A' and 26 show a flexible and a rigid type of basic duct units respectively. As shown in FIG. 25-A', a flexible type of duct unit 505 comprises a unit length of flexible tube 505-1 and a coupler 502 for connecting to another unit. A commercially available flexible aluminum duct is a tube that already has inner and outer "threads" on both ends and can connect to other threaded tubes or couplers. However, if a constant flow area and ability to connect with other duct units having the same inner dimensions are desired, a coupler 502 is added. FIG. 26 shows a one-piece rigid type of duct unit 550.

The ability to swivel the ducting system is also addressed in the present invention. A swiveling connection with the inlet opening can be advantageous when attaching or detaching the ducting system from the inlet. Only the coupler and swivel insert need to be rotated. The duct and canopy can be stationary. For a ducting system having an already flexed duct, an already tilted canopy or a canopy whose top opening is not centered, the ability to stay put is very convenient. Also, a tilted canopy or a canopy whose top opening is not centered can be quickly "spun" out of the way for easy removal of the cooking vessel. Another advantage of the use of the swiveling couplers is the ability to connect more than one duct to a canopy with more than one top opening.

On the other hand, a ducting system that does not swivel about its downstream end can be advantageous for vent hoods that are positioned considerably above the comfortable reach of the user. The user is able to detach and attach the ducting system from the inlet opening by simply handling the duct below.

FIGS. 27-A, 27-A', and 27-B show a type of ducting system 510 that is capable of swiveling on the upstream and downstream ends. It comprises a flexible duct 512 with crimped ends 512-1 and notched rim 512-11, swivel inserts 514, and couplers 502. The swivel insert 514 has an outside threaded wall with rim 514-2 and may have an outwardly flanged end 514-1 for holding onto during attaching and detaching for cleaning or part replacement. Assembly is as follows:

a) the crimped end 512-1 of duct 512 is inserted into a swivel insert 514 until its notched rim 512-11 goes beyond the rim 514-2 of swivel insert 514,
b) the notched rim 512-11 is flattened onto rim 514-2 without going beyond the outer edge,
c) while holding on to flange 514-1 of swivel insert 514, a first coupler 502 is threaded onto the outside of swivel insert 514,
d) steps (a) to (c) are repeated for the other end of duct 512,
e) (optional) a filter 503 is inserted into the free end of any coupler 502 clear of the flattened notched rim,
f) the free end of the first coupler 502 is connected to an inlet opening in the hood adaptor,
g) the free end of the second coupler 502 in (d) is connected to a canopy.

If only one swiveling end is desired, only one end of duct 512 is crimped, the second swivel insert and step (d) are eliminated. The non-crimped end of duct 512 is threaded into a second coupler 502. Also, to make sure that filter 503 does not touch the flattened notched rim, the midsection of coupler5 502 can have a shallow ubber fkabge 502-1 as a stopper and filter support.

FIGS. 28-A and 28-B show a ducting system 520 using another type of swiveling means. It comprises a length of tube 501, a coupler 502, and a 2-part swiveling coupler of parts 521 and 522. Coupler part 522 connects to a duct or tube while coupler part 521 connects to an inlet opening. Part 521 has a slightly resilient tapered end 521-1 while part 522 has a slightly resilient catcher end 522-1. Tapered end 521-1 is forced and squeezed into catcher end 522-1 where it is permanently received.

FIGS. 29-A, 29-A', and 29-B show a ducting system 530 using another type of swiveling means. It comprises a length of tube 501, two couplers 502 (second coupler 502 not shown), and a 3-part swiveling coupler of parts 531, 532, and 533. Part 531 is a cylindrical structure with inner threads and an inner bottom flange 531-1. Part 532 is a cylindrical structure with outer threads and an outer top flange 532-1. Part 532 is receivable inside part 531, the top flange 532-1 resting on bottom flange 531-1. Part 533 is another cylindrical member threaded inside and outside and is used to expand the outer diameter of part 532 as shown. Expanding the outer diameter of part 532 enables a coupler 502 to be attachable to the 3-part swiveling coupler or directly to an inlet opening if the swiveling option is not desired. A tiny elongated hole 533-1 in part 533 is for insertion of a rod to allow removal and attachment of part 533 onto part 522.

FIG. 30-A shows the underside of a Prior Art III range hood with a vent extender comprising an HE hood adaptor with two ducting systems in use. One inlet uses an extendible rigid duct unit 540 while the other inlet uses a combination of an extendible rigid duct unit 540 and flexible duct unit 505. A tube all made up of rigid units is workable if the inlet opening is directly above the burner. Otherwise, a flexible or a rigid and flexible combination is more desirable.

FIG. 30-B shows an extendible rigid duct unit 540 comprising a pair of tubes 541 and 542 where tube 542 is receivable inside tube 541. Tube 542 has at least one row of intermittently and vertically aligned supporting flanges 542-1 positioned at different cross-sections along its outer perimeter defining the different possible extendible lengths of the ducting system. Tube 542 also has a column stopper 542-3 at the end of a set of vertically aligned flanges. The lower perimeter of tube 542 has a continuous outwardly extending bottom flange 542-2. Its upper end 542-4 has the ability to be connected to another duct unit or to an inlet opening. The top inner perimeter of tube 541 has a row of intermittent hanging flanges 541-1 that is aligned vertically with supporting flanges 542-1 of tube 542. The lower end 541-2 of tube 541 has the ability to be connected to another duct unit or to a canopy 544. Assembly is as follows:

a) flanges 541-1 of tube 541 and the spaces between the intermitted flanges 542-1 of tube 542 are aligned,
b) tube 541 is dropped over tube 542 until flanges 541-1 touches the continuous bottom flange 542-2,
c) bottom end 541-2 of tube 541 is connected to a canopy or another duct unit, and
d) top end 542-4 of tube 542 is connected to an inlet opening or another duct unit.

FIG. 30-B' shows a rigid duct unit 540' which is a modification of the duct unit 540. This time the inner tube 541' has the intermittent hanging flanges 541'-1 on its top outside perimeter and goes up or down an outer tube 542' that has the rows of intermittent supporting flanges 542'-1, continuous inwardly extending bottom flange 542'-2 and column stopper 542'-3 along its inner walls. The figure depicts a transparent outer tube 542' in order to show the parts inside. Assembly and operation is basically the same as that of duct unit 540.

FIG. 31-A shows a cross-sectional back view of the duct unit 540 of FIG. 30-A taken along its longitudinal midsection after assembly. Hanging flanges 541-1 of tube 541 are supported by continuous bottom flange 542-2 of tube 542. At this point, the duct unit 540 is at its longest configuration, position A.

At position A, the corresponding cross-sectional top view taken along a plane PP (which is right above the flanges of tube 541) is shown in FIG. 32-A. Cross-sectional top views in FIGS. 32-A, 32-B1, and 32-B2 are based on hanging flanges 541-1 being transparent so that supporting flanges 542-1 and 542-2 underneath can be viewed as well. At position A, movement of tube 541 is confined to a 60° counter-clockwise turn and upward. One of the flanges 541-1 is deterred on the right side by column stopper 542-3 from turning clockwise. The continuous flange 542-2 deters downward movement. A counter-clockwise turn beyond 60° is also deterred because another flange 541-1', made shorter (by a length equal to the width of the column stopper) than the other two in the row, is blocked by column stopper 542-3 on the left.

To move from position A to a higher level or a shorter configuration, position B, tube 541 is lifted up using column stopper 542-3 as a stopper and alignment guide so that the flanges of tubes 541 and 542 do not intersect. FIG. 32-C shows the cross-sectional top view along plane PP during the transition. When the hanging flanges 541-1, of tube 541 has passed the desired row of supporting flanges 542-1 of tube 542, tube 541 is turned counter-clockwise until resistance is met. That is when flange 541-1' meets the column stopper on the left. Tube 541 is then released to rest on the nearest level of flanges of tube 542 below. FIG. 31-B shows a longitudinal sectional back view of position B. FIG. 32-B1 shows the corresponding cross-sectional top view taken along plane SS at position B.

To move from position B to a next higher level or shortest configuration, position C, the same procedure above is followed. FIG. 31-C shows a longitudinal sectional back view of position C and FIG. 32-B2 shows the corresponding cross-sectional top view taken along plane MM. FIGS. 32-B1 and 32-B2 look the same but the supporting flanges 542-1 underneath the hanging flanges belong to different levels.

To move from position B or position C to a lower level or a longer configuration, tube 541 is turned clock-wise until resistance is met. That is when flange 541-1 is met by column stopper 542-3 on the right. Tube 541 is then lowered using stopper column 542-3 again as an alignment guide. Before the hanging flanges 541-1 pass the desired row of flanges 542 of tube 542, tube 541 is turned counter-clockwise until resistance is met. Tube 541 is then released to rest on the lower level flanges of tube 542.

FIGS. 33-A and 33-B show duct units 560 and 560' comprising of nesting tapered tubes arranged downwardly from smallest to largest and from largest to smallest respectively. The inlet opening of the adaptor and top opening of the canopy are sized accordingly. The tubes are collapsible for storage in a container as shown in FIG. 33-C. The telescoping tubes may also be collapsed but left hanging at the inlet opening if the container in FIG. 33-C is provided with attachment means like threads to a threaded receiver on an area surrounding the inlet opening.

FIGS. 34-A, 34-B, and 34-C show an extendible ducting system 570 comprising a pair of tubes 571 and 572; tube 572 receivable inside tube 571. Tube 572 has a threaded outer wall 572-1 capable of mating with a threaded inner wall 571-1 in the upper section of tube 571. The upper end 572-2 of tube 572 has the ability to be connected to another duct unit, to a coupler, or directly to an inlet opening. The lower section 571-2 of tube 571 is not threaded and has an inner diameter that is capable of snugly receiving tube 572. The lower end 571-3 of tube 571 has the ability to be connected to another duct unit, to a coupler or directly to a canopy 573. Assembly is as follows:

a) the upper end 572-2 of tube 572 is inserted through the unthreaded lower section 571-2 of tube 571 until it hits the lowest part of the threaded inner wall 571-1 in the upper section of tube 571,
b) tube 571 is turned clockwise to mate the threads until the upper end 572-2 of tube 572 clears at least the upper rim 571-4 of tube 571,
c) the upper end 572-2 of tube 572 is connected to another duct unit, coupler, or inlet opening, and
d) the lower end 571-3 of tube 571 is connected to another duct unit, coupler or canopy.

The ducting system 570 is lengthened or shortened by simply turning tube 571 clockwise or counter-clockwise respectively. The lower end 572-3 of tube 572 functions as a stopper to prevent tube 571 from completely leaving tube 572.

Figure 35:
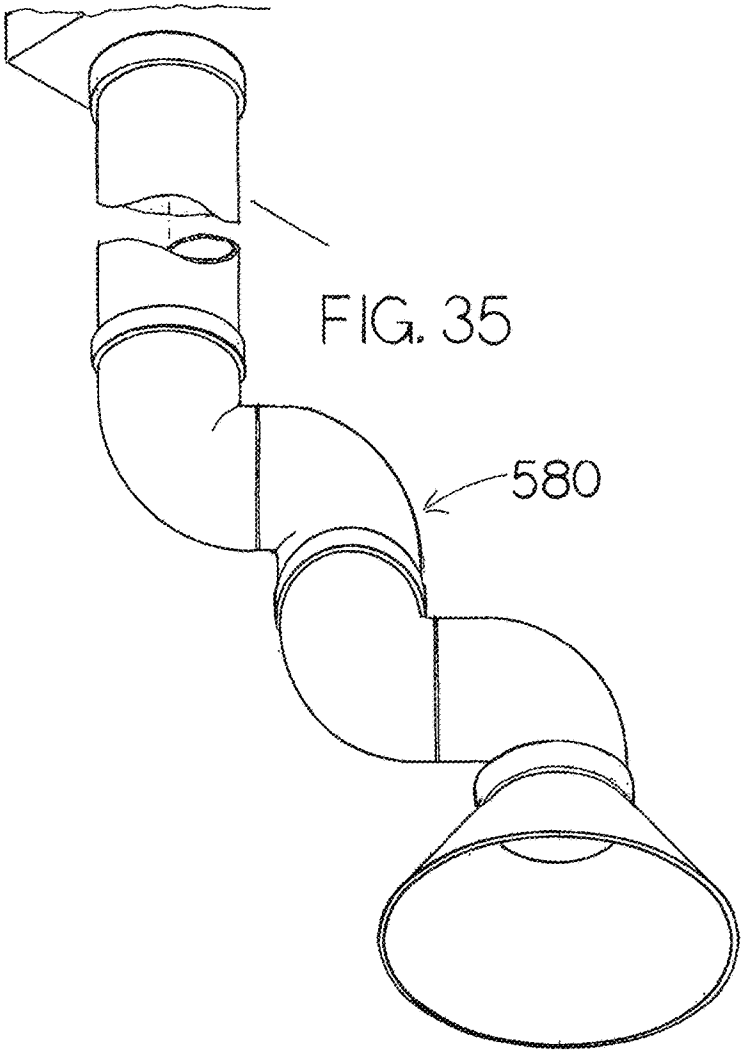
FIG. 35—a perspective view of a type of ducting system comprising of several rigid elbow tubes that swivel at their connecting ends to provide some flexibility in positioning the canopy.
Figure 42:
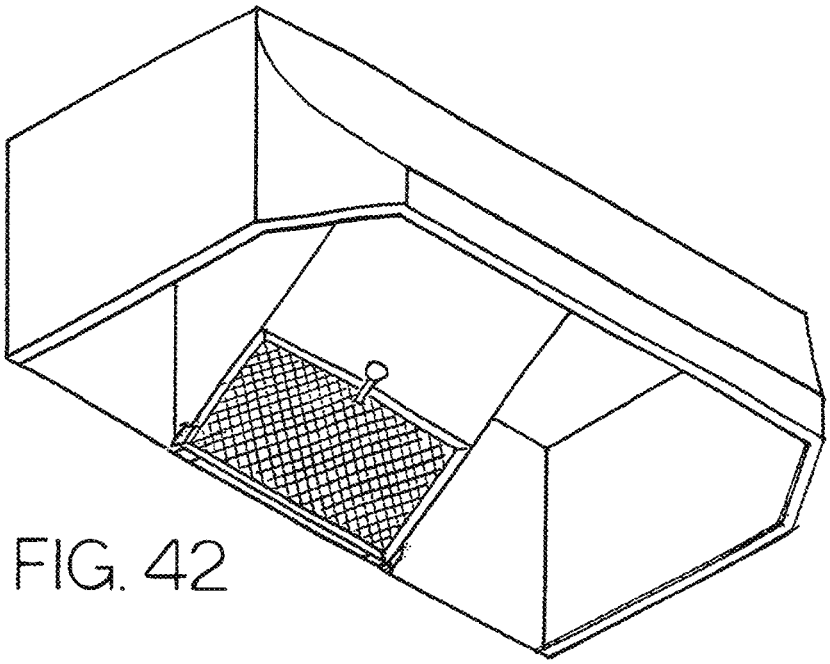
FIG. 42—(Prior Art I Hood) is a perspective view of the basic underside of a typical commercial and residential vent hood showing a slanted filter system against a rear side.
Figure 43:
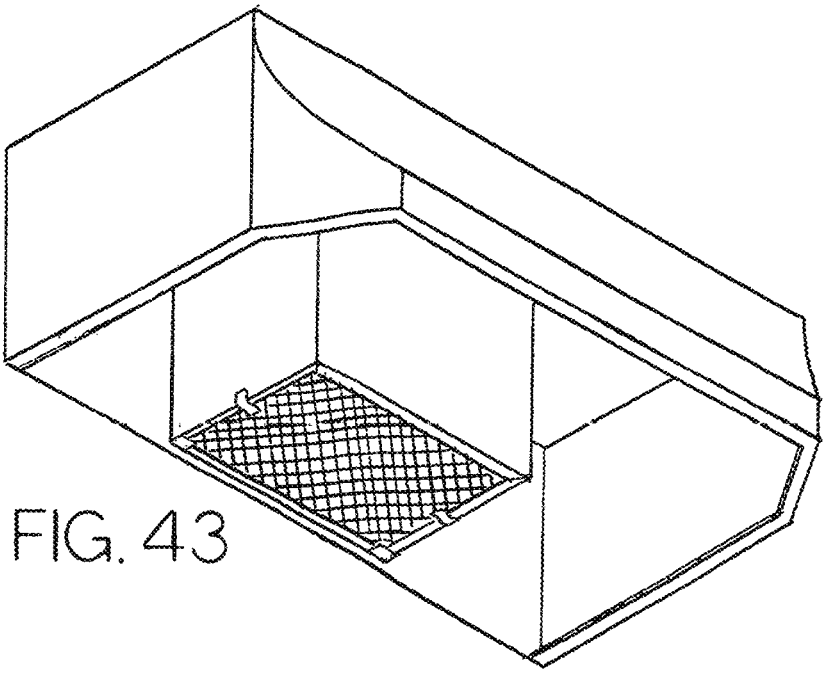
FIG. 43—(Prior Art II Hood) is a perspective view of the basic underside of a typical commercial and residential vent hood showing a horizontal filter system against a rear side.
Figure 44:
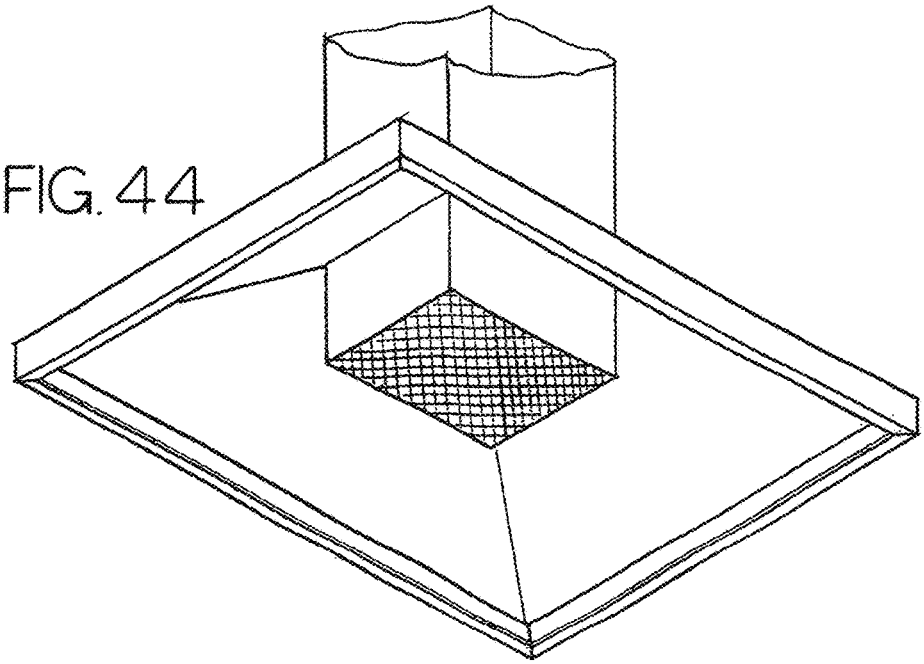
FIG. 44—(Prior Art III Hood) is a perspective view of the underside of a typical commercial or residential vent hood with a centrally located horizontal filter system usually used for an island or peninsula range.
Figure 45:
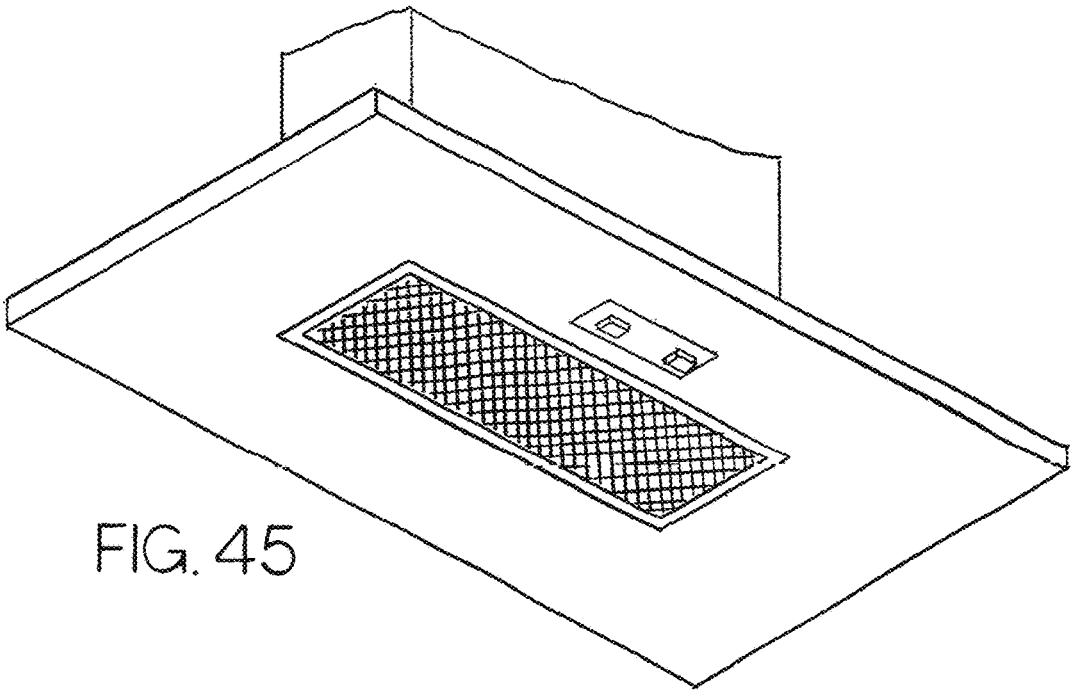
FIG. 45—(Prior Art IV Hood) is a perspective view of the underside of a slimline designed vent hood with a horizontal filter system that is flushed with the bottom.
Figure 46:
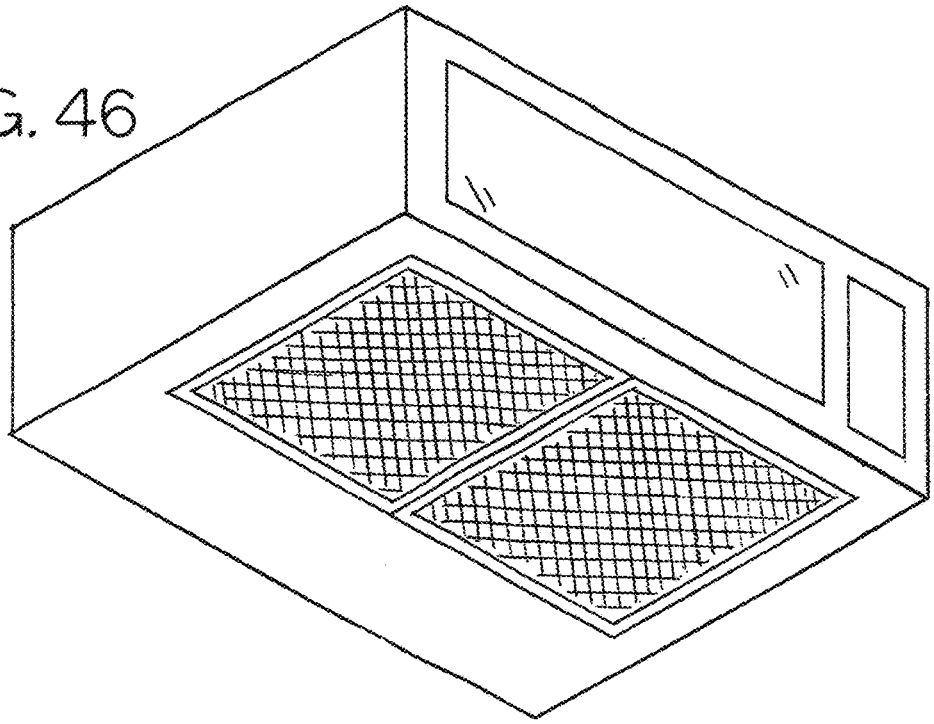
FIG. 46—(Prior Art V Hood) is a perspective view of the underside of an over-the-range microwave and vent hood having a horizontal filter system on its underside.
Figure 47:
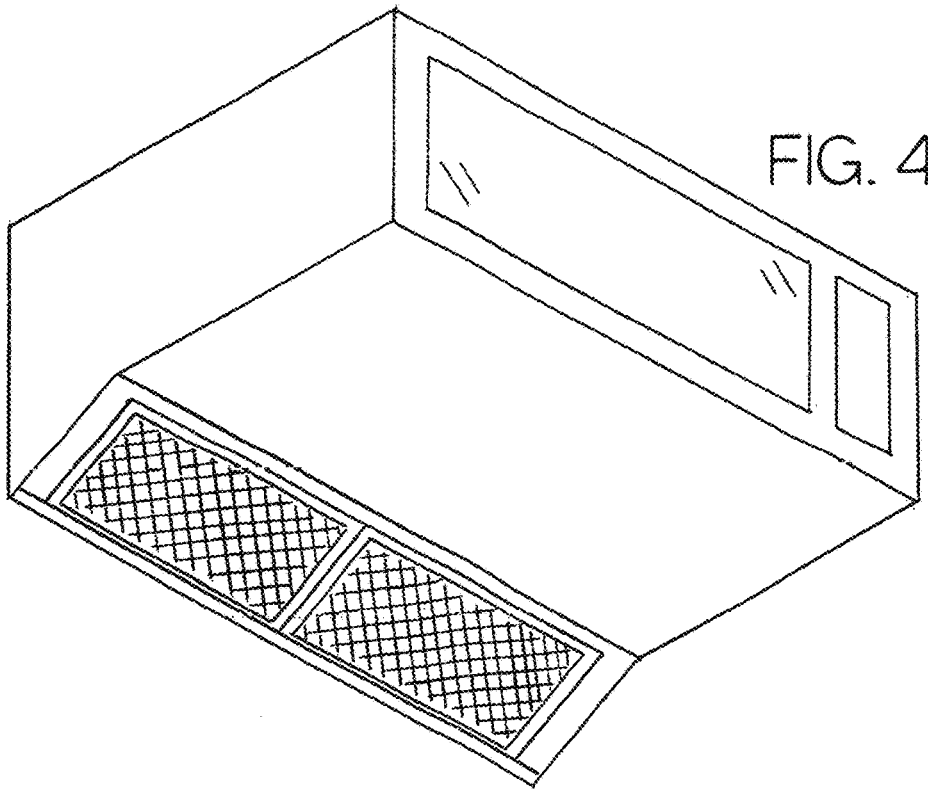
FIG. 47—(Prior Art VI) is a perspective view of the underside of an over-the-range microwave and vent hood having a slanted filter system against a rear side.
Figure 48:
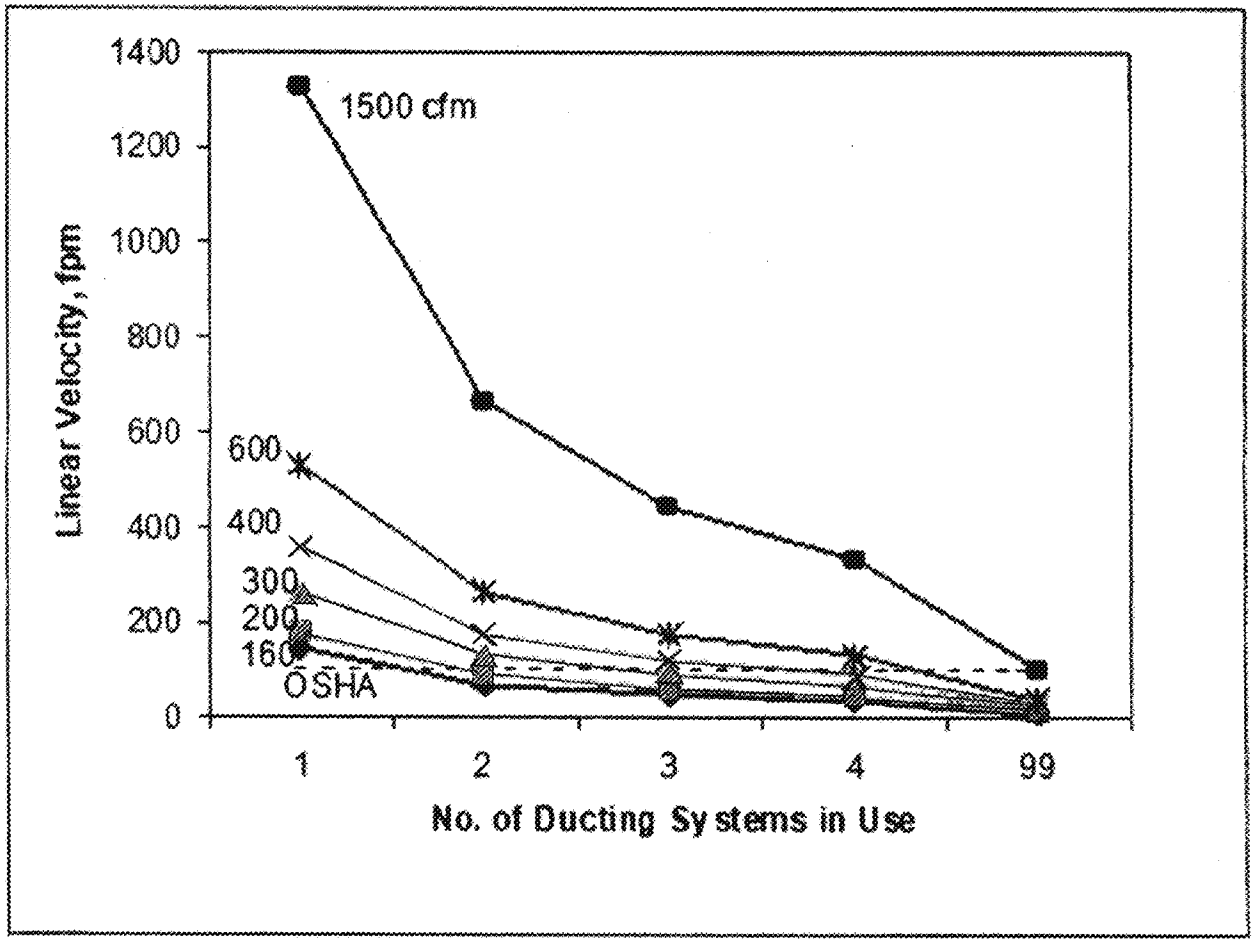
FIG. 48—a graph of linear velocities realized right at the mouth of the fume and odor source versus the number of ducting systems of the vent extender used.
Figure 49:
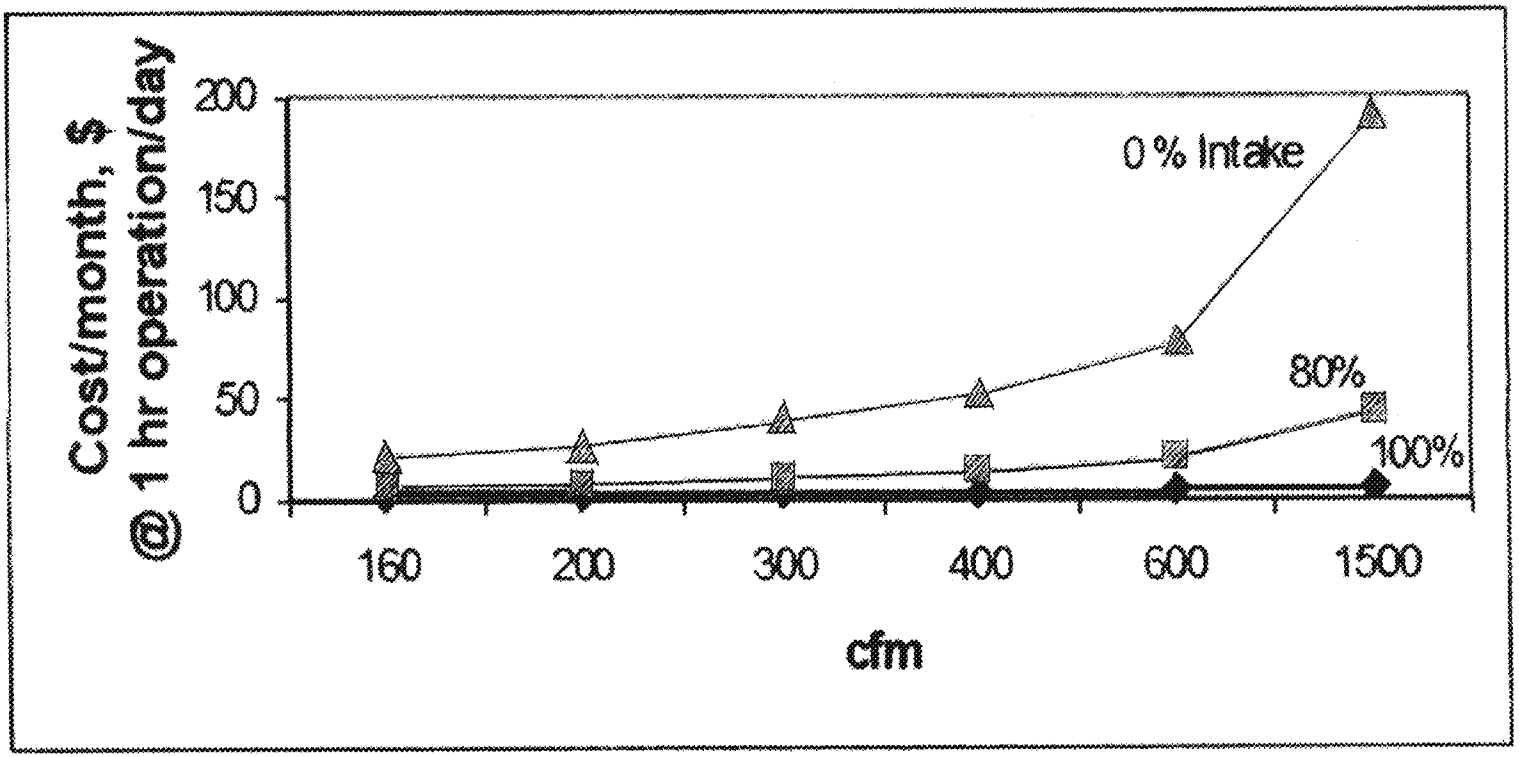
FIG. 49—a graph of operating cost per month versus different cfm (cubic ft. per min.) ratings of range hoods for different % usages of intake air.

FIG. 35 shows a method of flexing a ducting system of rigid parts 580 using a series of elbows that can swivel about their coupled ends.

Figure 36:
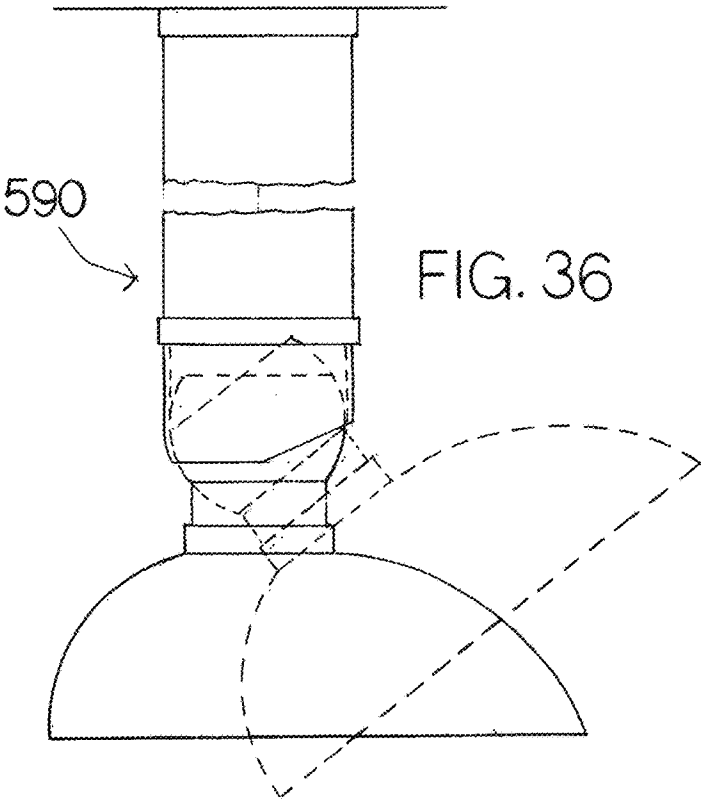
FIG. 36—a left side view of a ducting system having the ability to tilt a canopy by using a ball and socket-type joint at its final upstream end.

FIG. 36 shows a method of flexing a ducting system of rigid parts 590 comprising a ball and socket joint. A series of these joints may comprise all or part of the entire ducting system for increased flexibility.

FIGS. 37-A to 37-D show a 1000 version of the vent extender with provision for intake air for a Prior Art I kitchen hood 90'. Referring to FIG. 37-B, air is introduced through a narrow primary intake air inlet 1001 at the side of the hood, down through an intake director 1009, through intake enclosure 1006, through intake enclosure opening 1013, through intake tube 1002, through intake canopy top, through intake canopy, and out through the bottom of intake canopy 1003 where it is needed. Intake air now laden with cooking odors and grease are sucked up through an exhaust canopy 1004, through canopy top 1014, through exhaust tube 1005, through exhaust enclosure inlet opening 1012, through exhaust enclosure 1007, and finally through the filter and exhaust system of hood 90'. The exhaust parts are basically the elements in a vent extender that does not have intake air provision. A cover 1008 is provided for an unused exhaust/intake enclosure opening. Separate covers for the exhaust and intake enclosure openings can be designed.

Referring to FIG. 37-D, the left side has an inwardly directed flange 1016 under a slit 1017 where a C-cleat 1011 can go through. A C-cleat is first clamped on the left hemmed bottom 90'-2 of hood 90'. A magnet 1010 is placed at the bottom of intake director 1009. Flange 1016 of the hood adaptor is brought next to the free slit opening of the C-cleat and urged from left to right, the flange mating with the C-cleat. At the same time, the intake side is also urged to rest on the right hemmed bottom 90'-2 of hood 90'.

FIGS. 38-A, 38-B and 38-D show a 2000 version of the vent extender with provision for intake air for a Prior Art II kitchen hood 93'. It works just like the 1000 version above, 20XX parts corresponding to 10XX parts. Intake air inlet 2001 is shown as a circular opening simply for variation purposes. The exhaust enclosure 2007 is dropped below the bottom of the hood 93' revealing more of the adaptor. Installation is basically the same as that of the 1000 version although there is the option of clamping the hemmed bottom 93'-2 of hood 93' and the flange 2016 of the hood adaptor at the same time because one's hand can access the slit 2017 through the exhaust enclosure inlet opening.

FIG. 39-A shows a vent hood with the intake air director 900 already built in. The SE vent adaptor 3000 of FIG. 39-B for a Prior Art II kitchen hood 93' and the HE vent adaptor 4000 of FIG. 39-C for a Prior Art I kitchen hood 90' therefore do not include any intake air director. Secondary intake air inlets 3001 and 4001 are accommodated. Installation methods described earlier in the no-intake air versions can be employed.

Referring back to FIG. 37-B, assembly of the double tube and double canopy combination is as follows:

a) exhaust tube 1005 is nested inside intake tube 1002,
b) tubes in (a) are positioned vertically on the range top directly underneath their respective adaptor openings—exhaust enclosure inlet opening 1012 and intake enclosure opening 1013,
c) the top end of exhaust tube 1005, also called the exhaust downstream end, is lifted up and connected to inlet opening 1012,
d) the top end of intake tube 1002, also called the intake upstream end, is lifted up and connected to intake enclosure opening 1013,
e) exhaust canopy 1004 is nested inside intake canopy 1003,
f) the nested canopies in (e) are positioned directly underneath tubes 1004 and 1003 on the range top,
g) the top opening 1015 of intake canopy 1003 is connected to the bottom of intake tube 1002, and h) the top opening 1014 of exhaust canopy 1004 is connected to the bottom of exhaust tube 1005.

An alternative assembly means is as follows:

a) the exhaust and intake tubes are connected to their respective canopies, b) the exhaust tube-canopy assembly in (a) is nested inside the intake tube-canopy assembly in (a), c) the nested assembly in (b) is positioned underneath the inlet and intake openings of the adaptor, d) the exhaust tube-canopy assembly is lifted and its downstream end (top end) is attached to an inlet opening (the intake tube-canopy assembly may cause to be lifted), and e) the intake tube-canopy assembly is lifted and its intake upstream end (top end) is attached to an intake enclosure opening.

FIG. 40-B shows the possible assembly parts of a typical self-enclosed dual vent extender 5000 for a Prior Art II type of vent hood. The intake air enclosure is created by the addition of a raised floor 5003 with exhaust enclosure inlet openings 5003-1 over an adaptor bottom 5004 with intake enclosure openings 5004-1. The exact locations of openings 5003-1 and 5004-1 are predetermined so that they are concentric. A director insert 5002 directs the intake air from the mouth 900-1 of the fan housing 900 into the intake air enclosure while bypassing the exhaust enclosure. The adaptor top 5001 completes the exhaust enclosure. The addition of a riser 100-12 shown in FIG. 12-B to adaptor top 5001 adapts the vent extender 5000 to a Prior Art I hood.

FIG. 40-A shows a possible way of installing the assembled dual vent extender of FIG. 40-B onto a Prior Art II vent hood. The provision for intake air can be as simple as adding an air intake fan and duct to the outside, the reverse of an exhaust system. The fan housing 900 can be placed side by side with the existing exhaust fan housing for a compact and united effect. The bottom rim of the hood can be further redesigned to include a hem 88 at the rear side and the addition of another hem 87 below the existing side hem for the side flanges 5004-2 and side edges of top 5001 to readily slide through.

FIG. 41-A is a cross-sectional view of a vent extender with intake air option using the vent adaptor of FIG. 41-B (cut along plane CC) and a double-walled canopy 750. The exhaust and intake tubes for use with this canopy are not concentric. Consequently, the inlet opening is not nested inside the intake enclosure opening. The double-walled 750 canopy can be viewed as comprising of two canopies, a second canopy 750-2 over a smaller first canopy 750-1. The second canopy 750-2 has a connector opening 750-21 and a second opening 750-22. The first canopy 750-1 has a first opening 750-11. A connecting tube 775 having a top end and a bottom end connects the first opening 750-11 with the connector opening 750-21. The top end of the connecting tube 775 is snugly received inside the connector opening 750-21 of the second canopy while the bottom end of the connecting tube 775 is snugly received inside the first opening 750-11, therefore, preventing air coming through the connecting tube from going to the differential cross-sectional area of the two canopies. The top end of the connecting tube 775 is connected to an exhaust tube 565 communicating with an exhaust ventilation system A while the second opening is connected to an intake tube 575 communicating with an intake air source B. Like before, intake air is released through the differential cross-sectional area between the two canopies while exhaust air is sucked up through connecting tube 775.

FIG. 41-B shows the assembly of parts of the SE vent adaptor 6000 for use with canopy 750. Exhaust inlet openings 6003-1 of raised floor 6003 is snugly received into intake bypass opening 6004-1 of adaptor bottom 6004 and connects to exhaust tube 565. Intake enclosure opening 6004-2 connects to intake tube 575. Adaptor top 5001 and director insert 5002 complete the assembly. At least one end of each of tubes 565 and 575 should have a swiveling connection with the canopy or enclosure openings. No swiveling connection is required if clamping is the means of connecting.

The vent extenders using intake air can be applied to ventilation with or without an over-the-range type hood as an efficient and economical means to provide intake air. The top ends of the ducting system can be directly connected to remote exhaust power and intake air sources.

All "single" vent extenders (no provision for intake air) presented earlier can be adapted to become "dual" vent extenders with the addition of an intake enclosure, and an intake air director insert if necessary for bypassing the exhaust enclosure. The installation means are also adaptable. The hood enclosed (HE) type adaptor using panels and T bars can be equipped with an intake enclosure by suspending a box enclosure, one part at a time from the T bars of the original adaptor bottom, by suspending a box enclosure from the bottom hem of the hood, by replacing the panels with parts of a box enclosure, by replacing the panels with individual box enclosures each communicating with the intake air source, and by many other means. Indeed, the possibilities are numerous.

CONCLUSION AND RAMIFICATIONS

The range hood industry has come up with so many designs and capacities for ventilating systems. The benefits derived using the present invention can be applied to all of them. Adapting a hood enclosure to specialty-type or deluxe range hoods found in fine and fancy homes and commercial establishments becomes a problem only of more exacting specifications and design. The exhaust-enclosure-inlet-duct-canopy idea is the same.

As mentioned before, there are innumerable ways an enclosure, mounting means, ducting system and canopy can be put to practice and the present disclosure covers just some of them. Other variations will still employ the same idea. Some of these variations comprise:

a) A hood adaptor with and without intake air may be shaped, sized, and colored specifically for every brand, model, size, and color of range hood that is commercially available or custom-made including those hoods that are redesigned to include better or additional supporting means for the adaptor, b) the ducting system may be made up of interchangeable ducting units and also interchangeable between range hood brands, c) The ducting system and canopy may have other means to connect to an air intake duct to achieve air intake usage of close to 100%, or intake air can be introduced through other locations within the hood, d) the hood adaptor top for the self-enclosed hood adaptor may be molded to better approximate the underside cavity of a range hood, e) the hood-enclosed hood adaptor may include a "spray shield" or director positioned right over each inlet opening designed for its specific location relative to the outlet opening for enhancing efficiency and preventing grease that would have otherwise stayed on the roof of the hood underside, f) the rim of the outlet opening may be lined with an easily removable and replaceable flexible sealing strip or pleated material like rubber, plastic or thin flexible metal or the like, preferably grease resistant in order to better harness the suction power of the exhaust fan and to accommodate range hoods that can have filters positioned at different angles or clearances relative to the bottom of the hood, g) the outlet opening for the enclosure may also be adjustable for filters of differing sizes, h) the ducting system can be collapsed partially or completely into the enclosure when not in use, i) provision for openings on the adaptor for switches and light fixtures, that can be closed in order to preserve the power from the exhaust fan, yet can be detached from the adaptor when the adaptor is taken down for cleaning, j) other mounting means to mount and anchor the hood adaptor to the underside of the range hood and to keep the adaptor parts from shifting upward due to the power of the exhaust fan comprising other types of cleats, brackets, bars, magnets, velcro, tape, telescoping tubes, spring loaded nested tubes, screws, including permanent accommodations on the underside of the range hood, etc.

k) other connecting means to connect the downstream end of the ducting system to the inlet opening of the hood adaptor like tube clamps, snap-on clamps similar to those used in cake baking pans, larger versions of snap-on C clamps used for holding tools, knob bolts, thumb screws, hook and loop closures, adhesive, magnets, etc.

l) the entire hood adaptor bottom mounted on the range hood underside may be made up of several smaller panels such that the homeowner can rearrange the number and the location of the inlet openings and light panels to better match the location of the range burners, and light fixture respectively, m) the outer edges of the adaptor including mounting means may be lined with vinyl or rubber and made to snugly fit and protect the finish of the range hood, n) enhancing attachment means between the ducting system and the inlet opening to the hood adaptor like rubber or vinyl lined threads, thumb screws, clamps, or the like, o) other means of covering the unused inlets including the plug-in type inserted directly to the inlet openings, to the upstream end of the ducting system, or to the top opening of the canopy, and a sliding cover inside the enclosure providing variable inlet opening size, p) other flexing means to flex the ducting system, q) provisions to accommodate a) a flexible duct attached to an inlet opening but cannot support its shape or b) a duct that can support its shape, its downstream end positioned as close as possible to the exhaust filter, which may comprise one of the following: a pedestal support for the bottom of the canopy, a wall mounted support arm for the canopy, a free-standing support arm for the canopy, or a large or heavy canopy supported by the range top, r) other swiveling means to swivel the tube disposed towards the final downstream end of the ducting system or the canopy towards the final upstream end, s) provisions to accommodate canopies of different shape and size including canopies with side openings, flip-up or sliding windows to access the vapor source without being tilted, t) may be used for venting purposes other than a cooking environment. If the present invention were made of stainless steel or similar chemical resistant material, it can be combined with any ordinary stainless steel over-the-range hood to produce an effective yet inexpensive substitute for an expensive fume hood for laboratory or commercial purposes. A fume hood with a very high cfm capacity made especially for laboratory use can already run from $5,000 to $10,000, many many times the possible cost of the present invention.

u) the hood adaptor bottom could be made of material that can be flexed into the underside of the range hood and made to rest in the bottom hem of the hood as one piece yet rigid and strong to support up to four ducting systems with canopies.

v) the 3-dimensional or box hood adaptor bottom and 2-dimensional hood adaptor top combination like those shown in FIGS. 7-A and 8-A may be replaced with a 3-dimensional hood adaptor top and a 2-dimensional hood adaptor bottom combination, w) an area of the hood adaptor bottom that are not occupied by inlet openings may be provided with little openings connected upstream to an intake air source through channels running along the face of the adaptor bottom, thus providing "jets" of intake air to the cooking region below, x) the intake air source is connected downstream to channels running along the outside of the ducting system and terminating into the mouth or the inside of the canopy protected from entry of exhaust vapors by a one-way valve or cover if necessary, y) spacers between the exhaust ducting system and the intake ducting system may be added if necessary to maintain clearance even when the ducting is flexed or to fabricate the exhaust and intake tubes and/or the exhaust and intake canopies each as one piece, Z1) the exhaust ducting system envelopes the intake ducting system, and Z2) the vent extender is used for delivering intake air instead of sucking out exhaust air.

I claim:

1. A vent extender apparatus for confining the suction power of a ventilation system prior to delivering said power to close proximity of a fume and odor source via a downwardly extending tube, wherein said ventilation system is an over-the-range type hood having an underside, a primary filter location, an exhaust fan downstream from said primary filter location, said vent extender apparatus comprising:

a) a panel assembly arranged and sized to enclose at least the entire primary filter location in said hood;

b) wherein said assembly has at least one inlet opening equipped to accept a downwardly extending tube;

c) securing means for mounting said assembly upstream of the underside of said hood and upstream of said primary filter location; and d) wherein said inlet opening is spaced apart from said primary filter location;

whereby a 3-D enclosure is created upstream of the primary filter location to capture gas condensates and minimize filter clogging and whereby the securing means allows for easy set-up and removal for cleaning, and can provide a secure installation for the enclosure and its downwardly extending tubes.

2. The vent extender apparatus of claim 1 wherein said securing means comprises a selection from a group consisting of cleats, T-bars, L-bars, sliding panels, tension rods, or their equivalents.

* * * * *